US012680274B2

(12) United States Patent
Wakata et al.

(10) Patent No.: US 12,680,274 B2
(45) Date of Patent: Jul. 14, 2026

(54) CONSTRUCTION MACHINE

(71) Applicant: Yanmar Holdings Co., Ltd., Osaka (JP)

(72) Inventors: Tatsumasa Wakata, Chikugo (JP); Kazuki Takeda, Chikugo (JP); Seiya Norimoto, Chikugo (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 10 days.

(21) Appl. No.: 18/396,626

(22) Filed: Dec. 26, 2023

(65) Prior Publication Data

US 2024/0229422 A1 Jul. 11, 2024

(30) Foreign Application Priority Data

Dec. 28, 2022 (JP) ..... 2022-212777
Dec. 28, 2022 (JP) ..... 2022-212778
Dec. 28, 2022 (JP) ..... 2022-212779

(51) Int. Cl.
*E02F 9/22* (2006.01)
*E02F 9/08* (2006.01)
*E02F 9/16* (2006.01)

(52) U.S. Cl.
CPC ..... *E02F 9/2275* (2013.01); *E02F 9/0883* (2013.01); *E02F 9/16* (2013.01); *E02F 9/2267* (2013.01)

(58) Field of Classification Search
None
See application file for complete search history.

(56) References Cited

U.S. PATENT DOCUMENTS 7,854,284 B2 * 12/2010 Wada ..... E02F 9/2275 180/6.58
12,031,296 B2 * 7/2024 Fujishima ..... E02F 9/2267

FOREIGN PATENT DOCUMENTS

EP 1992745 A1 11/2008
JP H05270282 A 10/1993
JP H10121518 A 5/1998
JP 2000291059 A 10/2000
(Continued)

OTHER PUBLICATIONS

JP 2007212382 A machine translation to English from PE2E (Year: 2025).*
JP-2015232208-A machine translation to English from PE2E (Year: 2025).*
(Continued)

*Primary Examiner* — Michael Quandt
(74) *Attorney, Agent, or Firm* — NORTON ROSE FULBRIGHT US LLP

(57) ABSTRACT

An excavation work machine includes a hydraulic oil tank provided in a tank chamber and storing hydraulic oil that actuates a plurality of hydraulic actuators, a control valve controlling a flow of pressure oil supplied from the hydraulic oil tank to each of the hydraulic actuators, a plurality of hydraulic hoses extending from the control valve and communicatively connected to each of the hydraulic actuators, and a fuel tank that is provided in a front portion in the tank chamber covered with a hood provided to be openable and closable and stores fuel to be supplied to an engine. The plurality of hydraulic hoses are arranged along a rear surface portion of the hydraulic oil tank, and a fuel supply pump is provided in a space portion formed above a step portion in a front portion of the tank chamber.

20 Claims, 32 Drawing Sheets

(56) References Cited

FOREIGN PATENT DOCUMENTS

| | | | | |
|---|---|---|---|---|
| JP | 2002-088805 | A | | 3/2002 |
| JP | 2002089391 | A | * | 3/2002 |
| JP | 2007212382 | A | * | 8/2007 |
| JP | 2007224568 | A | | 9/2007 |
| JP | 200895326 | A | | 4/2008 |
| JP | 2008196234 | A | * | 8/2008 |
| JP | 2008-285829 | A | | 11/2008 |
| JP | 2010101306 | A | | 5/2010 |
| JP | 201164132 | A | | 3/2011 |
| JP | 2014159719 | A | | 9/2014 |
| JP | 2015232208 | A | * | 12/2015 |
| JP | 2016125242 | A | | 7/2016 |
| JP | 2017-166224 | A | | 9/2017 |
| JP | 2017160750 | A | | 9/2017 |
| JP | 2020139328 | A | | 9/2020 |
| JP | 202255033 | A | | 4/2022 |

OTHER PUBLICATIONS

JP-2008196234-A machine translation to English from PE2E (Year: 2025).*

JP-2002089391-A machine translation to English from PE2E (Year: 2025).*

1 Partial European Search Report dated May 29, 2024, issued in EP Patent Application No. 23216939.1.

Japanese Office Action mailed on Dec. 2, 2025, issued in JP Application No. 2022-212777.

Japanese Office Action mailed on Dec. 2, 2025, issued in JP Application No. 2022-212779.

* cited by examiner

CONSTRUCTION MACHINE

CROSS-REFERENCE TO RELATED APPLICATION

This application claims priority under 35 U.S.C. § 119 to Japanese Patent Application Nos. JP2022-212777, filed on Dec. 28, 2022, JP2022-212778, filed on Dec. 28, 2022, and JP2022-212779, filed on Dec. 28, 2022, the entire contents of which are hereby incorporated by reference in their entireties.

TECHNICAL FIELD

The present invention relates to a construction machine including a hydraulic oil tank that stores hydraulic oil that actuates a hydraulic actuator, a tank chamber that houses a fuel tank, the hydraulic oil tank, and the like, and a control valve for controlling a flow of pressure oil supplied from the hydraulic oil tank to various hydraulic actuators.

BACKGROUND ART

Conventionally, a construction machine such as an excavation work machine includes a hydraulic oil tank that stores hydraulic oil that actuates a hydraulic actuator such as a hydraulic cylinder, and a control valve for controlling a flow of pressure oil supplied from the hydraulic oil tank to various hydraulic actuators (see, for example, Patent Document 1). The hydraulic oil tank is provided with a level gauge (liquid level gauge) for grasping the amount of oil in the tank (see, for example, Patent Document 2). According to the level gauge of the hydraulic oil tank, for example, as an inspection work before starting the work by the construction machine, the oil amount in the hydraulic oil tank is checked by visually observing the level gauge. A plurality of hydraulic hoses for supplying pressure oil to the respective hydraulic actuators extend from the control valve. Further, there is a configuration in which a tank chamber that houses a fuel tank, a hydraulic oil tank, and the like is provided on a swivel body mounted above a traveling body, and a fuel supply pump for supplying fuel to the fuel tank is provided in the tank chamber as one type of functional component (see, for example, Patent Document 3). According to the fuel supply pump, fuel in a container such as a drum can is sucked through a hose and automatically supplied into the fuel tank.

Patent Document 1 discloses an arrangement of a plurality of hydraulic hoses extending from a control valve, in which a hydraulic oil tank is disposed behind a fuel tank and the control valve is disposed on a side surface of the hydraulic oil tank, and a clearance between the fuel tank and the hydraulic oil tank and a clearance below the hydraulic oil tank and the control valve are used as spaces for routing the plurality of hydraulic hoses. Patent Document 2 discloses a configuration of a hydraulic shovel, in which a level gauge is provided on a side surface of a hydraulic oil tank, and the level gauge is disposed at a position in a gap between a lateral decorative cover that covers the hydraulic oil tank from a lateral side and a pump chamber door. According to the configuration disclosed in Patent Document 2, the level gauge can be visually observed from the gap between the lateral decorative cover and the pump chamber door, and thus the amount of oil in the hydraulic oil tank can be checked by the level gauge without opening the pump chamber door. Regarding the arrangement of the fuel supply pump in the tank chamber, Patent Document 3 discloses a configuration in which a hydraulic oil tank is disposed behind a fuel tank provided in the front right side portion of a swivel body, and an automatic supply unit with a fuel supply pump is provided in a housing space formed by leaving a gap between the hydraulic oil tank and the fuel tank. In such a configuration, the fuel supply pump is disposed in an arrangement space formed in a notched shape on the lower left side of a flat unit case interposed between the hydraulic oil tank and the fuel tank, in a state of being attached to the unit case.

PRIOR ART DOCUMENT

Patent Document

Patent Document 1: Japanese Unexamined Patent Publication No. 2008-285829

Patent Document 2: Japanese Unexamined Patent Publication No. 2002-88805

Patent Document 3: Japanese Unexamined Patent Publication No. 2017-166224

SUMMARY OF INVENTION

Technical Problem

The configuration disclosed in Patent Document 1 has the following problems. The plurality of hydraulic hoses extend from the control valve in directions different from one another and are arranged in spaces on sides different from one another around the control valve, and thus there is a problem that maintenance such as replacement of the hydraulic hoses is difficult. In particular, since a clearance between the fuel tank and the hydraulic oil tank and a clearance below the hydraulic oil tank and the control valve are limited spaces, it is difficult to secure a working space around the hydraulic hoses, according to a configuration in which these clearances are used as an arrangement space of the hydraulic hoses, which is not preferable in terms of maintainability. Further, the configuration disclosed in Patent Document 2 has the following problems. The gap for visually observing the level gauge of the hydraulic oil tank is a gap between a lateral decorative cover, which is an exterior member provided on a lateral side of a swivel body mounted above a traveling body in a hydraulic shovel, and a pump chamber door, and enables the level gauge to be visually observed from the lateral side outside the swivel body. The lateral decorative cover is provided on the opposite side of the driver's cab with the excavation work machine interposed therebetween in the left-right direction. In such a configuration, the level gauge cannot be visually recognized from the driver's cab provided in the swivel body. Further, the tank chamber is covered with a cover forming an exterior of the construction machine, and supply of fuel to the fuel tank and the like are performed in a state where the cover is opened. According to the arrangement configuration of the fuel supply pump as disclosed in Patent Document 3, the fuel supply pump is arranged on the lower left side of the unit case in the gap space between the hydraulic oil tank and the fuel tank, and thus it is difficult to visually recognize the fuel supply pump in a state where the cover of the tank chamber is opened, and there is a problem that maintenance of the fuel supply pump cannot be easily performed.

The present invention has been made in view of the above-mentioned problems, and it is an object of the present invention to provide a construction machine capable of easily visually recognizing a level gauge of a hydraulic oil tank even from a driver's seat side, easily checking an oil amount in the hydraulic oil tank, and obtaining good workability, or a construction machine capable of obtaining good maintainability for a functional component such as a plurality of hydraulic hoses extending from a control valve and a fuel supply pump provided in a tank chamber.

Solution to Problem

A construction machine according to the present invention includes a hydraulic oil tank provided in a tank chamber and storing hydraulic oil that actuates a plurality of hydraulic actuators, a driver's seat provided on a lateral side of the tank chamber, a level gauge that is provided on the driver's seat side of the tank chamber and indicates an amount of the hydraulic oil in the hydraulic oil tank, a control valve for controlling a flow of pressure oil supplied from the hydraulic oil tank to each of the hydraulic actuators, and a plurality of hydraulic hoses extending from the control valve and communicatively connected to each of the hydraulic actuators. The plurality of hydraulic hoses are arranged along a side surface portion of the hydraulic oil tank.

A construction machine according to another aspect of the present invention is such that, in the construction machine, a swivel frame provided with the tank chamber and the driver's seat is included, and the level gauge is disposed above a front portion of the swivel frame.

A construction machine according to another aspect of the present invention is such that, in the construction machine, the level gauge is communicatively connected to the hydraulic oil tank via a connection hose.

A construction machine according to another aspect of the present invention is such that, in the construction machine, a fuel tank disposed in front of the hydraulic oil tank is included, and the level gauge is disposed on a lateral side of the fuel tank.

A construction machine according to another aspect of the present invention is such that, in the construction machine, the tank chamber is covered with a cover member provided to be openable and closable, an other level gauge that is provided in the tank chamber and indicates an amount of the hydraulic oil in the hydraulic oil tank is included, and the other level gauge is disposed at a position where the other level gauge can be visually observed in a state where the cover member is opened.

A construction machine according to another aspect of the present invention is such that, in the construction machine, a driver's seat provided on a lateral side of the tank chamber is included, and the control valve is disposed on a side opposite to the driver's seat side with respect to the hydraulic oil tank.

A construction machine according to another aspect of the present invention is such that, in the construction machine, a side surface portion of the hydraulic oil tank is a side surface portion on a rear side.

A construction machine according to another aspect of the present invention is such that, in the construction machine, one end side of each of the hydraulic hoses is connected to a side surface portion on a left and right outside of the control valve via a connection member, and the connection member is configured in such a manner that the hydraulic hoses extend rearward from the side surface portion on the left and right outside.

A construction machine according to another aspect of the present invention is such that, in the construction machine, a holding section that holds an intermediate portion of the hydraulic hoses against a side surface portion of the hydraulic oil tank is provided on the side surface portion of the hydraulic oil tank.

A construction machine according to another aspect of the present invention is such that, in the construction machine, the holding section is provided at a plurality of locations above and below.

A construction machine according to another aspect of the present invention is such that, in the construction machine, a fuel tank disposed in front of the hydraulic oil tank is included, and an equipment attachment section for attaching hydraulic equipment provided to a path of hydraulic oil stored in the hydraulic oil tank or a path of fuel stored in the fuel tank is provided on a left and right outside of the fuel tank.

A construction machine according to another aspect of the present invention is such that, in the construction machine, the tank chamber is covered with a cover member provided to be openable and closable, an operation pattern switching unit that is provided on a front side of the fuel tank in the tank chamber and switches a pattern of hydraulic pressure input to the control valve in response to an operation of an operation unit provided near the driver's seat to thereby switch an operation pattern of the operation unit is included, and the operation pattern switching unit is disposed at a position where a switching operation can be performed in a state where the cover member is opened.

A construction machine according to another aspect of the present invention is a construction machine that includes a tank provided in a front portion in a tank chamber covered with a cover member provided to be openable and closable, and is such that the tank has a step portion in a front portion, and a functional component is provided in a space portion formed above the step portion in the tank chamber.

A construction machine according to another aspect of the present invention is such that, in the construction machine, the step portion has a rear side surface portion, a side surface portion, and a bottom surface portion, and is a notch-shaped portion that forms the space portion by these surface portions.

A construction machine according to another aspect of the present invention is such that, in the construction machine, a swivel frame on which the tank is installed is included, and the functional component is provided in a state of being supported by a support member attached to the swivel frame.

A construction machine according to another aspect of the present invention is such that, in the construction machine, a fixing member for fixing the tank to the swivel frame is included, and the tank is provided to be movable with respect to the swivel frame by releasing fixation by the fixing member.

A construction machine according to another aspect of the present invention includes, in the construction machine, an other tank provided in the tank chamber and disposed behind the tank, and has, as the fixing member, a first fixing member fixed to each of the other tank and the support member and a second fixing member also serving as the support member.

A construction machine according to another aspect of the present invention is such that, in the construction machine, the tank is a fuel tank that stores fuel to be supplied to a drive source, the functional component is a fuel supply pump for supplying fuel to the fuel tank, and an operation switch for turning on and off an actuation of the fuel supply pump is provided on the rear side surface portion of the step portion.

A construction machine according to another aspect of the present invention is such that, in the construction machine, a fuel gauge that indicates an amount of fuel in the fuel tank is provided on the rear side surface portion of the step portion.

A construction machine according to another aspect of the present invention is such that, in the construction machine, a hose accommodating portion that accommodates a suction hose for fuel suction by a fuel supply pump is provided in the tank chamber.

Advantageous Effects of Invention

According to the present invention, it is possible to easily visually recognize a level gauge of a hydraulic oil tank even from a driver's seat side, easily check an oil amount in the hydraulic oil tank, and obtain good workability, and it is possible to obtain good maintainability for a functional component such as a plurality of hydraulic hoses extending from a control valve and a fuel supply pump provided in a tank chamber.

DESCRIPTION OF EMBODIMENTS

In an embodiment of the present invention, the description will be made on an excavation work machine (shovel), which is a swivel work vehicle, as an example of a construction machine according to the present invention. However, the construction machine according to the present invention is not limited to the excavation work machine, and is widely applicable to other types of construction machines such as a bulldozer, a crane work machine, a compact truck loader, a skid steer loader, and a wheel loader.

Figure 1:
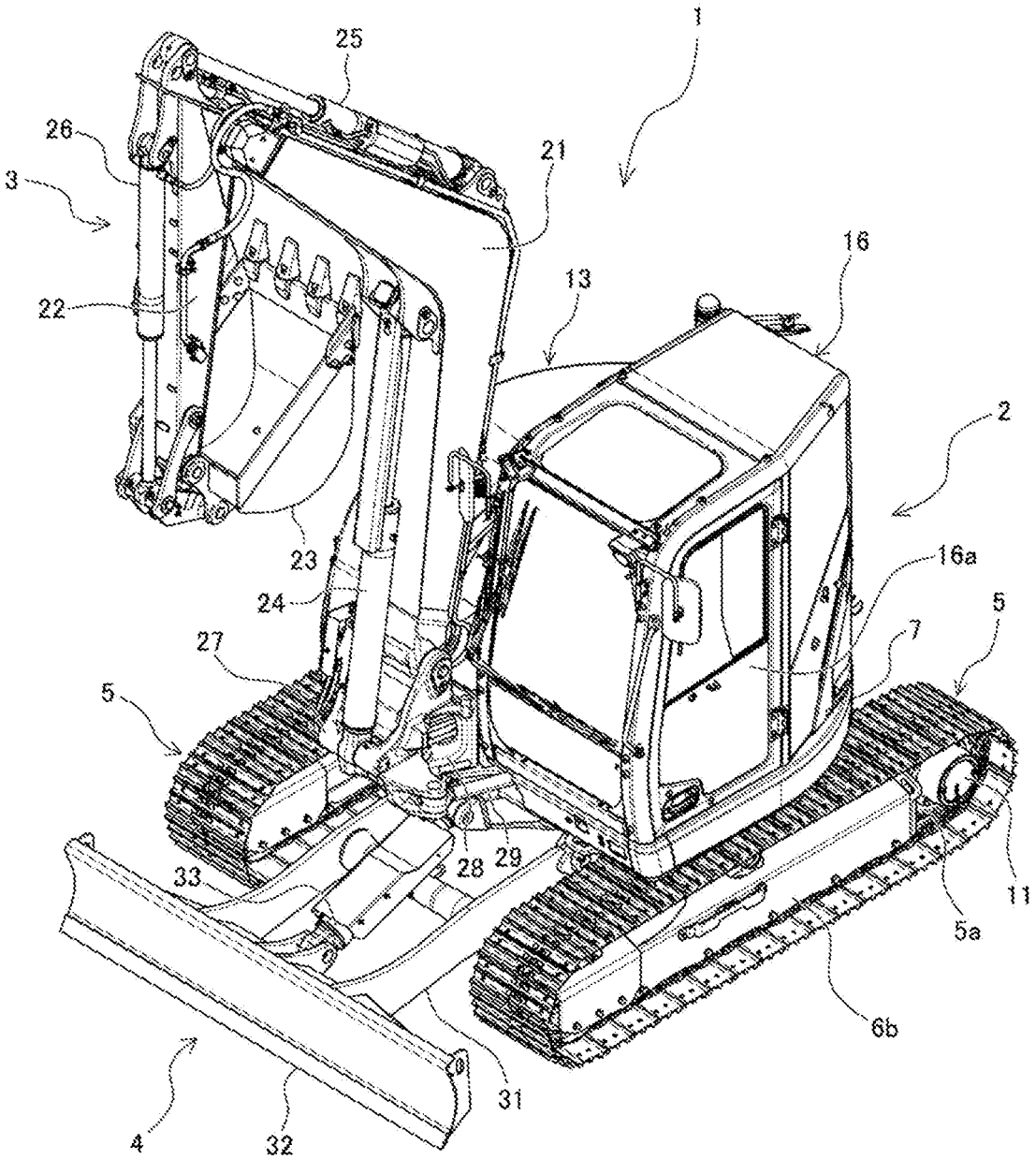
FIG. 1 is a left front perspective view of an excavation work machine according to one embodiment of the present invention.
Figure 2:
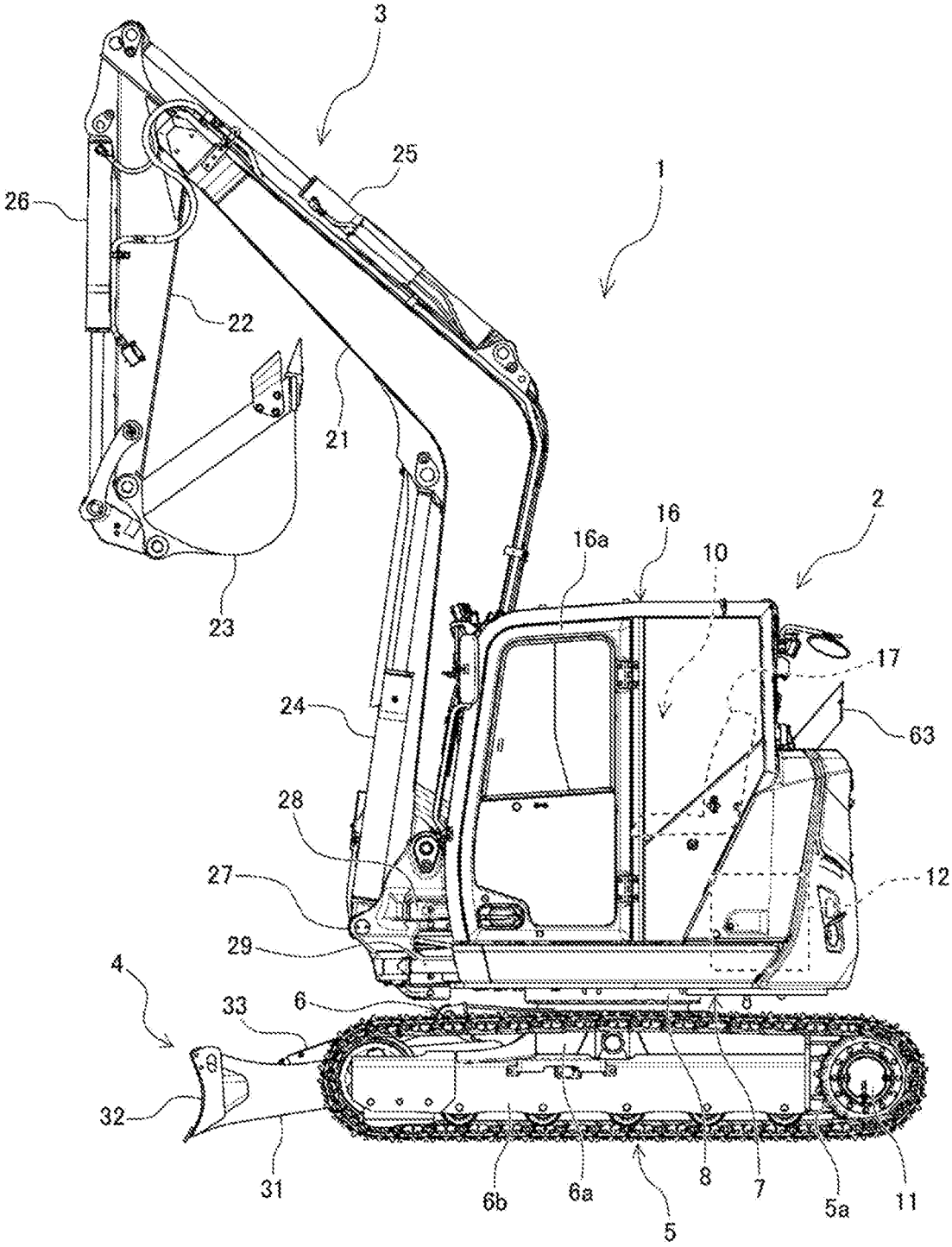
FIG. 2 is a left side view of the excavation work machine according to one embodiment of the present invention.
Figure 3:
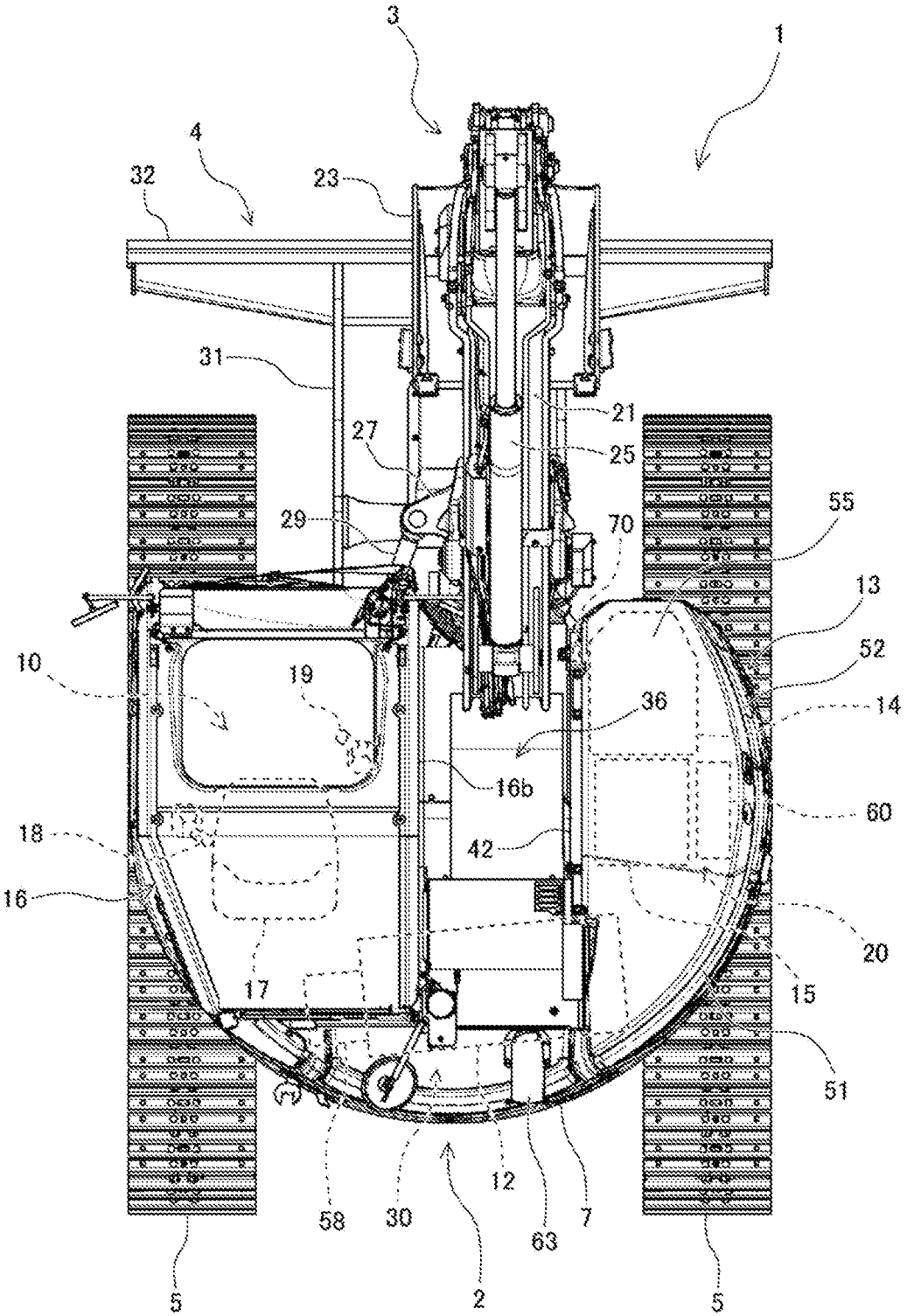
FIG. 3 is a plan view of the excavation work machine according to one embodiment of the present invention.

A description will be made on an overall configuration of an excavation work machine 1 according to the present embodiment with reference to FIGS. 1 to 3. As illustrated in FIGS. 1 to 3, the excavation work machine 1 includes a traveling apparatus 2 as a self-propelled traveling vehicle body, and an excavation unit 3 and a soil removal unit 4, each of which is a work unit mounted to the traveling apparatus 2.

The traveling apparatus 2 is a part constituting a main machine of the excavation work machine 1 and has a pair of crawler-type traveling units 5, 5 on the left and right, a machine body frame 6 as a base stand installed between the left and right traveling units 5, 5, and a swivel frame 7 installed on the machine body frame 6.

The traveling unit 5 has a configuration in which a crawler is wound around a plurality of rotating bodies such as sprockets and rollers supported by the machine body frame 6. The traveling unit 5 has, at a rear end thereof, a drive sprocket 5*a* as a drive wheel. The machine body frame 6 has a center frame section 6*a* positioned in the middle part between the left and right traveling units 5, 5 and side frame sections 6*b* disposed on both left and right sides of the center frame section 6*a*.

Each traveling unit 5 is provided with a traveling hydraulic motor 11. The traveling hydraulic motor 11 is provided so as to rotationally drive the drive sprocket 5*a* in a state of being attached to a predetermined portion such as the side frame section 6*b* of the machine body frame 6 in each traveling unit 5. Each of the left and right traveling hydraulic motors 11, 11 drives the traveling unit 5, which allows the traveling apparatus 2 to travel straightly back and forth or to swivel and travel to the left and right.

The swivel frame 7 is connected to the machine body frame 6 via a swivel support section 8 including a swivel bearing provided on the upper side of the center frame section 6*a*, and can be swiveled in either left or right direction about the vertical axis. The swivel frame 7 is swiveled by driving of a swivel motor (not illustrated) which is a hydraulic motor for swiveling.

A driving unit 10 is provided on the swivel frame 7. Further, a prime motor section including an engine 12 as a drive source is provided on the rear portion of the swivel frame 7. On the right side of the driving unit 10, a tank housing section 13 constituting a tank chamber 20 housing a fuel tank 14 and a hydraulic oil tank 15 is provided (see FIG. 3).

The driving unit 10 is for driving and operating the traveling apparatus 2, the excavation unit 3, and the soil removal unit 4, and is provided in a cabin 16 installed on the swivel frame 7. The cabin 16 has a frame that forms an outline thereof and a plurality of window parts made of a transparent member such as glass, and is configured as a whole in a substantially box shape. In the left side surface portion, the cabin 16 has an open/close door 16*a* that opens and closes an entrance for an operator to the driving unit 10.

In the cabin 16, a driver's seat 17 is provided on a driver's seat support base provided on a floor portion. A traveling operation unit such as a traveling lever, a work operation unit such as a work operation lever for operating work units such as the excavation unit 3 and the soil removal unit 4, an operation panel unit having various operation units such as switches, and the like are provided around the driver's seat 17.

Regarding the work operation unit, a left side work operation lever 18 is provided on the left side of the driver's seat 17, and a right side work operation lever 19 is provided on the right side of the driver's seat 17 (see FIG. 3). The excavation unit 3 is operated by these left and right operation levers. Each of the left side work operation lever 18 and the right side work operation lever 19 is covered with a bellows-shaped lever boot on the base portion side, and is configured to be able to be tilted at least in the front-rear direction and the left-right direction.

The excavation unit 3 is attached to the front side of the swivel frame 7. The excavation unit 3 has a boom 21 that constitutes the base end portion thereof, an arm 22 that is coupled to the tip end side of the boom 21, and a bucket 23 that is attached to a tip end portion of the arm 22. Further, the excavation unit 3 has a boom cylinder 24 that rotates the boom 21, an arm cylinder 25 that rotates the arm 22, and a bucket cylinder 26 that rotates the bucket 23.

A base end portion of the boom 21 is supported by a boom support bracket 27. The boom support bracket 27 is supported by a bracket attachment section 28 protruding from a central portion in the left-right direction of the front end of the swivel frame 7 via a swing shaft with the up-down direction as the rotation axis direction. The excavation unit 3 is provided so as to swing to the left and right about the swing shaft with respect to the swivel frame 7 by an expansion and contraction movement of a swing cylinder 29 provided between the boom support bracket 27 and the swivel frame 7. The boom support bracket 27 has a portion that rotatably supports a base end portion of the boom 21 with the left-right direction as a rotation axis direction, a portion that supports a lower end portion of the boom cylinder 24, and a portion that receives connection of the tip end portion of a rod that is the front end portion of the swing cylinder 29.

Figure 4:
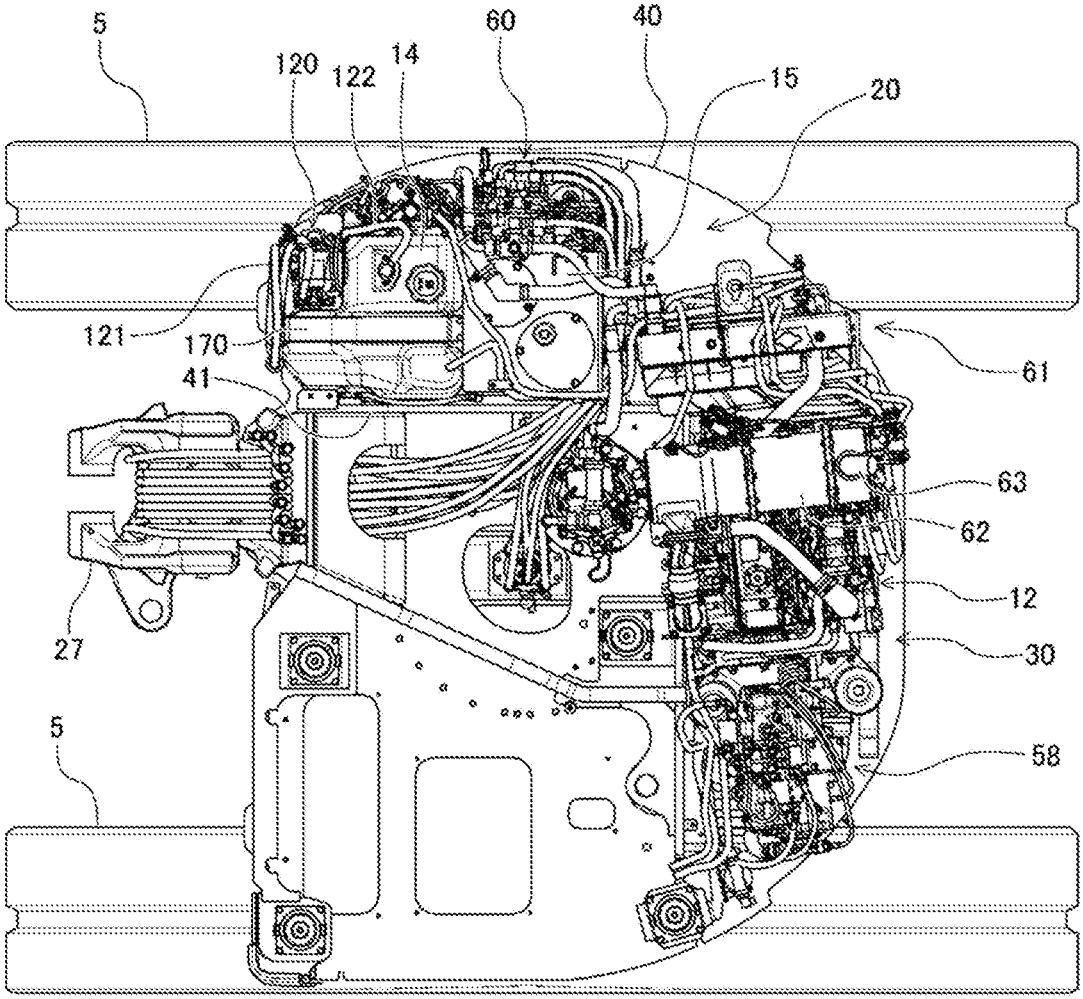
FIG. 4 is a plan view illustrating an arrangement configuration of units on a base plate of the excavation work machine according to one embodiment of the present invention.

The boom cylinder 24, the arm cylinder 25, and the bucket cylinder 26 that constitute the excavation unit 3 and the swing cylinder 29 that swings the excavation unit 3 are each a hydraulic cylinder actuated by pressure oil discharged by a hydraulic pump 58 (see FIG. 4). Further, in the excavation unit 3, the bucket 23 is detachably coupled to the tip end portion of the arm 22 as a work attachment, and depending on the content of a work, other attachments such as a grapple or breaker may be mounted instead of the bucket 23.

The soil removal unit 4 is attached to the front side of the machine body frame 6. The soil removal unit 4 has a support frame 31 that includes a left and right pair of arms, each of which extends in a front-rear direction between the left and right traveling units 5, 5, a blade 32 as a soil removal plate that is provided on the tip end side of the support frame 31, and a blade cylinder 33 that lifts/lowers the blade 32 via the support frame 31. The blade cylinder 33 is a hydraulic cylinder operated by the pressure oil discharged from the hydraulic pump 58.

The support frame 31 is attached to the machine body frame 6 so as to be rotatably lifted and lowered, by having the rear end portion of the left and right arms rotatably supported by a support bracket provided in the front portion of the machine body frame 6 with the left-right direction as the rotation axis direction. The blade 32 is installed in a state of being supported by the front end portion of the support frame 31. The blade cylinder 33 is bridged between the machine body frame 6 and the blade 32 with the rear end portion being supported by the support bracket provided in the front portion of the machine body frame 6, and the front end portion being supported by a support bracket provided on the back side of the blade 32 so as to be rotatable with the left-right direction as the rotation axis direction, respectively. By the expansion and contraction movement of the blade cylinder 33, the support frame 31 and the blade 32 integrally rotate up and down.

The excavation work machine 1 includes a lower traveling body, which is configured to include the machine body frame 6 and the traveling units 5, 5 supported on both the left and right sides of the machine body frame 6, and an upper swiveling body 20B swivelably mounted on the lower traveling body. The upper swiveling body includes the swivel frame 7, and the driving unit 10, the engine 12, the tank housing section 13, and the like provided on the swivel frame 7.

In the excavation work machine 1 having the above-described configuration, the operator who is seated on the driver's seat 17 properly operates the traveling lever, the work operation lever, and the like, thereby performing a desired action or work. Specifically, for example, by the operation of the traveling lever, the traveling apparatus 2 travels straight forward and backward or turns left and right by the operation of the left and right traveling units 5. Further, operating the work operation lever performs the excavation work by the excavation unit 3, or the soil removal work or ground leveling work by the soil removal unit 4.

[Configuration of Tank Housing Section]

A configuration of the tank housing section 13 will be described with reference to FIGS. 4 to 10. On the base plate 40 constituting the swivel frame 7, the tank housing section 13 is provided in a region portion on the right side of substantially trisected regions on the base plate 40 in the left-right direction. The base plate 40 is a plate-like frame member arranged horizontally, and forms the bottom surface portion of the swivel frame 7. The base plate 40 has a flat upper surface 40*a*.

The tank housing section 13 is a portion in which the fuel tank 14, the hydraulic oil tank 15, and the like are housed in the tank chamber 20 sectioned on the base plate 40. The rear side of the tank chamber 20 is spatially continuous with an engine room 30 that houses the engine 12 disposed at the rear portion on the base plate 40.

On the swivel frame 7, the cabin 16 in which the driver's seat 17 (see FIG. 3) is disposed is provided on the left in the lateral direction of the tank chamber 20. That is, the tank chamber 20 housing the hydraulic oil tank 15 and the driver's seat 17 are arranged side by side on the swivel frame 7.

The tank chamber 20 is sectioned from a portion on the center side in the left-right direction on the base plate 40 by a bulkhead portion 42 including a part of a vertical plate 41 provided on the base plate 40. The bulkhead portion 42 forms a side surface portion on the driving unit 10 side (left side) of the side surface portions forming the tank chamber 20. Further, the bulkhead portion 42 faces a right side wall portion 16*b* of the cabin 16 via a space portion 36 behind the bracket attachment section 28 on the swivel frame 7. The space portion 36 is a recessed space portion between the cabin 16 and the tank housing section 13, for ensuring a rearward movement range of the excavation unit 3.

The vertical plate 41 is provided in a state of being fixed to the base plate 40, and constitutes a part of the swivel frame 7. The vertical plate 41 is provided over substantially the entire range in the front-rear direction of the base plate 40, at a position closer to the right side than the center portion in the left-right direction on the base plate 40 in a direction in which the left-right direction is the plate thickness direction. The vertical plate 41 has a shape in which the height of a front portion 41*a* thereof gradually decreases from the front side to the rear side.

The front portion 41*a* of the vertical plate 41 forms the lower portion of the bulkhead portion 42. An upper front frame 44 forming an edge portion of the bulkhead portion 42 is provided on the upper side of the front portion 41*a* of the vertical plate 41. The upper front frame 44 is inclined downward toward the front, and the front end portion thereof is fixed to and supported by the upper side of the front end portion of the vertical plate 41. A plate-shaped flange section 44*a* serving as a support portion for the vertical plate 41 is provided at the front end portion of the upper front frame 44. The upper front frame 44 has a flange section 44*a* overlapped with a support plate section 41*b* provided above the front end portion of the vertical plate 41 from above, and is fixed to the support plate section 41*b* by fixing bolts 45 penetrating the flange section 44*a*.

The rear portion of the upper front frame 44 is coupled to and supported by the upper end portion of a rear frame 43 which is a frame portion vertically erected with respect to the upper surface 40*a* of the base plate 40. The rear frame 43 has a plate-like flange section 43*a* at the lower end portion thereof, and is fixed to the base plate 40 by a bolt 46 or the like penetrating the flange section 43*a*.

The upper front frame 44 has a first inclined frame portion 44*b* that forms a large portion of the rear side of the upper front frame 44, and a second inclined frame portion 44*c* that is a portion on the front side of the first inclined frame portion 44*b* and has a steeper inclination than the first inclined frame portion 44*b*. The flange section 44*a* is provided at the lower end portion of the second inclined frame portion 44*c*.

Figure 7:
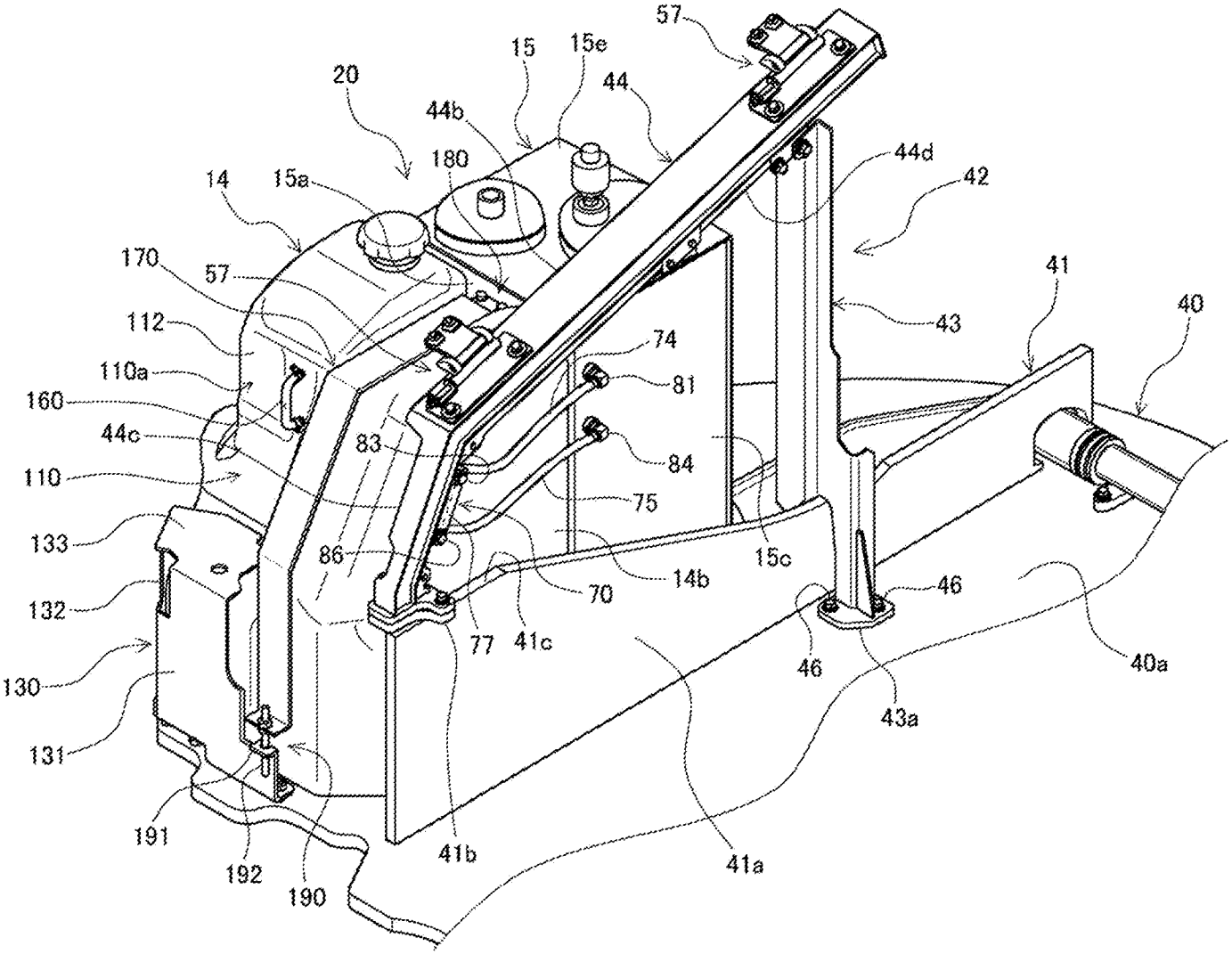
FIG. 7 is a left front perspective view illustrating an arrangement configuration in a tank chamber according to one embodiment of the present invention.
Figure 8:
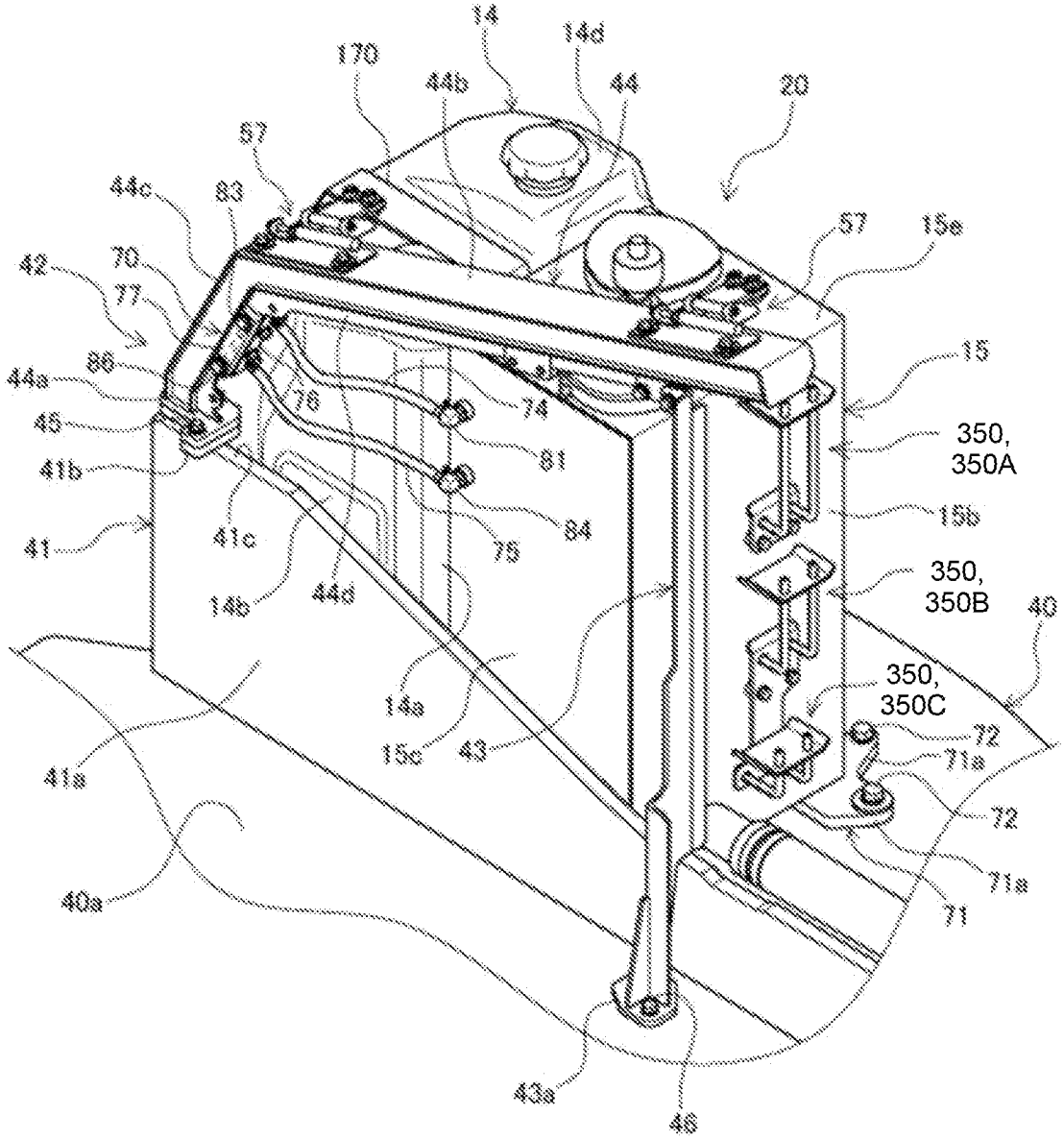
FIG. 8 is a left rear perspective view illustrating an arrangement configuration in the tank chamber according to one embodiment of the present invention.
Figure 10:
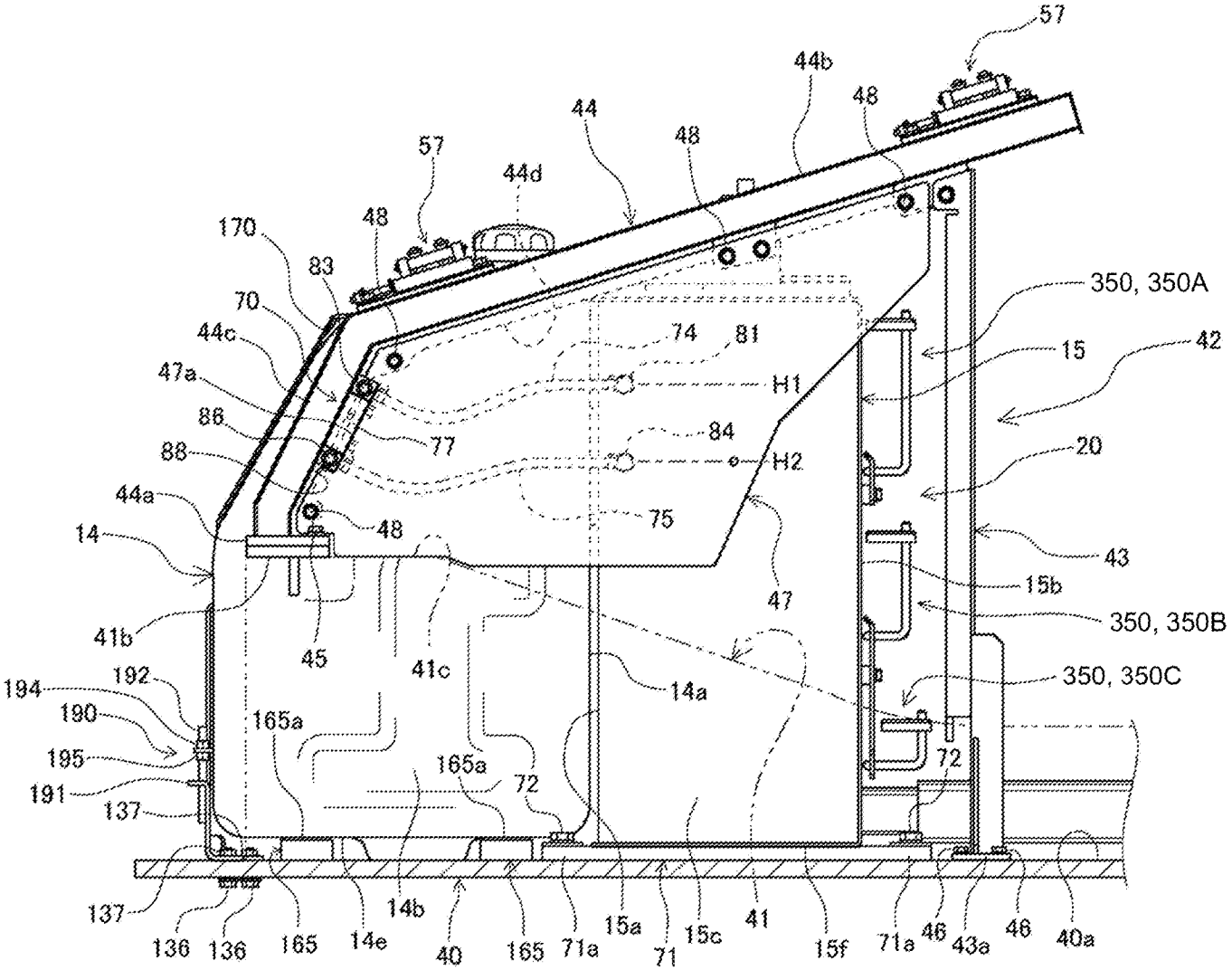
FIG. 10 is a left side view illustrating an arrangement configuration in the tank chamber according to one embodiment of the present invention.

The front portion 41*a* of the vertical plate 41 and the upper front frame 44 forming the bulkhead portion 42 form a frame-shaped portion together with the rear frame 43, and most of the front side of the region surrounded by the frame-shaped portion is closed by the partition plate 47 (see FIG. 10). In FIGS. 7 and 8, the partition plate 47 is not illustrated. The partition plate 47 is provided in a region surrounded by the vertical plate 41, the upper front frame 44, and the rear frame 43 so as to close a portion on the front side of a front-down inclined surface portion 35 (see FIG. 6) forming a part of the bottom portion of the space portion 36 between the cabin 16 and the tank housing section 13.

As illustrated in FIG. 10, the partition plate 47 has a plate thickness direction in the left-right direction, and has a bent shape along the bent form of the upper front frame 44 on the upper side and the front side. In addition, the partition plate 47 has a horizontal shape along a horizontal upper surface portion 41*c* formed on the front end side of the vertical plate 41 at the lower edge portion of the front portion. The partition plate 47 covers most of the rear side of the upper portion of the fuel tank 14 and most of the front side of the upper portion of the hydraulic oil tank 15 from the left side.

Figure 11:
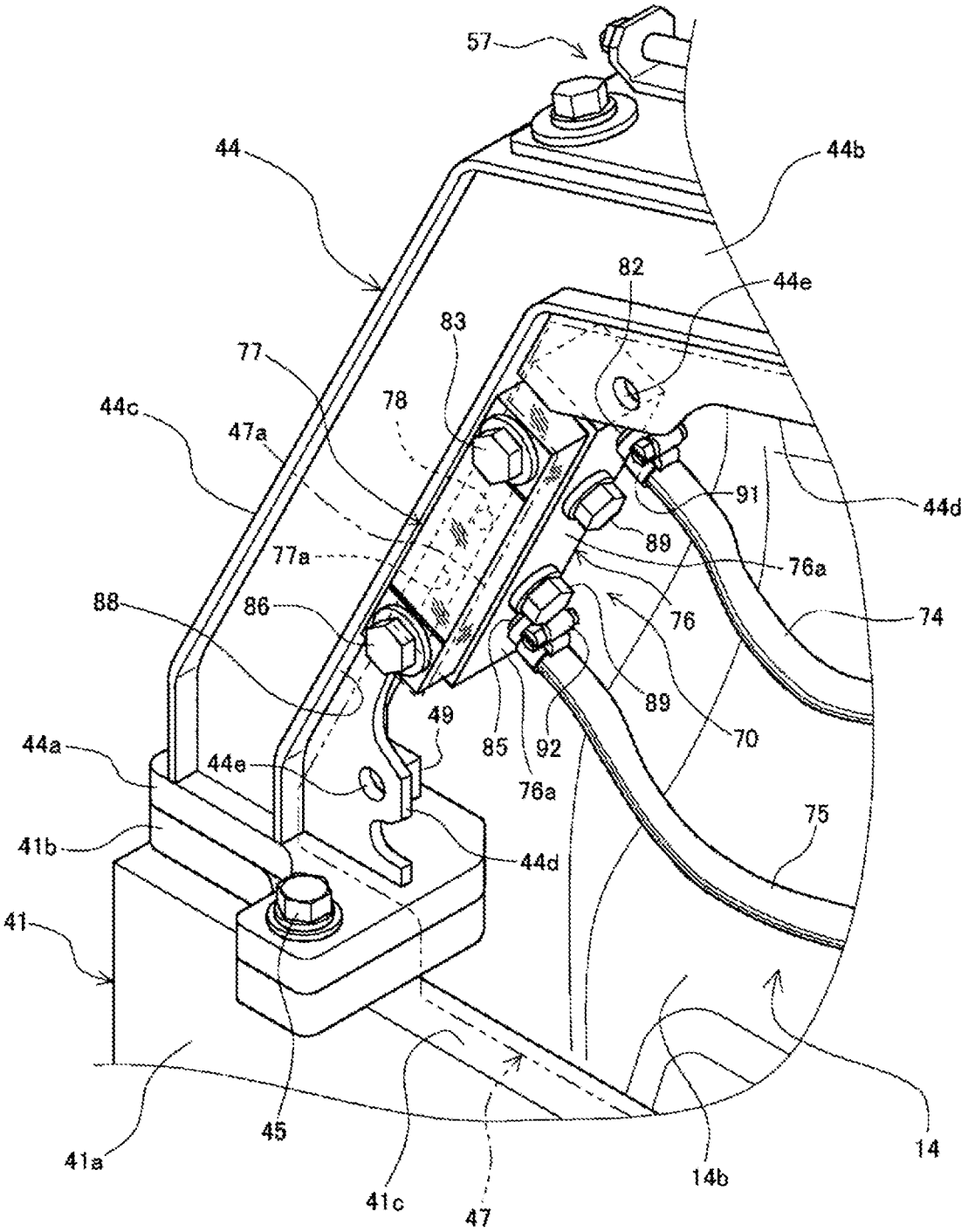
FIG. 11 is a left rear perspective view illustrating a configuration of a level gauge and its vicinity according to one embodiment of the present invention.

The partition plate 47 is fixed to the inner side of the bent shape of the upper front frame 44, that is, a rib-shaped support protruding surface portion 44*d* protruding from the lower side of the first inclined frame portion 44*b* and the rear side of the second inclined frame portion 44*c* at a plurality of positions by a bolt 48 that is a fastening member and a nut-shaped fastening portion 49 provided on the right side of the support protruding surface portion 44*d* and receiving the bolt 48, with its upper and front edge portions contacting and supported from the left side (see FIGS. 10 and 11). A hole portion 44*e* through which the bolt 48 penetrates is formed in the support protruding surface portion 44*d*.

In the tank housing section 13, a portion on the right side of the bulkhead portion 42 on the base plate 40 is covered with a plurality of exterior covers which are covering members, and the tank chamber 20 forming a housing space is thereby formed. Each of the plurality of exterior covers has a shape and a size corresponding to the shape of the swivel frame 7 and the arrangement of the configuration on the swivel frame 7.

Figure 6:
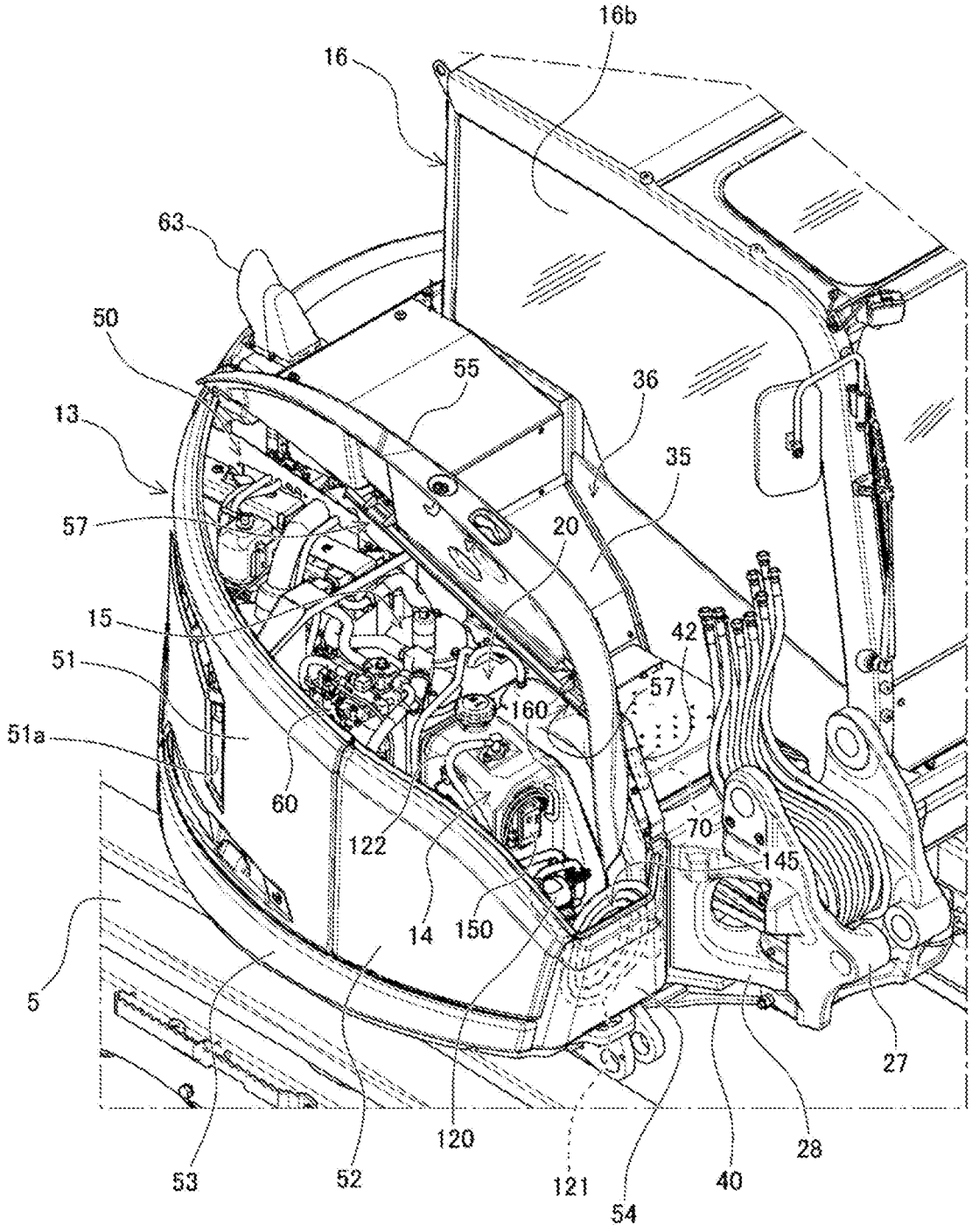
FIG. 6 is a right front perspective view illustrating a state where an upper cover of a tank housing section of the excavation work machine according to the embodiment of the present invention is opened.

As illustrated in FIGS. 3 and 6, the tank housing section 13 has, as exterior covers, a right rear cover 51 that covers the right lateral rear portion of the tank chamber 20, a right front cover 52 that covers the right lateral front portion of the tank chamber 20, a right lower cover 53 that covers the right lower portion of the tank chamber 20, and a front cover 54 that covers the front portion of the tank chamber 20. These covers are, for example, metal covers. Further, the tank housing section 13 has a hood 55 that is a cover member that covers the upper side of the tank chamber 20 as an exterior cover. The hood 55 is, for example, a resin cover.

The right rear cover 51 and the right front cover 52 constitute, on the right side of the tank housing section 13, a continuously curved peripheral wall portion along the right arc-shaped curved shape of the base plate 40 in a plan view. The upper edge portions of the right rear cover 51 and the right front cover 52 have a shape that is inclined so as to follow the front-down inclined shape of the upper front frame 44 in a right side view. That is, the height of the peripheral wall portion formed by the right rear cover 51 and the right front cover 52 gradually decreases from the rear side to the front side.

The right lower cover 53 is a narrow cover provided on the lower side of a cover portion by the right rear cover 51 and the right front cover 52 along the lower edge portion of the cover section, and has a curved shape along the right arc-shaped curved shape of the base plate 40 in a plan view. The front cover 54 is provided between the front edge portions of the right front cover 52 and the right lower cover 53 and the front edge portion of the bulkhead portion 42, and covers the front side of the tank chamber 20 at substantially the same height as the front edge portion of the right front cover 52.

In the tank housing section 13, the right rear cover 51, the right front cover 52, the front cover 54, and the bulkhead portion 42 form an opening portion 50 that is open toward the upper front side (see FIG. 6). The opening portion 50 is an opening portion on the upper side of the tank chamber 20, forms an opening edge portion along a front-down inclined shape by upper edge portions of each of the right rear cover 51, the right front cover 52, the front cover 54, and the bulkhead portion 42, and has an opening shape with the front-rear direction as the longitudinal direction in a plan view. The opening portion 50 generally has an opening shape in which, in a plan view, a left edge portion is formed in a substantially linear shape along the front-rear direction by the bulkhead portion 42, a right edge portion is formed in a curved shape protruding to the right by the right rear cover 51 and the right front cover 52, and a front edge portion is formed in a substantially linear shape along the left-right direction by the front cover 54.

The hood 55 is an upper cover that covers the tank chamber 20 from above by covering the opening portion 50 from above. The hood 55 has a shape corresponding to the opening shape of the opening portion 50, and is provided so as to close the entire opening portion 50. The hood 55 forms an inclined surface portion inclined downward toward the front along the shape of the opening portion 50.

The hood 55 is provided so as to be openable and closable by two front and rear hinge portions 57 provided on the first inclined frame portion 44*b* of the upper front frame 44. When the hood 55 is rotated by the left front and rear hinge portions 57 so as to raise the right side, the opening portion 50 of the tank chamber 20 is opened (see FIG. 6). In this way, the tank chamber 20 is covered by the hood 55 provided so as to be openable and closable.

In the tank chamber 20, the fuel tank 14 is provided in the front portion, and the hydraulic oil tank 15 is provided on the rear side of the fuel tank 14. The fuel tank 14 is a fuel oil tank that stores fuel oil to be supplied to the engine 12, and corresponds to the tank according to the present invention. The hydraulic oil tank 15 is a tank that stores hydraulic oil for actuating various hydraulic actuators included in the excavation work machine 1, and is a configuration corresponding to the other tank according to the present invention. The various hydraulic actuators that are actuated by receiving supply of pressure oil from the hydraulic oil include hydraulic cylinders such as the boom cylinder 24, the arm cylinder 25, the bucket cylinder 26, and the swing cylinder 29, as well as the traveling hydraulic motor 11 and the swivel motor (see FIG. 1).

The hydraulic oil tank 15 is disposed behind the fuel tank 14, and is positioned at the substantially central portion in the front-rear direction in the tank chamber 20. The fuel tank 14 and the hydraulic oil tank 15 are mounted on and supported by the upper surface 40*a* of the base plate 40. The fuel tank 14 and the hydraulic oil tank 15 have substantially the same dimensions in the left-right direction, are disposed adjacent to each other in the front-rear direction, and are provided in such a manner that most portions thereof are positioned within the range of the outer shape of the bulkhead portion 42 in a left side view. Further, the fuel tank 14 and the hydraulic oil tank 15 have substantially the same height.

In the tank chamber 20, a control valve 60 is disposed adjacent to the hydraulic oil tank 15 on the right side of the hydraulic oil tank 15. The control valve 60 is a unit for controlling the flow of the pressure oil supplied from the hydraulic oil tank 15 to the plurality of hydraulic actuators.

The control valve 60 controls the flow of pressure oil to the respective hydraulic actuators. The control valve 60 is configured as a valve unit including a plurality of direction switching valves corresponding to the respective hydraulic actuators, and controls, by the operation control of the direction switching valves or the like, the flow rate and the supply destination (flow direction) of the pressure oil supplied from the inside of the hydraulic oil tank 15 by the driving of the hydraulic pump 58. By controlling the supply of pressure oil to the respective hydraulic actuators, the operation of the excavation unit 3, the traveling operation of the traveling apparatus 2, and the like are performed.

On the base plate 40, a heat exchanger 61 and the engine 12 are provided in the engine room 30 connected to the rear side of the tank chamber 20 (see FIG. 4). The heat exchanger 61 has an equipment configuration having a heat exchange function for cooling the engine 12, and includes a radiator, an oil cooler, an exhaust fan that rotates in conjunction with the engine 12, and the like. Hot air in the engine room 30 is discharged by the exhaust fan through an opening 51*a* (see FIG. 6) formed in the right rear cover 51.

The engine 12 is installed on the rear portion of the base plate 40 with the axial direction of the output shaft being substantially left and right. The engine 12 is a diesel engine that receives fuel supplied from the fuel tank 14. Combustion gas generated in combustion chambers of the engine 12 is discharged out of the engine room 30 through an exhaust unit 62 and a muffler 63. The hydraulic pump 58 is disposed on the left side of the engine 12.

A rotary shaft of the hydraulic pump 58 is coupled to the drive shaft of the engine 12 via a coupling. The hydraulic pump 58 is driven by the rotation of the drive shaft of the engine 12, and feeds the hydraulic oil in the hydraulic oil tank 15 to various hydraulic actuators via the control valve 60.

[Configuration of Level Gauge]

The excavation work machine 1 according to the present embodiment includes a level gauge 70, which is a liquid level gauge for grasping the amount of oil in the tank, for the hydraulic oil tank 15 (see FIG. 7). The level gauge 70 indicates the amount of hydraulic oil in the hydraulic oil tank 15. Regarding the arrangement of the level gauge 70, in the configuration including the hydraulic oil tank 15 provided in the tank chamber 20 and the driver's seat 17 provided on the left side of the tank chamber 20, the level gauge 70 is provided on the driver's seat 17 side of the tank chamber 20, that is, on the left side. Hereinafter, the arrangement configuration of the hydraulic oil tank 15 and the level gauge 70 will be described in detail with reference to FIGS. 7 to 12.

The hydraulic oil tank 15 has a quadrangular prism outer shape having a rectangular shape in a plan view in the tank main body section, and has a front surface portion 15*a*, a rear surface portion 15*b*, a left side surface portion 15*c*, a right side surface portion 15*d*, an upper surface portion 15*e*, and a lower surface portion 15*f*, as surface portions forming the outer shape of the tank main body section. The hydraulic oil tank 15 is installed on the base plate 40 in such a manner that the front surface portion 15*a* and the rear surface portion 15*b* are arranged along the left-right direction and the left side surface portion 15*c* and the right side surface portion 15*d* are arranged along the front-rear direction in a plan view.

The hydraulic oil tank 15 is fixed to the base plate 40 via a fixing plate section 71 provided on the lower side of the tank main body section. The fixing plate section 71 has a plurality of protruding piece portions 71*a* protruding outward from the outer shape of the tank main body section of the hydraulic oil tank 15 in a plan view. The hydraulic oil tank 15 is fixed to the base plate 40 by a fixing bolt 72 or the like that penetrates each protruding piece portion 71*a*.

The hydraulic oil tank 15 is disposed directly behind the fuel tank 14 with its front surface portion 15*a* facing the rear surface portion 14*a* of the fuel tank 14 with a slight gap therebetween. Further, the hydraulic oil tank 15 is disposed in the vicinity of the bulkhead portion 42 with its left side surface portion 15*c* facing the right side of the bulkhead portion 42 with a slight gap therebetween.

In the hydraulic oil tank 15, the lower portion of the left side surface portion 15*c* is close to the vertical plate 41 constituting the bulkhead portion 42, and the upper portion of the left side surface portion 15*c* is close to the partition plate 47 constituting the bulkhead portion 42. Further, the left side surface portion 14*b* of the fuel tank 14 is positioned slightly to the left of the left side surface portion 15*c* of the hydraulic oil tank 15, and is closer to each of the vertical plate 41 and the partition plate 47 than the left side surface portion 15*c*.

Regarding the arrangement of the level gauge 70, in the configuration including the fuel tank 14 disposed in front of the hydraulic oil tank 15, the level gauge 70 is disposed on a lateral side of the fuel tank 14. In the present embodiment, the level gauge 70 is disposed on the left in the lateral direction of the fuel tank 14 in a state of being supported by and fixed to the front portion of the bulkhead portion 42, which is a side surface portion on a side (left side) close to the driver's seat 17 among the side surface portions of the tank chamber 20.

The level gauge 70 is communicatively connected to the hydraulic oil tank 15 via two connection hoses (74, 75) forming a connection pipe portion. An upper connection hose 74, which is a first connection hose, and a lower connection hose 75, which is a second connection hose provided below the upper connection hose 74, are provided as two connection hoses for the level gauge 70. As described above, the level gauge 70 is connected to the hydraulic oil tank 15 by the upper connection hose 74 and the lower connection hose 75 which are piping members communicating with the inside of the hydraulic oil tank 15.

The level gauge 70 has a support block section 76 having a quadrangular prism outer shape and a gauge section 77 provided on one side surface of the support block section 76. The support block section 76 has a front side surface portion, a rear side surface portion, a left side surface portion, and a right side surface portion, as side surface portions. The gauge section 77 has a quadrangular prism outer shape having substantially the same length as that of the support block section 76, and is fixed to the support block section 76 in a state where the right side surface thereof is aligned with the left side surface portion of the support block section 76. The level gauge 70 has a substantially quadrangular prism outer shape as a whole due to the support block section 76 and the gauge section 77.

The gauge section 77 has a gauge passage 77*a* in which a spherical float 78 is movably incorporated. The gauge passage 77*a* is formed linearly along the longitudinal direction of the gauge section 77. The gauge section 77 is made of a transparent member, and the position of the float 78 in the gauge passage 77*a* can be visually recognized from the outside.

One end side of each of the upper connection hose 74 and the lower connection hose 75 is connected to the hydraulic oil tank 15, and the other end side is connected to the support block section 76 of the level gauge 70. The upper connection hose 74 and the lower connection hose 75 are disposed so as to extend forward from the left side surface portion 15*c* of the hydraulic oil tank 15, and are connected to the level gauge 70. Connecting portions of the upper connection hose 74 and the lower connection hose 75 to the hydraulic oil tank 15 are positioned in the vicinity of the front edge portion of the upper portion of the left side surface portion 15*c*.

One end side of the upper connection hose 74 is connected to the left side surface portion 15*c* of the hydraulic oil tank 15 via an L-shaped joint 81 so as to communicate with the storage space of the hydraulic oil tank 15. The height position of the connecting portion of the upper connection hose 74 in the hydraulic oil tank 15, that is, the height position of the joint 81 is a first height position H1 in the upper portion of the hydraulic oil tank 15 (see FIG. 10).

The other end side of the upper connection hose 74 is communicatively connected to a cylindrical upper connection port section 82 protruding from the upper end portion of a rear side surface portion 76*a* of the support block section 76. The upper connection hose 74 is fixed to the upper connection port section 82 by a hose band 91 in a state where the upper connection port section 82 is inserted into the end portion on the other end. The other end of the upper connection hose 74 communicates with the upper end portion of the gauge passage 77*a* from the upper connection port section 82 via an upper internal passage provided inside the upper end portion of each of the support block section 76 and the gauge section 77. The upper internal passage includes a passage portion formed by an upper flow passage forming bolt 83. The upper flow passage forming bolt 83 has a flow passage in its shaft portion, penetrates the gauge section 77 from the left side surface of the gauge section 77, and is screwed into the support block section 76.

One end side of the lower connection hose 75 is connected to the left side surface portion 15*c* of the hydraulic oil tank 15 via an L-shaped joint 84 so as to communicate with the storage space of the hydraulic oil tank 15. The height position of the connecting portion of the lower connection hose 75 in the hydraulic oil tank 15, that is, the height position of the joint 84 is a second height position H2 in the upper portion of the hydraulic oil tank 15 (see FIG. 10).

The other end side of the lower connection hose 75 is communicatively connected to a cylindrical lower connection port section 85 protruding from the lower end portion of the rear side surface portion 76*a* of the support block section 76. The lower connection hose 75 is fixed to the lower connection port section 85 by a hose band 92 in a state where the lower connection port section 85 is inserted into the end portion on the other end. The other end of the lower connection hose 75 communicates with the lower end portion of the gauge passage 77*a* from the lower connection port section 85 via a lower internal passage provided inside the lower end portion of each of the support block section 76 and the gauge section 77. The lower internal passage includes a passage portion formed by a lower flow passage forming bolt 86. The lower flow passage forming bolt 86 has a flow passage in its shaft portion, penetrates the gauge section 77 from the left side surface of the gauge section 77, and is screwed into the support block section 76.

The level gauge 70 is attached to the rear side of the second inclined frame portion 44*c* of the upper front frame 44. The second inclined frame portion 44*c* has, on the rear side, an attachment surface 88 which is a flat surface portion along the inclination of the second inclined frame portion 44*c* in a side view. The attachment surface 88 is a surface that is linear in a side view and faces rearward and downward.

The level gauge 70 is fixed to the second inclined frame portion 44*c* at two positions by fixing bolts 89 in a state where the front side surface portion of the support block section 76 is in contact with the attachment surface 88. A fixing section by the two fixing bolts 89 is provided at an intermediate portion between the upper connection port section 82 and the lower connection port section 85 in the longitudinal direction of the support block section 76. The fixing bolt 89 penetrates the support block section 76 from the rear side surface portion 76*a* side and is screwed into the second inclined frame portion 44*c*.

In this way, the level gauge 70 is provided in a state where the longitudinal direction of the outer shape of the quadrangular prism shape, that is, the extending direction of the gauge passage 77*a*, which is the movement direction of the float 78, is along the front-down inclination of the second inclined frame portion 44*c*. For example only, an inclination angle θ1 (see FIG. 12) of the longitudinal direction of the level gauge 70 with respect to the up-down direction (vertical direction) is approximately 25 degrees.

Figure 12:
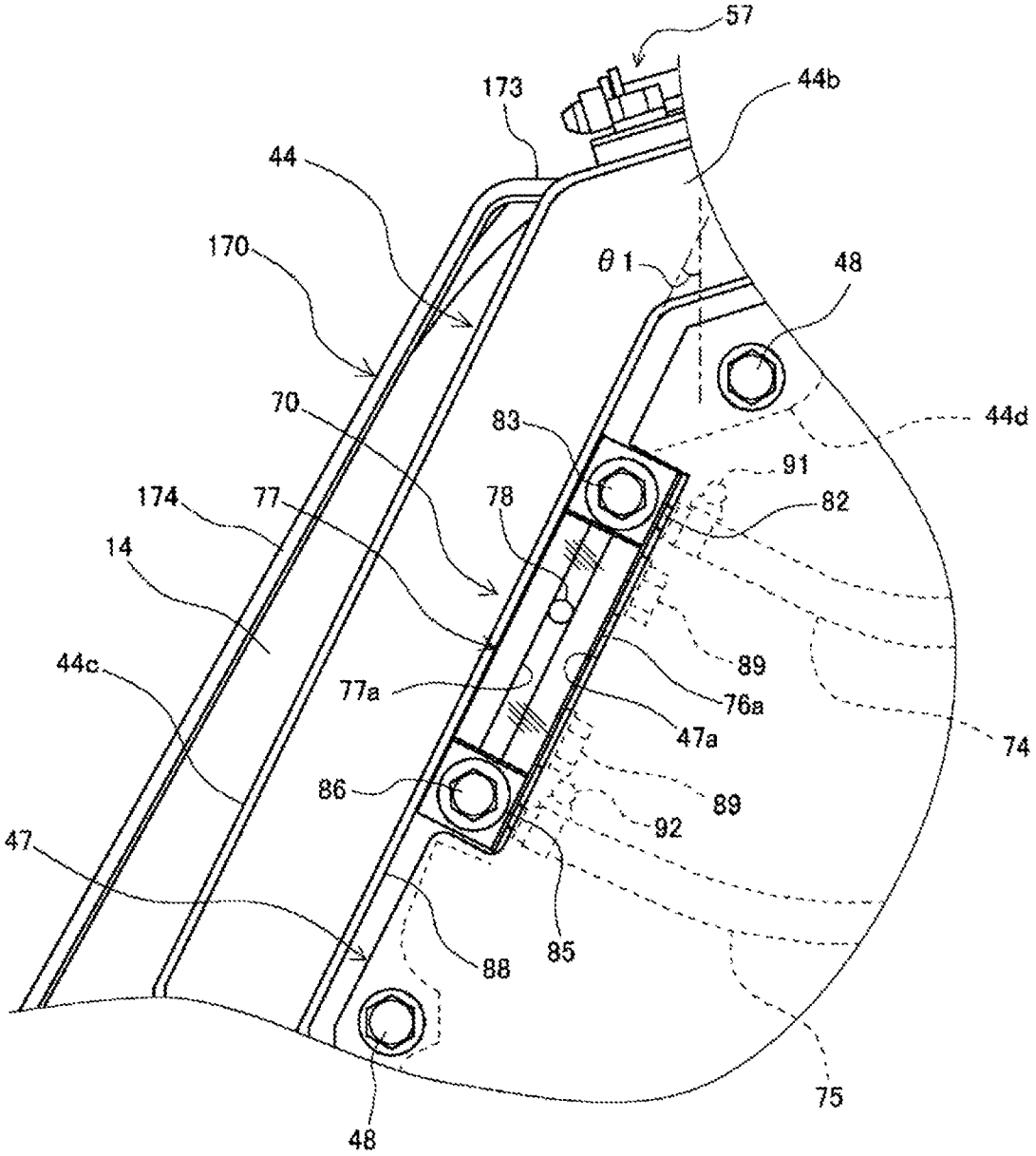
FIG. 12 is a left side view illustrating a configuration of the level gauge and its vicinity according to one embodiment of the present invention.
Figure 13:
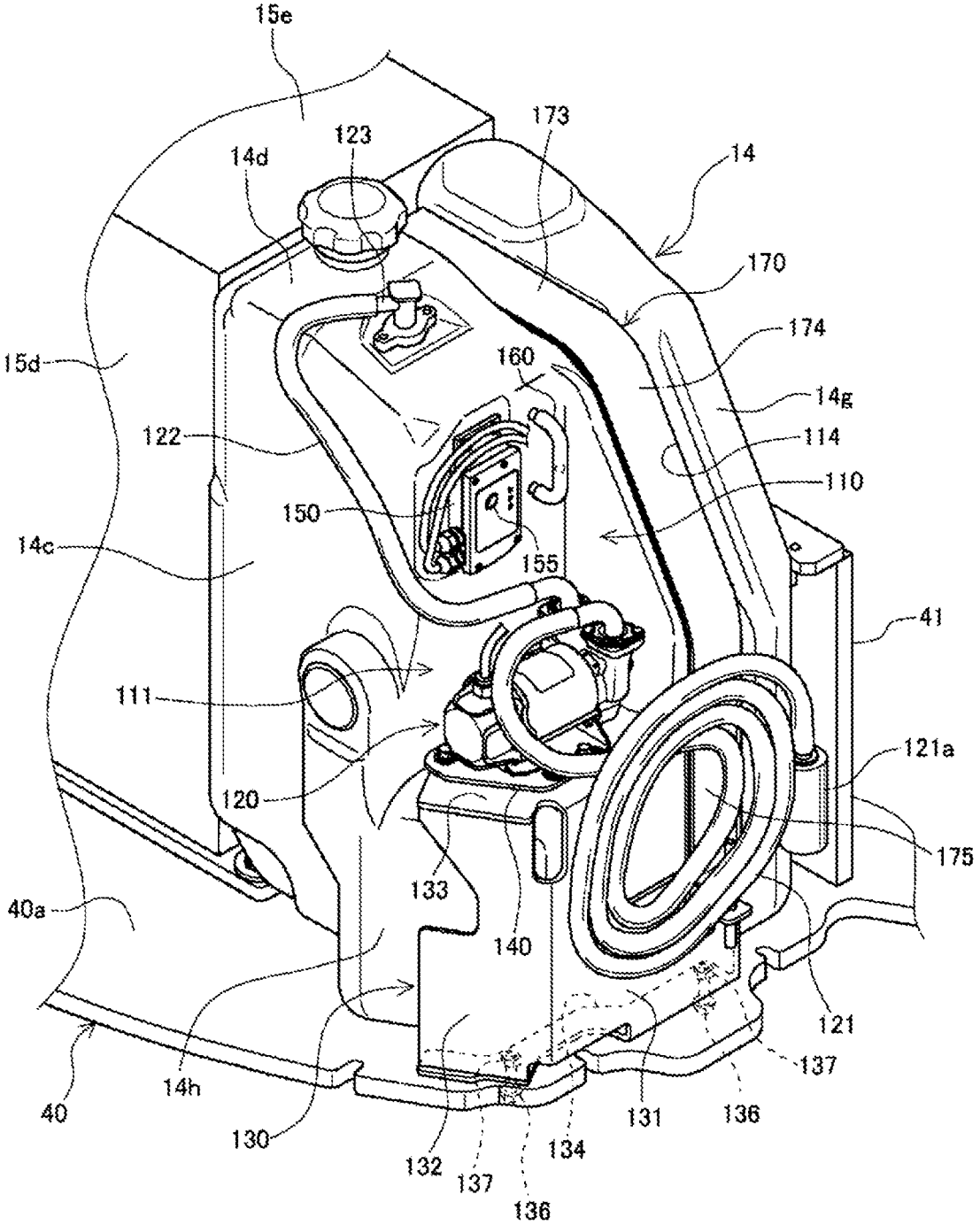
FIG. 13 is a right front perspective view illustrating a configuration of a fuel tank and its vicinity according to one embodiment of the present invention.

As illustrated in FIGS. 10 to 12, the level gauge 70 is provided at a position overlapping the partition plate 47 constituting the bulkhead portion 42 in the left-right direction, and is provided in a state where the gauge section 77 is exposed to the left side from the partition plate 47. The partition plate 47 has a notch section 47*a* for avoiding interference with the level gauge 70 at a position corresponding to the level gauge 70, and the gauge section 77 is exposed to the left side by the notch section 47*a*. The support protruding surface portion 44*d* of the upper front frame 44 to which the partition plate 47 is attached from the left side is provided at a position overlapping the gauge section 77 in the left-right direction (see FIG. 11), and the partition plate 47 is provided at a position overlapping the gauge section 77 in the left-right direction.

Moreover, the level gauge 70 is provided in a state where the gauge section 77 is exposed to the left side from the partition plate 47 constituting the bulkhead portion 42, and thus the gauge section 77 is exposed to the outside.

That is, the level gauge 70 is provided in a state where the gauge section 77 faces the space portion 36 between the cabin 16 and the bulkhead portion 42.

Further, the partition plate 47 covers the upper connection hose 74, the lower connection hose 75, and the connecting portions of these hoses to the level gauge 70 and the hydraulic oil tank 15 from the left side. That is, the upper connection hose 74 and the lower connection hose 75 are provided using a gap between the fuel tank 14 and the hydraulic oil tank 15 and the partition plate 47 as a piping space.

According to the arrangement configuration of level gauge 70 as described above, in the configuration including the swivel frame 7 provided with the tank chamber 20 and the driver's seat 17, the level gauge 70 is disposed above the front portion of the swivel frame 7. The level gauge 70 has a common or substantially common position in the left-right direction with the upper connection hose 74 and the lower connection hose 75, and is disposed above the front portion of the base plate 40.

In particular, in the present embodiment, the level gauge 70 is disposed above the front end portion of the base plate 40. More specifically, the level gauge 70 is positioned on the right side of the lateral center of the base plate 40 and above the front end portion of the base plate 40. In the level gauge 70, the gauge section 77 is exposed to the left side from the partition plate 47 by the notch section 47*a*, and basically, the position of the float 78 can be visually recognized only from the left side of the partition plate 47.

According to the level gauge 70, the height of the liquid level of the gauge passage 77*a* communicating with the storage space of the hydraulic oil tank 15 through the upper connection hose 74, lower connection hose 75, or the like is equal to the height of the liquid level of the hydraulic oil in the hydraulic oil tank 15. Therefore, regarding the height of the liquid level of the hydraulic oil in the hydraulic oil tank 15, the height of the liquid level positioned between a first height position H1 and a second height position H2 (see FIG. 10) is indicated as a position (height) of the float 78 in the gauge passage 77*a* by the level gauge 70. When the height of the liquid level of the hydraulic fluid in the hydraulic oil tank 15 is higher than the first height position H1, the float 78 is positioned at the ascending end, and when the height of the liquid level is lower than the second height position H2, the float 78 is positioned at the descending end.

The level gauge 70 is used to check that a predetermined amount of hydraulic oil is contained in the hydraulic oil tank 15. Further, the level gauge 70 is used to check the presence or absence of occurrence of a failure such as breakage of a hose that causes leakage of the hydraulic oil, from the degree of decrease in the amount of oil in the tank of the hydraulic oil tank 15.

Figure 9:
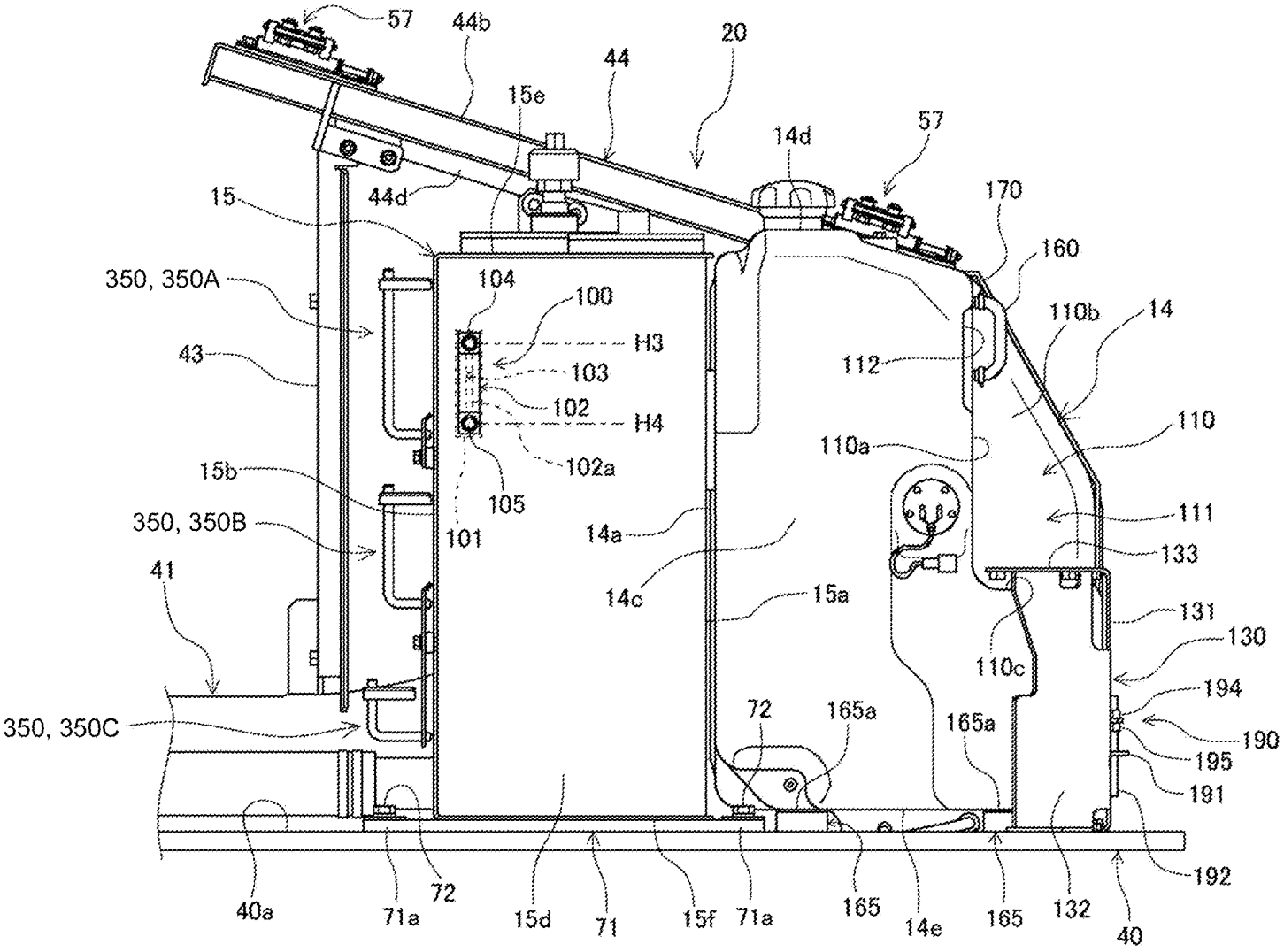
FIG. 9 is a right side view illustrating an arrangement configuration in the tank chamber according to one embodiment of the present invention.

Furthermore, the excavation work machine 1 according to the present embodiment includes, in addition to the level gauge 70, an other level gauge 100 provided on the tank main body section as a liquid level gauge for grasping the amount of oil in the tank of the hydraulic oil tank 15 (see FIG. 9). That is, in the hydraulic oil tank 15, when the level gauge 70 is used as a first level gauge, the level gauge 100 is provided as a second level gauge.

The level gauge 100 indicates the amount of hydraulic oil in the hydraulic oil tank 15, similarly to the level gauge 70. The level gauge 100 is provided in the tank chamber 20 by being provided on a side surface portion of the hydraulic oil tank 15. The level gauge 100 is installed on a side surface of the hydraulic oil tank 15 on the side opposite to the driver's seat 17 side (bulkhead portion 42 side).

As illustrated in FIG. 9, the level gauge 100 is provided at a position closer to the rear side of the upper portion of the right side surface portion 15*d* of the hydraulic oil tank 15. The level gauge 100 has the same configuration as that of the level gauge 70, and is provided at the same or substantially the same height position as that of the level gauge 70 with the longitudinal direction as the up-down direction.

The level gauge 100 includes a support block section 101 corresponding to the support block section 76 of the level gauge 70, and a gauge section 102 provided on one side surface of the support block section 101. In the level gauge 100, the wall portion forming the right side surface portion 15*d* of the hydraulic oil tank 15 is sandwiched between the support block section 101 and the gauge section 102, thereby positioning the support block section 101 inside the hydraulic oil tank 15 and positioning the gauge section 102 outside the tank.

The gauge section 102 has a gauge passage 102*a* in which a spherical float 103 is movably incorporated. The gauge passage 102*a* is formed linearly along the longitudinal direction of the gauge section 102. The gauge section 102 is made of a transparent member, and the position of the float 103 in the gauge passage 102*a* can be visually recognized from the outside.

The upper end portion of the gauge passage 102*a* communicates with the inside of the hydraulic oil tank 15 via an upper internal passage provided inside the upper end portion of each of the gauge section 102 and the support block section 101. The upper internal passage includes a passage portion formed by an upper flow passage forming bolt 104. The upper flow passage forming bolt 104 has a flow passage in its shaft portion, penetrates the walls of the gauge section 102 and the hydraulic oil tank 15 and is screwed into the support block section 101. A height position H3 of the upper flow passage forming bolt 104 is equal to or substantially equal to the first height position H1 of the level gauge 70 (see FIG. 10).

The lower end portion of the gauge passage 102*a* communicates with the inside of the hydraulic oil tank 15 via a lower internal passage provided inside the lower end portion of each of the gauge section 102 and the support block section 101. The lower internal passage includes a passage portion formed by a lower flow passage forming bolt 105. The lower flow passage forming bolt 105 has a flow passage in its shaft portion, penetrates the walls of the gauge section 102 and the hydraulic oil tank 15 and is screwed into the support block section 101. A height position H4 of the lower flow passage forming bolt 105 is equal to or substantially equal to the second height position H2 of the level gauge 70 (see FIG. 10).

According to the level gauge 100 attached to the tank main body section of the hydraulic oil tank 15, the height of the liquid level of the gauge passage 102*a* communicating with the storage space of the hydraulic oil tank 15 is equal to the height of the liquid level of the hydraulic oil in the hydraulic oil tank 15. Therefore, regarding the height of the liquid level of the hydraulic oil in the hydraulic oil tank 15, the height of the liquid level positioned between the third height position H3 and the fourth height position H4 (see FIG. 9) is indicated as a position (height) of the float 103 in the gauge passage 102*a* by the level gauge 100. When the height of the liquid level of the hydraulic fluid in the hydraulic oil tank 15 is higher than the third height position H3, the float 103 is positioned at the ascending end, and when the height of the liquid level is lower than the fourth height position H4, the float 103 is positioned at the descending end.

According to the arrangement configuration of the level gauge 100 as described above, the level gauge 100 is disposed at a position where the level gauge 100 can be visually observed in a state where the hood 55 of the tank chamber 20 is opened. In other words, as illustrated in FIG. 6, in a state where the hood 55 is opened, the upper portion of the right side surface portion 15*d* of the hydraulic oil tank 15 is exposed, and the level gauge 100 provided in the upper portion of the right side surface portion 15*d* can be visually recognized by opening the hood 55.

According to the arrangement configuration of the level gauge 70 in the excavation work machine 1 according to the present embodiment as described above, the level gauge 70 of the hydraulic oil tank 15 can be easily visually recognized even from the driver's seat 17 side, and it is easy to check the amount of oil in the hydraulic oil tank 15, and good workability can be obtained.

According to the level gauge 70, the operator can check the amount of oil in the hydraulic oil tank 15 by visually observing the level gauge 70, for example, as inspection work before the start of work by the excavation work machine 1. Here, the operator can visually observe the level gauge 70 from a window 16*c* (see FIG. 6) forming a wall portion on the right side of the cabin 16, in a state of being seated on the driver's seat 17 in the cabin 16. In addition, the level gauge 70 can be visually recognized regardless of whether the hood 55 is opened or closed, that is, even when the hood 55 is closed. Therefore, the amount of oil in the hydraulic oil tank 15 can be checked without getting out of the cabin 16 or opening the hood 55, and good workability and maintainability can be obtained.

Further, the level gauge 70 is provided in a state of being exposed to the outside of the tank chamber 20, and thus the level gauge 70 can be easily visually recognized even at a position separated from the level gauge 70 to some extent. Therefore, for example, it is possible to check the level gauge 70 while performing other work such as refueling to the hydraulic oil tank 15.

Further, the level gauge 70 is disposed above the front portion of the swivel frame 7. According to such a configuration, the level gauge 70 easily enters the field of view of the operator seated on the driver's seat 17 in the cabin 16, and the level gauge 70 can be easily visually recognized from the cabin 16.

Further, the level gauge 70 is disposed at a position separated from the hydraulic oil tank 15 via the upper connection hose 74 and the lower connection hose 75. According to such a configuration, it is possible to obtain a high degree of freedom for the arrangement position of the level gauge 70. As a result, the level gauge 70 can be easily disposed at a position that can be easily viewed from the driver's seat 17 side.

Further, the level gauge 70 is disposed on the left in the lateral direction of the fuel tank 14. In particular, in the present embodiment, the level gauge 70 is disposed directly to the left of the upper front portion of the left side surface portion 14*b* of the fuel tank 14. According to such a configuration, in the configuration in which the fuel tank 14 is disposed in front of the hydraulic oil tank 15 in the tank chamber 20, the level gauge 70 provided on the bulkhead portion 42 can be disposed at a position easily viewable from the driver's seat 17, and good visibility of the level gauge 70 can be obtained.

Further, the fuel tank 14 which is more frequently replenished with fuel than the hydraulic oil change/replenishing frequency of the hydraulic oil tank 15 can be disposed in front of the hydraulic oil tank 15, and the level gauge 70 of the hydraulic oil tank 15 can be disposed in front of the hydraulic oil tank 15 in the front-rear direction in the same manner as the fuel tank 14. As a result, it is possible to obtain good workability in replenishing fuel to the fuel tank 14, checking the level gauge 70 from the driver's seat 17, and the like, and it is possible to achieve a configuration with good maintainability.

Further, regarding the arrangement of the level gauge 70, the excavation work machine 1 has a configuration in which only the gauge section 77 is exposed to the outside of the tank chamber 20 by the partition plate 47, and the upper connection hose 74, the lower connection hose 75, and their connecting portions are covered by the partition plate 47. According to such a configuration, it becomes easy for the operator in the cabin 16 to concentrate his/her line of sight on the level gauge 70, it is possible to obtain good visibility of the level gauge 70 and obtain favorable appearance design properties.

Further, the excavation work machine 1 includes the other level gauge 100 disposed at a position where the level gauge 100 can be visually observed in a state where the hood 55 is opened in the tank chamber 20, as a level gauge that indicates the amount of oil in the tank of the hydraulic oil tank 15. According to such a configuration, the operator can supply the hydraulic oil to the hydraulic oil tank 15 while checking the level gauge 100, and thus good maintainability can be obtained.

In particular, the level gauge 100 is disposed on the right side surface portion 15*d* of the hydraulic oil tank 15, which is the opposite side (right side) to the side on which the level gauge 70 is disposed in the left-right direction. That is, the level gauge 100 is provided on a side surface portion of the hydraulic oil tank 15 on the side opposite to the driver's seat 17 side.

According to such a configuration, in a state where the hood 55 is opened, the amount of oil in the hydraulic oil tank 15 can be checked by any one of the level gauge 70 and the level gauge 100, and thus it is possible to widen a position range in which the amount of oil in the hydraulic oil tank 15 can be checked. As a result, good maintainability can be obtained.

[Configuration of Fuel Tank and Periphery Thereof]

A configuration of the fuel tank 14 and the periphery thereof will be described with reference to FIGS. 4 to 10 and FIGS. 13 to 18. The fuel tank 14 schematically has, as surface portions forming the outer shape thereof, a rear surface portion 14*a* facing the front surface portion 15*a* of the hydraulic oil tank 15, a left side surface portion 14*b* that is substantially flush with the left side surface portion 15*c* of the hydraulic oil tank 15, a right side surface portion 14*c*, an upper surface portion 14*d*, and a lower surface portion 14*e*. Further, the front side of the fuel tank 14 has a front surface portion 14*f*, an inclined surface portion 14*g*, and a right front surface portion 14*h*.

Further, the fuel tank 14 has a step portion 110 at the front portion thereof. The step portion 110 is formed as a recessed portion in the upper portion on the right side on the left and right outside of the fuel tank 14. The step portion 110 is a recess that forms a space portion 111 in which the upper side, the front side, and the right side are open sides. The step portion 110 is formed by cutting out a corner portion on the upper right side of the front portion of the fuel tank 14. The step portion 110 is schematically a notch-shaped portion that has a rear side surface portion 110*a* that is a rear-side surface portion of the step portion 110 and faces the front side, a left side surface portion 110*b* that is a left-side surface portion of the step portion 110 and faces the right side, and a bottom surface portion 110*c* that is a surface portion forming the bottom portion of the step portion 110 and faces the upper side, and that forms the space portion 111 by these surface portions.

In the fuel tank 14, the inclined surface portion 14*g* is an inclined portion that is inclined downward toward the front, and is formed in the substantially left half portion and the substantially upper half portion of the fuel tank 14 in the left-right direction. For example only, the inclination angle of the inclined surface portion 14*g* with respect to the vertical direction is approximately 30 degrees.

In the step portion 110, the rear side surface portion 110*a* forms a ridge portion together with each of the upper surface portion 14*d* and the right side surface portion 14*c*. Further, the left side surface portion 110*b* forms a ridge portion together with the inclined surface portion 14*g*. Furthermore, the bottom surface portion 110*c* forms a ridge portion together with each of the front surface portion 14*f* and the right front surface portion 14*h*.

In the configuration in which the fuel tank 14 has the step portion 110 as described above, a functional component is provided in the space portion 111 formed above the step portion 110 in the tank chamber 20. The functional component is disposed in the tank chamber 20 in such a manner that at least a part of the functional component is positioned in the space portion 111 formed by the step portion 110. In the present embodiment, as an example of the functional component, a fuel supply pump 120 for supplying fuel to the fuel tank 14 is provided inside the step portion 110. The fuel supply pump 120 is provided on the front side of the fuel tank 14 inside the tank chamber 20 by being disposed inside the step portion 110.

The fuel supply pump 120 is an electric suction pump that sucks up fuel from a container such as a polyethylene tank or a drum and supplies the fuel to the fuel tank 14. The fuel supply pump 120 has a pump main body portion 120*a* having a substantially cylindrical outer shape, and is installed in the step portion 110 of the fuel tank 14 in a direction in which the cylinder axial direction of the substantially cylindrical outer shape of the pump main body portion 120*a* is the left-right direction. A suction hose 121 for fuel suction by the fuel supply pump 120 and a supply hose 122 to the fuel tank 14 extend from the fuel supply pump 120.

The base end side, which is the downstream side, of the suction hose 121 is communicatively connected to a suction port 120*b* of the fuel supply pump 120. A filter 121*a* is provided at the tip end portion of the suction hose 121 which is the end portion on the upstream side. The base end side, which is the upstream side, of the supply hose 122 is communicatively connected to a delivery port 120*c* of the fuel supply pump 120. The tip end side, which is the downstream side, of the supply hose 122 is communicatively connected to a supply port section 123 provided on the upper surface portion 14*d* of the fuel tank 14. The supply port section 123 is provided in a portion of the upper surface portion 14*d* on the right side which is the rear side of the step portion 110.

The fuel supply pump 120 is provided so as to be positioned entirely within the step portion 110 of the fuel tank 14. In other words, the fuel supply pump 120 is entirely positioned within the range of the outer shape of the rear side surface portion 110*a* of the step portion 110 in a front view, entirely positioned within the range of the outer shape of the left side surface portion 110*b* of the step portion 110 in a right side view, and entirely positioned within the range of the outer shape of the bottom surface portion 110*c* of the step portion 110 in a plan view.

In the configuration including the swivel frame 7 on which the fuel tank 14 is installed, the fuel supply pump 120 is provided in a state of being supported by a support bracket 130 as a support member attached to the swivel frame 7. The support bracket 130 is a bent plate-shaped attachment member that is a metal plate-shaped member bent into a predetermined shape.

Figure 14:
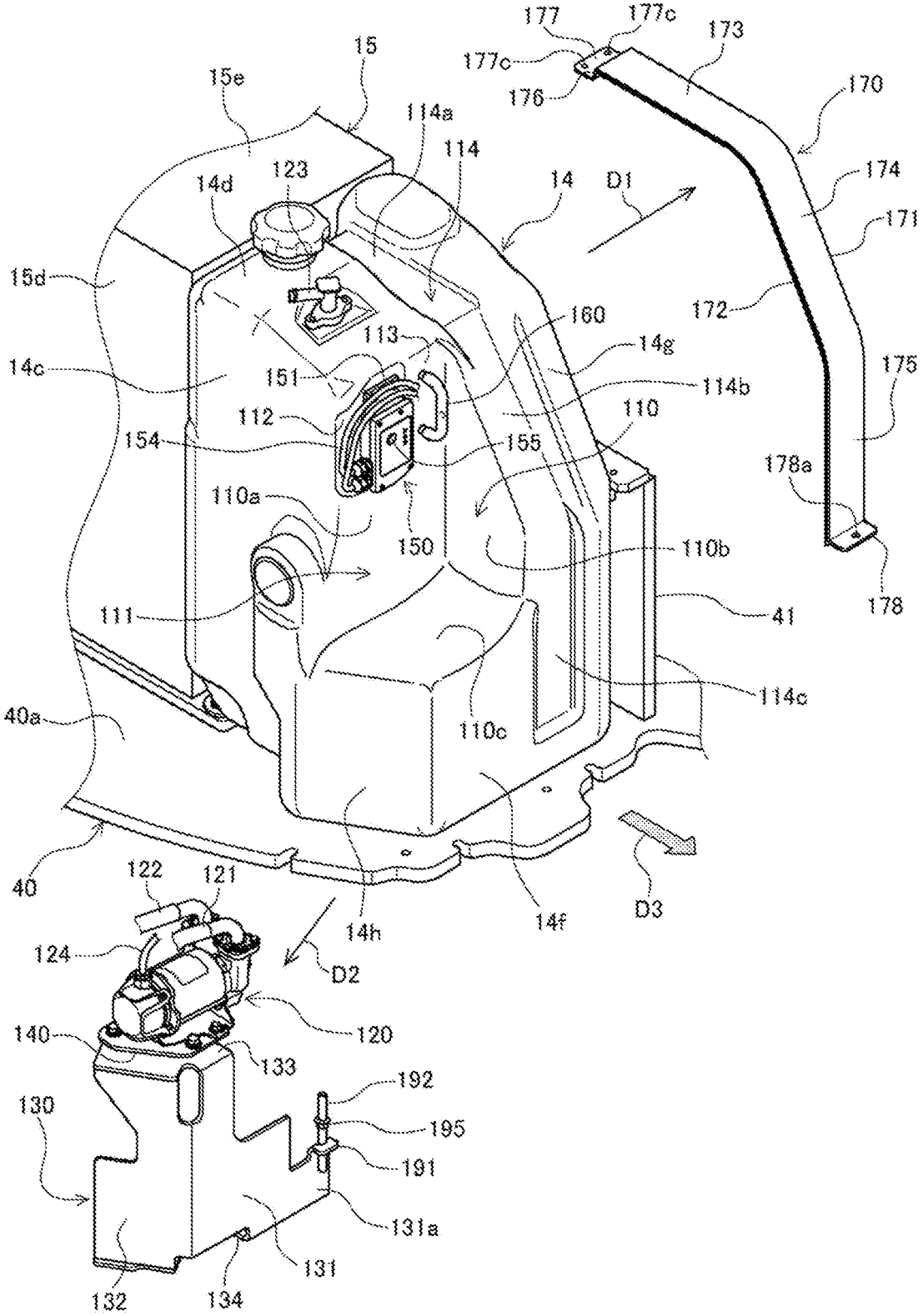
FIG. 14 is a right front exploded perspective view illustrating a configuration of the fuel tank and its vicinity according to one embodiment of the present invention.
Figure 15:
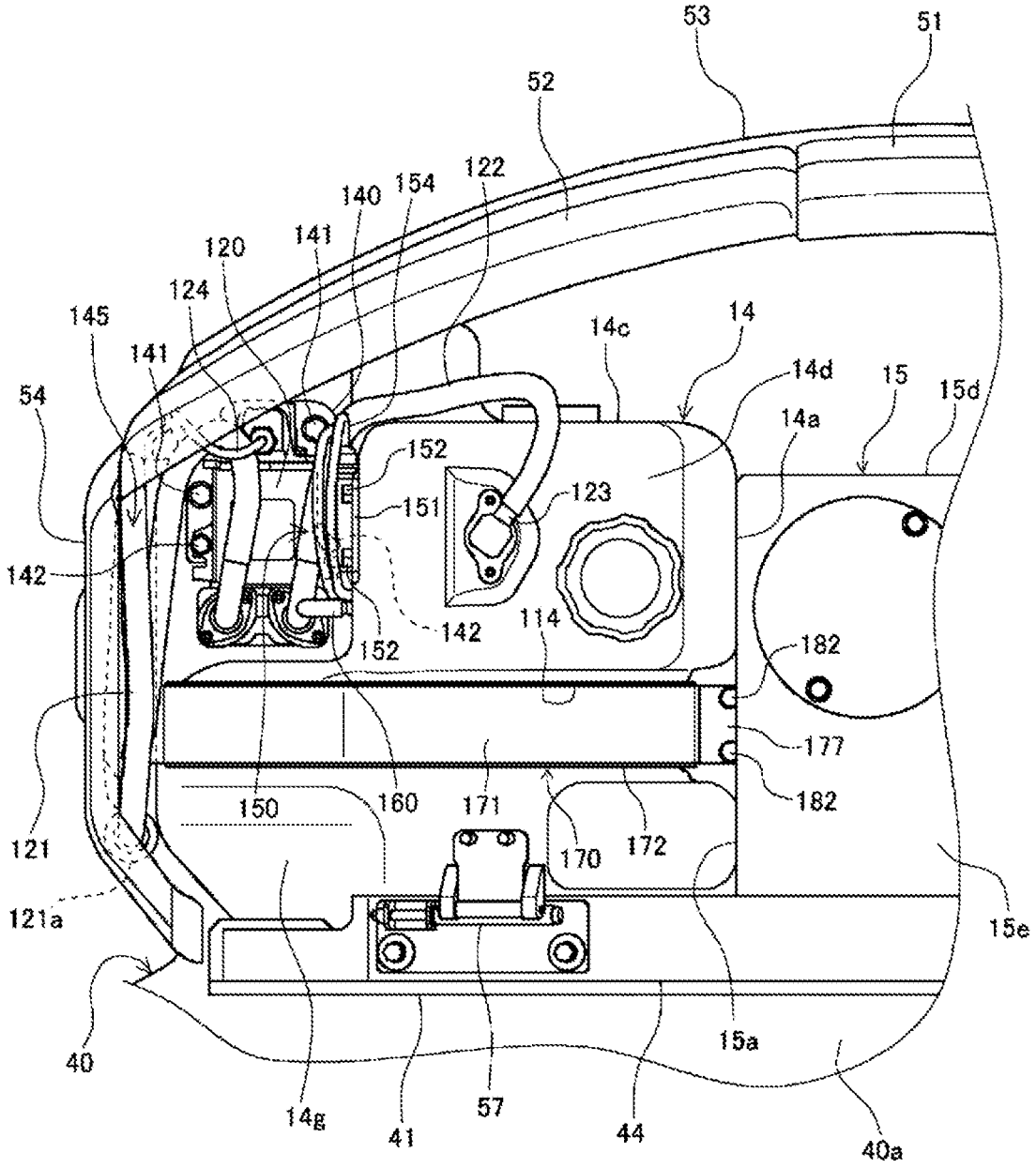
FIG. 15 is a plan view illustrating a configuration of the fuel tank and its vicinity according to one embodiment of the present invention.
Figure 16:
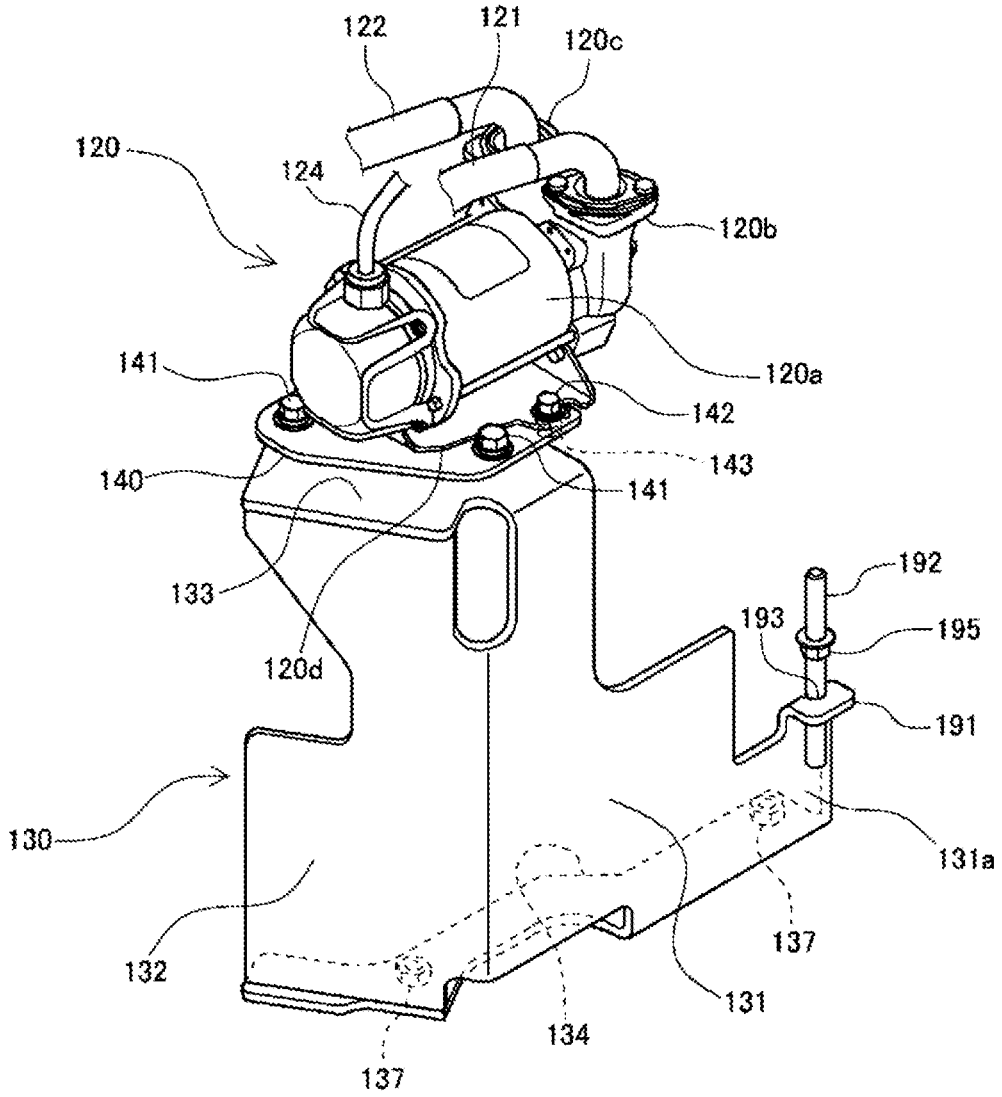
FIG. 16 is a right front perspective view illustrating a fuel supply pump and a support member according to one embodiment of the present invention.

The support bracket 130 is provided so as to be applied to the lower portion on the right front side of the fuel tank 14 installed on the base plate 40 constituting the swivel frame 7. As illustrated in FIGS. 14 and 15, the support bracket 130 has a front surface portion 131 that is a surface portion along the front surface portion 14*f* of the fuel tank 14 and covers the front surface portion 14*f*, an inclined surface portion 132 that is a surface portion along the right front surface portion 14*h* of the fuel tank 14 and covers the right front surface portion 14*h*, and an upper surface portion 133 that is a surface portion along the bottom surface portion 110*c* of the fuel tank 14 and convers the bottom surface portion 110*c*.

The front surface portion 131 and the inclined surface portion 132 of the support bracket 130 are in contact with or slightly spaced apart from (substantially in contact with) the front surface portion 14*f* and the right front surface portion 14*h* of the fuel tank 14, respectively. Further, the upper surface portion 133 of the support bracket 130 is spaced apart from the bottom surface portion 110*c* of the fuel tank 14, and is positioned above the bottom surface portion 110*c*.

The support bracket 130 is provided in a state of being fixed to the base plate 40. The support bracket 130 has, as a portion fixed to the base plate 40, a fixing surface portion 134 formed to be bent inward at a right angle with respect to each of the front surface portion 131 and the inclined surface portion 132. The support bracket 130 is fastened and fixed to the base plate 40 at two positions by a bolt 136 which penetrates the base plate 40 and the fixing surface portion 134 from the lower side and a nut section 137 which is positioned on the fixing surface portion 134 and receives screwing of the bolt 136, with the fixing surface portion 134 as a surface portion contacting with the upper surface 40*a* of the base plate 40.

The fuel supply pump 120 is fixed to and supported by the support bracket 130 via an attachment plate 140. The attachment plate 140 is a flat plate-shaped member, and is fastened and fixed to the support bracket 130 at two front and rear positions by bolts 141 or the like penetrating the attachment plate 140 and the upper surface portion 133 in a state of being superimposed on the upper surface portion 133 of the support bracket 130.

The fuel supply pump 120 is fixed to the attachment plate 140 while being placed on the attachment plate 140. The fuel supply pump 120 has an attachment bracket portion 120*d* on the lower side of the pump main body portion 120*a*, and is fastened and fixed to the attachment plate 140 at two front and rear positions by bolts 142 and nuts 143, with the attachment bracket portion 120*d* as a fixing and supporting portion against the attachment plate 140 (see FIGS. 15 and 16).

Regarding the suction hose 121 extending from the fuel supply pump 120, as illustrated in FIGS. 6 and 15, a hose accommodating portion 145 that accommodates the suction hose 121 is provided in the tank chamber 20. The hose accommodating portion 145 is provided as a gap portion between the fuel tank 14 and an exterior cover forming the tank chamber 20 around the fuel tank 14.

In the present embodiment, the hose accommodating portion 145 is formed between the fuel tank 14 and the exterior cover on the front side of the lower portion of the fuel tank 14. In other words, the hose accommodating portion 145 has, as an accommodating space, a space portion between the front surface portion 14*f* of the fuel tank 14 and the front edge portion of the right front cover 52 and the front cover 54, which are exterior covers. Therefore, the suction hose 121 accommodated in the hose accommodating portion 145 is positioned on the rear side of the front cover 54 and the front side of the front surface portion 131 of the support bracket 130 in the tank chamber 20.

The hose accommodating portion 145 is a flat space portion that is narrow in the front-rear direction, and the suction hose 121 is accommodated in the hose accommodating portion 145 by being wound or bent into a flat shape. In the example illustrated in FIGS. 6 and 15, the suction hose 121 with the base end side connected to the suction port 120*b* of the fuel supply pump 120 is accommodated in the hose accommodating portion 145 with the most part of the tip end side formed in a spiral shape. Further, when the hood 55 is opened, the upper portion of the spiral portion of the suction hose 121 accommodated in the hose accommodating portion 145 is exposed above the upper edge portion of the front cover 54 (see FIG. 6).

However, the accommodating form of the suction hose 121 in the hose accommodating portion 145 is not particularly limited. When the hood 55 is closed in a state where the suction hose 121 is accommodated in the hose accommodating portion 145, the suction hose 121 is accommodated in the tank chamber 20.

In the configuration in which the fuel supply pump 120 is disposed in the step portion 110 of the fuel tank 14 as described above, an operation switch 150 for turning on and off the actuation of the fuel supply pump 120 is provided at a portion of the fuel tank 14 in the vicinity of the fuel supply pump 120. The operation switch 150 is provided on the rear side surface portion 110*a* of the step portion 110 of the fuel tank 14 in the tank chamber 20, at a position facing the space portion 111.

The operation switch 150 is installed in a switch installation recess 112 formed on the right side of the upper portion of the rear side surface portion 110*a* forming the step portion 110 of the fuel tank 14. The switch installation recess 112 is a portion which is recessed relatively shallowly in such a manner that the upper right portion of the rear side surface portion 110*a* is partially positioned on the rear side with respect to other portions.

The operation switch 150 has a flat box-like outer shape, and is installed in the switch installation recess 112 along the rear side surface portion 110*a*. The operation switch 150 is attached to the fuel tank 14 in a state of being fixed by a fixing tool 152 (see FIG. 15) such as a bolt which penetrates a flange section 151 formed in the peripheral edge portion.

The operation switch 150 is electrically connected to the fuel supply pump 120 by connecting a signal line 154 extending from the right surface portion thereof to a signal line 124 extending from the upper side of the pump main body portion 120*a* of the fuel supply pump 120. The signal lines 124, 154 are connected to each other by a connector (not illustrated) provided at the tip end portion of each signal line. An operation button 155 is provided on the front surface portion of the operation switch 150. When the operation button 155 is pressed, the fuel supply pump 120 is turned on and off. The fuel supply pump 120 and the operation switch 150 constitute an automatic refueling unit that automatically supplies fuel oil from a polyethylene tank or the like to the fuel tank 14.

Further, in the fuel tank 14, a fuel gauge 160 that indicates the amount of fuel in the fuel tank 14 is provided on the rear side surface portion 110*a* of the step portion 110 in the tank chamber 20, at a position facing the space portion 111. The fuel gauge 160 is provided on a vertical flat surface portion 113 on the left side of the upper portion of the rear side surface portion 110*a* of the fuel tank 14. That is, the fuel gauge 160 is provided on the flat surface portion 113 which is a portion on the left side of the switch installation recess 112 on the rear side surface portion 110*a*. Therefore, the fuel gauge 160 is positioned to the left of the operation switch 150.

Figure 17:
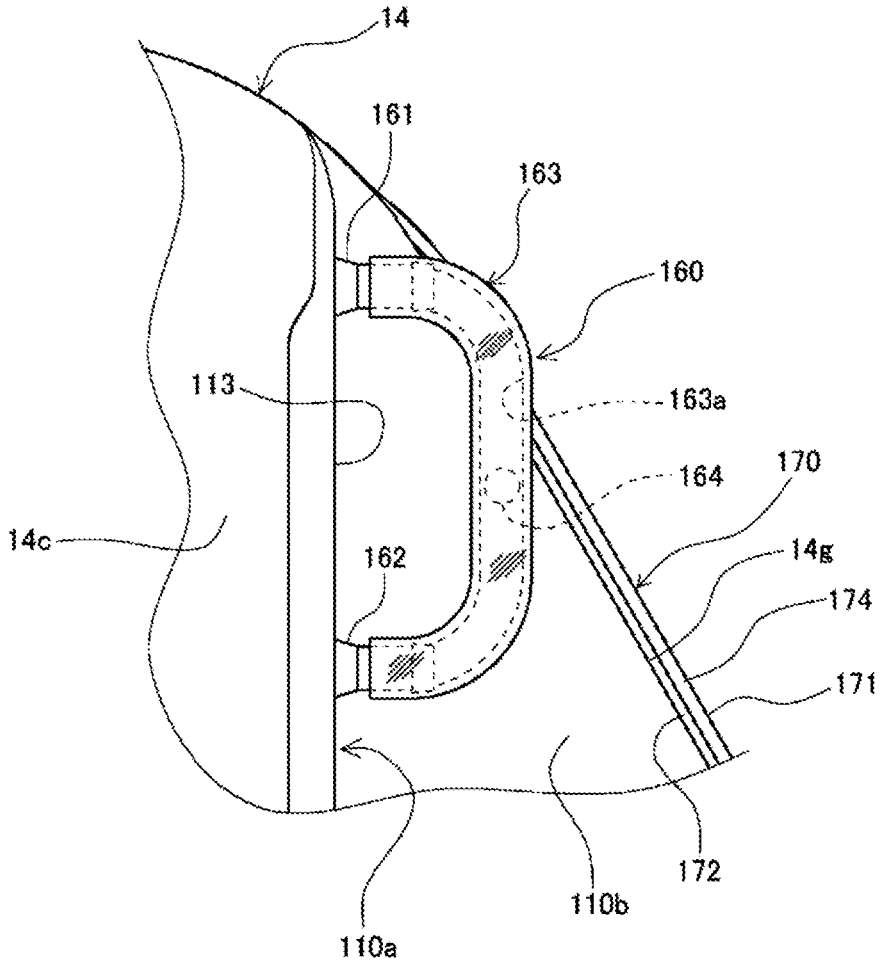
FIG. 17 is a right side view illustrating a configuration of a fuel gauge according to one embodiment of the present invention.

The fuel gauge 160 is a liquid level gauge for grasping the amount of oil in the tank of the fuel tank 14. As illustrated in FIG. 17, the fuel gauge 160 has an upper connection port section 161 and a lower connection port section 162 which are provided so as to communicate with the storage space of the fuel tank 14 in the flat surface portion 113 of the fuel tank 14, and a main body pipe section 163 which communicatively connects these connection port sections with each other.

The upper connection port section 161 is a cylindrical opening portion provided to protrude forward at a first height position in the vicinity of the upper end portion of the flat surface portion 113 of the fuel tank 14. The lower connection port section 162 is a cylindrical opening portion provided to protrude forward at a position vertically below the upper connection port section 161 and at a second height position lower than the first height position in the upper portion of the flat surface portion 113.

The main body pipe section 163 is a tubular member having a substantially "U"-shaped bent form, and in a state where the upper connection port section 161 is inserted into one end side and the lower connection port section 162 is inserted into the other end side, the upper connection port section 161 and the lower connection port section 162 are communicatively connected to each other to form a gauge passage communicating with the inside of the tank together with these connection port sections. The main body pipe section 163 is fixed to each of the upper connection port section 161 and the lower connection port section 162 by a hose band or the like (not illustrated).

In the main body pipe section 163, an intermediate portion between respective connecting portions to the upper connection port section 161 and the lower connection port section 162 is formed as a linear portion along the up-down direction, and a spherical float 164 is movably incorporated in an internal passage 163*a*. The main body pipe section 163 is made of a transparent member, and the position of the float 164 in the internal passage 163*a* can be visually recognized from the outside.

According to the fuel gauge 160, the height of the liquid level in the gauge passage is equal to the height of the liquid level of the hydraulic oil in the fuel tank 14. Therefore, regarding the height of the liquid level of the liquid fuel in the fuel tank 14, the height of the liquid level positioned between the upper connection port section 161 and the lower connection port section 162 is indicated as the position (height) of the float 164 in the gauge passage by the fuel gauge 160.

The fuel gauge 160 is used to check that a predetermined amount of fuel is contained in the fuel tank 14. Further, the fuel gauge 160 is used to check the presence or absence of occurrence of a failure such as breakage of a hose that causes leakage of the fuel, from the degree of decrease in the amount of oil in the tank of the fuel tank 14.

Next, a fixing structure of the fuel tank 14 on the base plate 40 will be described. The excavation work machine 1 includes a fixing/holding plate 170 and the support bracket 130 as fixing members for fixing the fuel tank 14 to the base plate 40 of the swivel frame 7. In other words, the excavation work machine 1 has, as fixing members, the fixing/holding plate 170 which is a first fixing member and the support bracket 130 which is a second fixing member also serving as a support member.

The fuel tank 14 is provided in a state of being placed on the base plate 40. Support fittings 165 are interposed between the fuel tank 14 and the base plate 40 at two front and rear positions (see FIGS. 9 and 10). The support fitting 165 is a bent plate-shaped member whose longitudinal direction is the left-right direction and which has a flat gate shape in a front view, and forms a horizontal support surface 165*a* at a position higher than the upper surface 40*a* of the base plate 40. The fuel tank 14 is placed on the base plate 40 in a state where the lower surface portion 14*e* is supported by the support surface 165*a*. A buffer material such as a rubber sheet is interposed between the support surface 165*a* and the lower surface portion 14*e*.

The fixing/holding plate 170 is a belt-like bent member having a substantially constant width as a whole and having a predetermined bent shape in a side view. The fixing/holding plate 170 is fixed to each of the hydraulic oil tank 15 and the support bracket 130 in a state of being applied to the fuel tank 14 from the upper front side in a direction in which the width direction is the left-right direction and the longitudinal direction is along the front-rear direction in a plan view.

The fixing/holding plate 170 has a rear end portion fixed to the hydraulic oil tank 15 fixed on the base plate 40, and a front end portion fixed to a support bracket 130 fixed on the base plate 40. That is, the rear end portion of the fixing/holding plate 170 is fixed to the base plate 40 via the hydraulic oil tank 15, and the front end portion thereof is fixed to the base plate 40 via the support bracket 130. The fixing/holding plate 170 indirectly fixes the fuel tank 14 to the base plate 40 by pressing the fuel tank 14 from the upper side in a state of being fixed to the hydraulic oil tank 15 and the support bracket 130. The fixing section of the fixing/holding plate 170 to the hydraulic oil tank 15 is referred to as a rear side fixing section 180, and the fixing section of the fixing/holding plate 170 to the support bracket 130 is referred to as a front side fixing section 190.

The fixing/holding plate 170 has a holding plate main body 171 formed of a metal plate-shaped member, and an elastic sheet 172 as a buffer member formed of an elastic material such as a rubber sheet attached to the back side (lower side) of the fixing/holding plate main body 171. The holding plate main body 171 and the elastic sheet 172 have substantially the same shape and size as each other, and have an integrally bent shape as the fixing/holding plate 170. The elastic sheet 172 may be interposed between the fuel tank 14 and the holding plate main body 171. Therefore, the elastic sheet 172 may be attached to the fuel tank 14 side, for example. In this case, the holding plate main body 171 itself serves as the fixing/holding plate 170.

The fixing/holding plate 170 has, as a portion that forms a bent shape in a side view, a horizontal surface portion 173 along the upper surface portion 14*d* of the fuel tank 14, an inclined surface portion 174 that is inclined downward toward the front along the inclined surface portion 14*g* of the fuel tank 14, and a vertical surface portion 175 that is vertical along the front surface portion 14*f* of the fuel tank 14. In the fixing/holding plate 170, the horizontal surface portion 173, the inclined surface portion 174, and the vertical surface portion 175 have substantially the same length. The fixing/holding plate 170 has a double structure by the holding plate main body 171 and the elastic sheet 172, and the holding plate main body 171 and the elastic sheet 172 have portions corresponding to the horizontal surface portion 173, the inclined surface portion 174, and the vertical surface portion 175, respectively.

In the fuel tank 14, a recessed groove portion 114 corresponding to the outer shape of the fixing/holding plate 170 is formed as a portion to which the fixing/holding plate 170 is attached (see FIG. 14). In the fuel tank 14, the groove portion 114 is formed in an intermediate portion in the left-right direction. More specifically, the groove portion 114 is formed in the central portion of the portion of the fuel tank 14 on the left side of the step portion 110 in the left-right direction.

The groove portion 114 has a width substantially the same as the width of the fixing/holding plate 170 or slightly larger than the width of the fixing/holding plate 170. The fixing/holding plate 170 has, for example, a width dimension of approximately 1/7 to 1/5 of the dimension of the fuel tank 14 in the left-right direction. Further, the groove portion 114 has a depth substantially the same as the thickness of the fixing/holding plate 170 or slightly shallower than the thickness of the fixing/holding plate 170.

The groove portion 114 has a horizontal first surface portion 114*a* formed on the upper surface portion 14*d* and brought into contact with the horizontal surface portion 173, an inclined second surface portion 114*b* formed on the inclined surface portion 14*g* and brought into contact with the inclined surface portion 174, and a vertical third surface portion 114*c* formed on the front surface portion 14*f* and brought into contact with the vertical surface portion 175 (see FIG. 14). The fixing/holding plate 170 is attached in a state where the elastic sheet 172 is in contact with each surface portion of the groove portion 114, and is subjected to a positioning action mainly in the left-right direction by being fitted into the groove portion 114.

Figure 18:
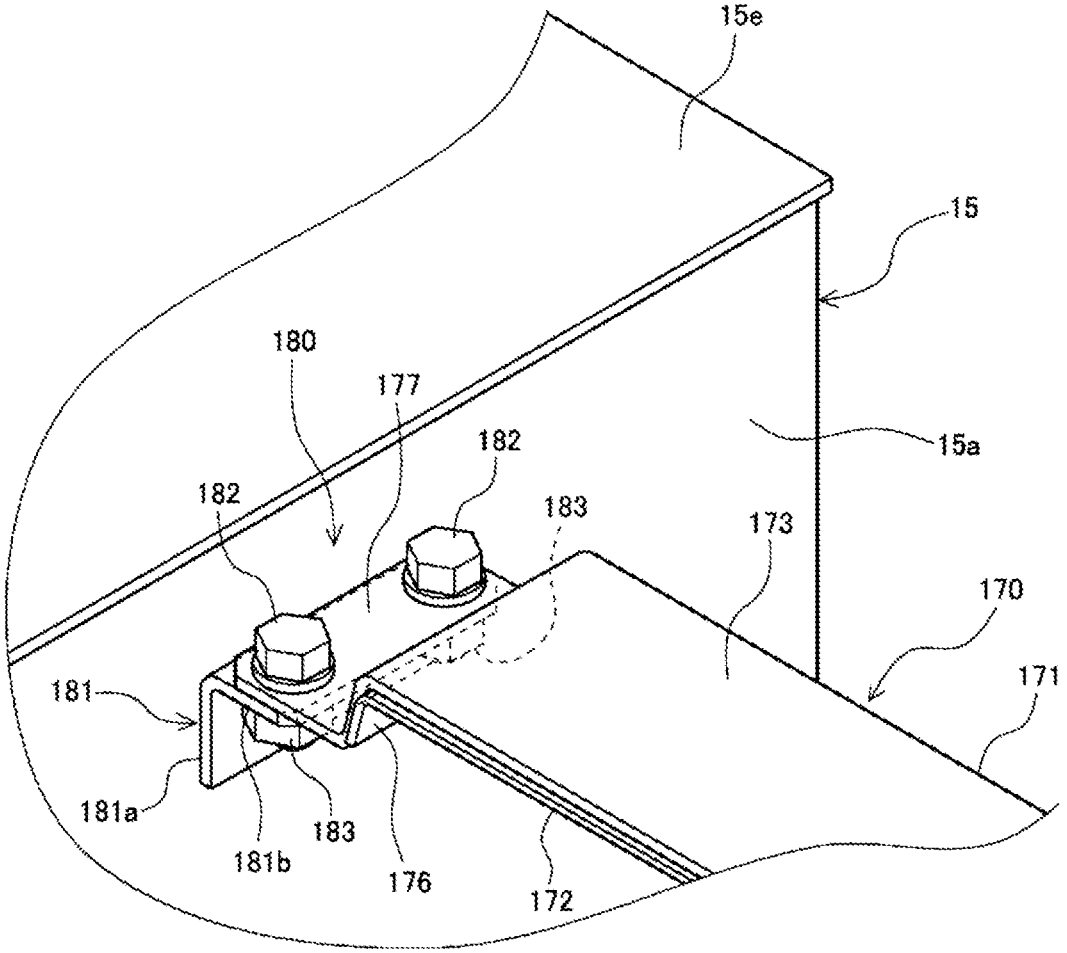
FIG. 18 is a right front perspective view illustrating a configuration of a fixing section on the rear side of a fixing/holding plate according to one embodiment of the present invention.
Figure 19:
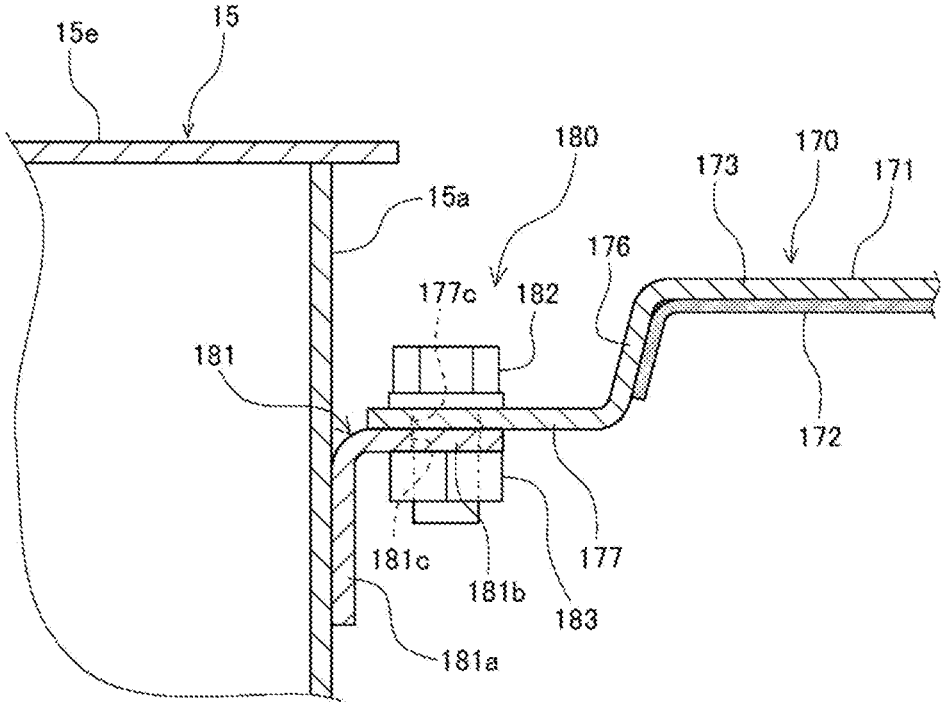
FIG. 19 is a right side sectional view illustrating a configuration of the fixing section on the rear side of the fixing/holding plate according to one embodiment of the present invention.

As illustrated in FIGS. 18 and 19, in the rear side fixing section 180, the rear end portion of the fixing/holding plate 170 is fixed to a support stay 181 provided on the front surface portion 15*a* of the hydraulic oil tank 15. The support stay 181 is provided in the vicinity of the upper end portion of the laterally intermediate portion of the front surface portion 15*a*. The support stay 181 is provided by fixing an L-shaped fitting to the front surface portion 15*a*, and has a fixing surface portion 181*a* along the front surface portion 15*a* and a support surface portion 181*b* forming a surface portion horizontally protruding forward from the front surface portion 15*a*, and these surface portions form an L-shape in a side view. In the support stay 181, the fixing surface portion 181*a* is fixed to the front surface portion 15*a* by welding or the like.

At the rear end portion of the fixing/holding plate 170, a rear fixing surface portion 177 is provided, which is formed in a step-down shape with respect to the horizontal surface portion 173 via an inclined surface portion 176. The inclined surface portion 176 is formed to be bent with respect to the horizontal surface portion 173 so as to form an inclined surface inclined downward toward the rear from the rear edge portion of the horizontal surface portion 173. The rear fixing surface portion 177 is formed to be bent with respect to the inclined surface portion 176 in a horizontal shape toward the rear from the lower edge portion of the inclined surface portion 176. A double structure portion of the holding plate main body 171 and the elastic sheet 172 is formed from the horizontal surface portion 173 to the inclined surface portion 176, and the rear fixing surface portion 177 is formed only by the holding plate main body 171.

The fixing/holding plate 170 is fastened and fixed to the support stay 181 at two left and right positions by bolts 182 and nuts 183 in a state where the rear fixing surface portion 177 is overlapped with the support surface portion 181*b* of the support stay 181 from the upper side. The bolt 182 penetrates the rear fixing surface portion 177 and the support surface portion 181*b* from the upper side, and is screwed into the nut 183 on the lower side of the support surface portion 181*b*. The rear fixing surface portion 177 and the support surface portion 181*b* are respectively formed with hole portions 177*c* and 181*c* through which the bolt 182 is penetrated. As described above, in the rear side fixing section 180, the fixing/holding plate 170 is fixed to the main body portion of the hydraulic oil tank 15 via the support stay 181.

Figure 20:
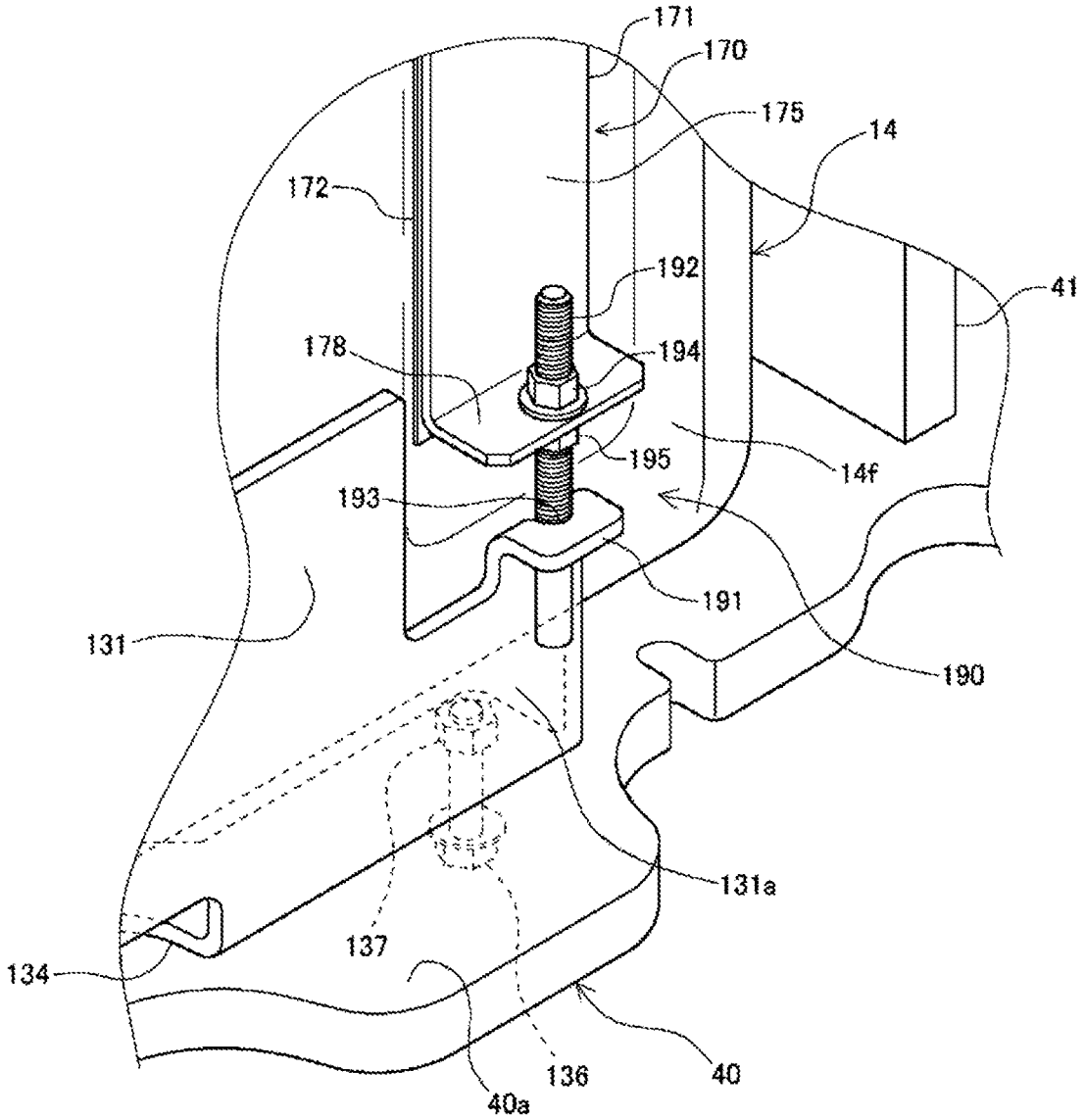
FIG. 20 is a right front perspective view illustrating a configuration of a fixing section on the front side of the fixing/holding plate according to one embodiment of the present invention.
Figure 21:
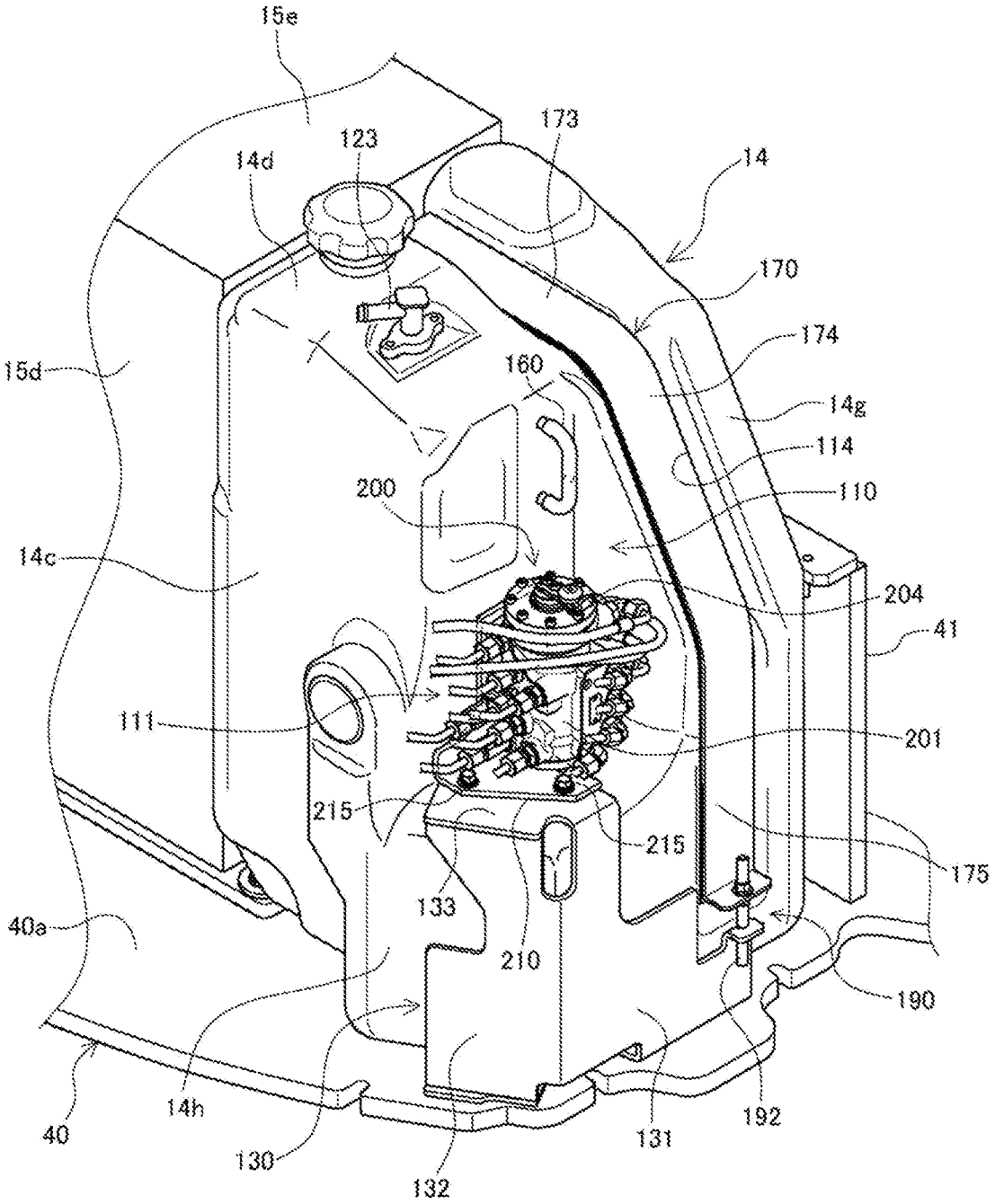
FIG. 21 is a right front perspective view illustrating an example of arrangement of another functional component according to one embodiment of the present invention.
Figure 22:
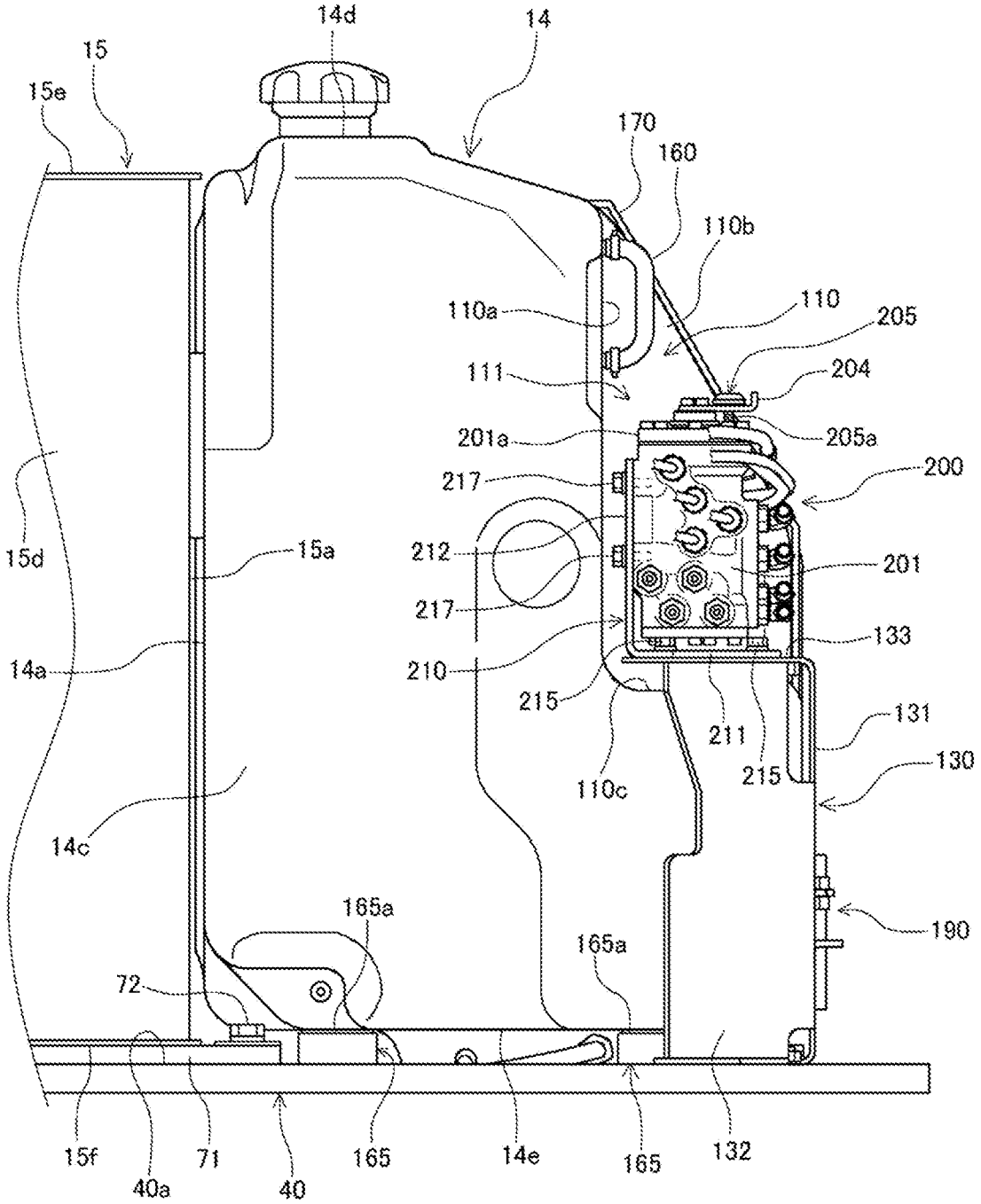
FIG. 22 is a right side view illustrating an example of arrangement of another functional component according to one embodiment of the present invention.
Figure 23:
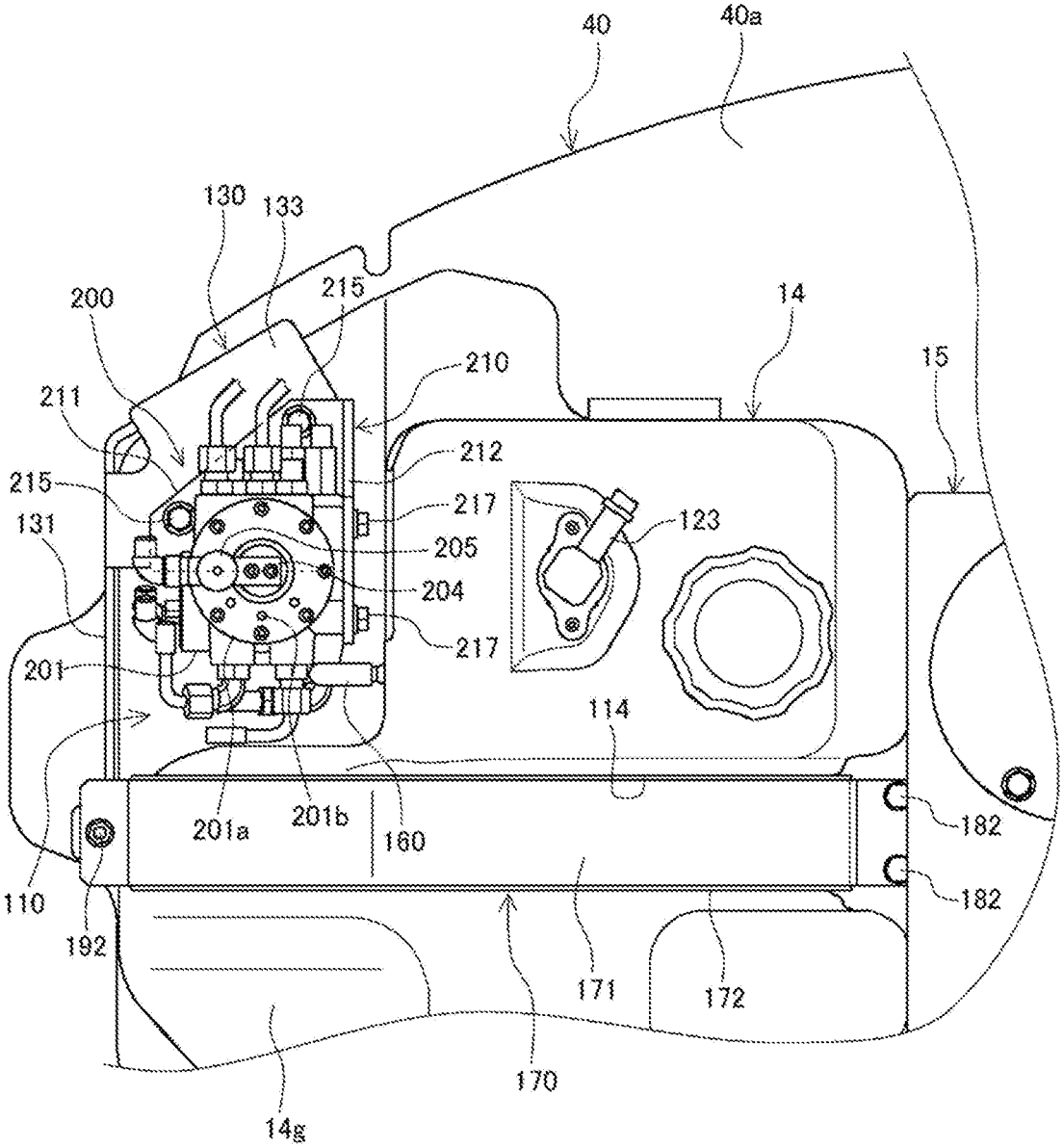
FIG. 23 is a plan view illustrating an example of arrangement of another functional component according to one embodiment of the present invention.
Figure 24:
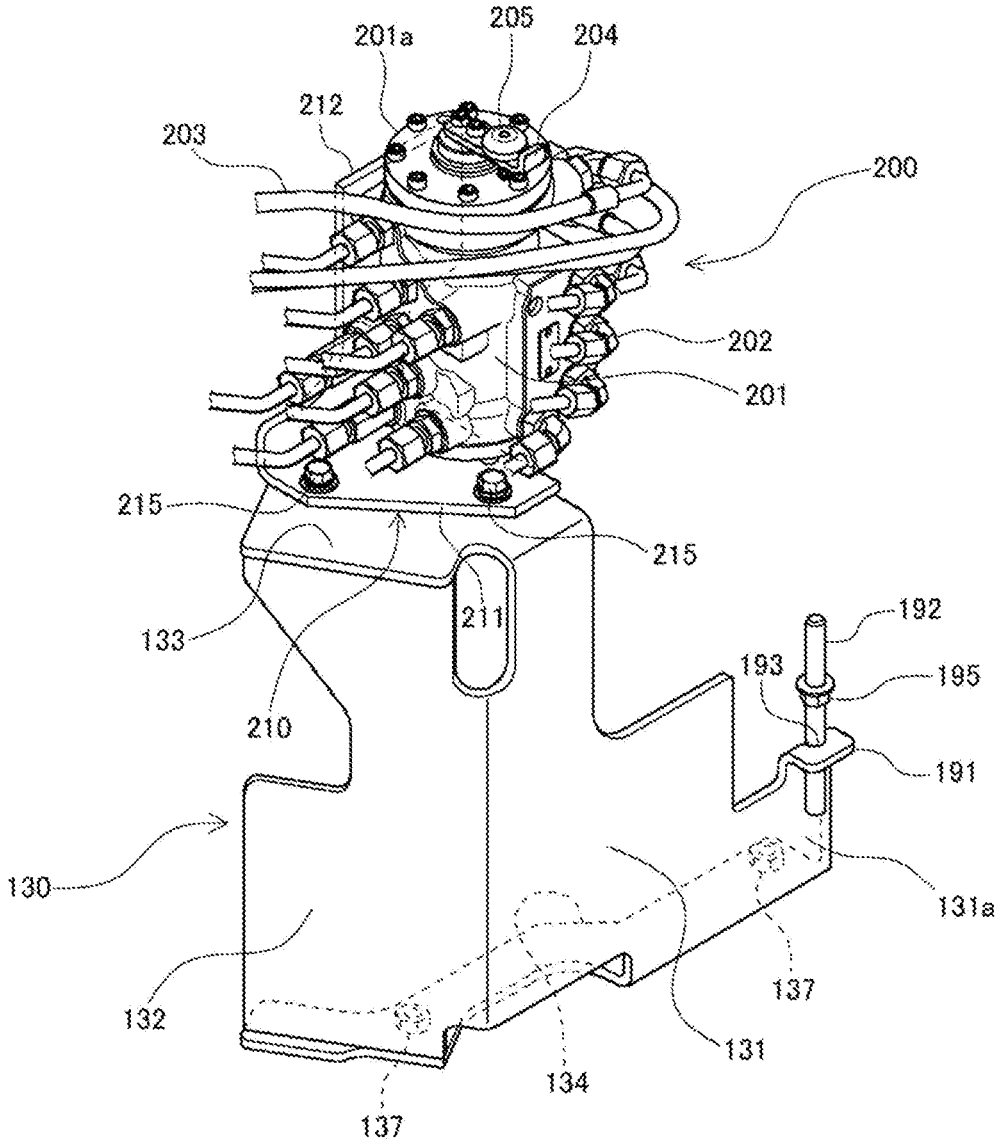
FIG. 24 is a right front perspective view illustrating a multivalve and a support member according to one embodiment of the present invention.

As illustrated in FIG. 20, in the front side fixing section 190, the front end portion (lower end portion) of the fixing/holding plate 170 is fixed to a holding plate support surface portion 191 which is a part of the support bracket 130 via a screw rod 192. In the front surface portion 131 of the support bracket 130, the holding plate support surface portion 191 is formed horizontally bent forward from the upper edge portion of an extending portion 131*a* whose lower portion extends leftward. The holding plate support surface portion 191 has a rectangular outer shape in a plan view.

The screw rod 192 is a linear rod-like member having a screw portion on the outer peripheral surface, and is fixed to the support bracket 130 in a direction in which the axial direction is the up-down direction. In the support bracket 130, as a portion through which the screw rod 192 penetrates, a notch-shaped opening portion 193 having a shape along an arc shape in a plan view is formed at a corner portion between the extending portion 131*a* and the holding plate support surface portion 191. The screw rod 192 is fixed to the support bracket 130 by welding or the like in such a manner as to penetrate the holding plate support surface portion 191 by being fitted into the opening portion 193. The screw rod 192 extends upward from the holding plate support surface portion 191. In the screw rod 192, at least a portion on the upper side of the holding plate support surface portion 191 is a male screw portion in which a screw portion is formed on the outer peripheral surface.

The lower end portion of the fixing/holding plate 170 is provided with a front fixing surface portion 178 formed so as to form a right angle with respect to the vertical surface portion 175. The front fixing surface portion 178 is formed to be bent in a horizontal shape toward the front from the lower edge portion of the vertical surface portion 175. The double structure portion of the holding plate main body 171 and the elastic sheet 172 is formed up to the lower end portion of the vertical surface portion 175, and the front fixing surface portion 178 is formed only by the holding plate main body 171.

The fixing/holding plate 170 is fastened and fixed to the screw rod 192 by an upper nut 194 and a lower nut 195 positioned above and below the front fixing surface portion 178 in a state where the front fixing surface portion 178 faces the holding plate support surface portion 191 from above and the screw rod 192 penetrates the front fixing surface portion 178. The upper nut 194 and the lower nut 195 are screwed into the screw rod 192, and fix the fixing/holding plate 170 to the screw rod 192 by sandwiching the front fixing surface portion 178. A hole portion 178*a* through which the screw rod 192 penetrates is formed in the front fixing surface portion 178 (see FIG. 14). As described above, in the front side fixing section 190, the fixing/holding plate 170 is fixed to the support bracket 130 via the screw rod 192.

In the front side fixing section 190, the fixing position of the fixing/holding plate 170 in the axial direction of the screw rod 192 is adjusted by the positions of the upper nut 194 and the lower nut 195 on the screw rod 192. Accordingly, by tightening the upper nut 194 with respect to the lower nut 195 in such a manner that the front fixing surface portion 178 approaches the holding plate support surface portion 191, a sandwiching force between the fixing/holding plate 170 and the base plate 40 can be applied as a downward pressing force against the fuel tank 14. As a result, the fuel tank 14 is fixed to the base plate 40. As for the fixing of the fuel tank 14 by the fixing/holding plate 170, the movement of the fuel tank 14 in the left-right direction on the base plate 40 is restricted by the fitting action of the fixing/holding plate 170 with respect to the groove portion 114 of the fuel tank 14.

Further, the fuel tank 14 is restricted from moving forward and rightward on the base plate 40 by the support bracket 130 fixed on the base plate 40. On the left side and the rear side of the fuel tank 14 on the base plate 40, the movement of the fuel tank 14 is restricted by the vertical plate 41 and the hydraulic oil tank 15 which are respectively disposed in the vicinity of the fuel tank 14.

According to the fixing structure of the fuel tank 14 to the base plate 40 as described above, the fuel tank 14 is provided to be movable with respect to the base plate 40 of the swivel frame 7 by releasing the fixation by the fixing/holding plate 170 and the support bracket 130. That is, the fuel tank 14 can be taken out from the base plate 40 by removing the fixing/holding plate 170 and the support bracket 130.

Specifically, the fixing/holding plate 170 is removed from the acting state with respect to the fuel tank 14 by removing the bolts 182 and the nuts 183 in the rear side fixing section 180 to release the fixation by the rear side fixing section 180, and removing the upper nut 194 in the front side fixing section 190 to release the fixation by the front side fixing section 190 (see an arrow D1 in FIG. 14). Further, the support bracket 130 is removed from the base plate 40 by removing the bolt 136 screwed into the nut section 137 (see an arrow D2 in FIG. 14).

As for the removal of the support bracket 130, the support bracket 130 can be removed together with the fuel supply pump 120 fixed on the support bracket 130. When the fuel supply pump 120 is removed in a state of being fixed to the support bracket 130, the connection of the supply hose 122 to the supply port section 123 of the fuel tank 14 and the electrical connection of the fuel supply pump 120 to the operation switch 150 by the signal lines 124, 154 are released.

As described above, by removing the fixing/holding plate 170 and the support bracket 130, the fuel tank 14 becomes movable on the front side and the right side on the base plate 40. In this state, the fuel tank 14 can be removed from the swivel frame 7 by, for example, sliding the fuel tank 14 forward on the base plate 40 (see an arrow D3 in FIG. 14). Further, the fuel tank 14 can also be removed from the swivel frame 7, for example, by being lifted upward. When the fuel tank 14 is removed, the exterior cover forming the tank chamber 20 is opened or removed, and the fuel tank 14 is thereby released from the exterior cover.

According to the configuration of the fuel tank 14 and the periphery thereof in the excavation work machine 1 according to the present embodiment as described above, good maintainability can be obtained for the fuel supply pump 120.

The fuel tank 14 provided in the tank chamber 20 has the step portion 110, and the fuel supply pump 120 is provided in the space portion 111 formed by the step portion 110. According to such a configuration, when the hood 55 of the tank chamber 20 is opened, the fuel supply pump 120 is exposed to face the opening portion 50, and thus the fuel supply pump 120 can be easily visually recognized. As a result, good accessibility to the fuel supply pump 120 can be obtained, and maintenance of the fuel supply pump 120 can be easily performed.

The step portion 110 of the fuel tank 14 for disposing the fuel supply pump 120 may be a portion formed so as to form a space portion with at least the upper side as the open side. Therefore, the step portion 110 may be, for example, a notch-shaped portion forming a space portion in which the upper side and the front side are open sides, or may be a hole-shaped portion forming a space portion in which only the upper side is the open side.

Further, the step portion 110 of the fuel tank 14 is formed as a notch-shaped portion that forms the space portion 111 by the rear side surface portion 110*a*, the left side surface portion 110*b*, and the bottom surface portion 110*c*. That is, the step portion 110 is provided as a portion that forms the space portion 111 in which three sides of the upper side, the front side, and the lateral side (right side) are open sides. According to such a configuration, it is possible to obtain good accessibility and maintainability for the fuel tank 14 in a state where the hood 55 is opened.

Further, the fuel supply pump 120 is supported by the support bracket 130 attached to the base plate 40. According to such a configuration, it is not necessary to directly attach the fuel supply pump 120 to the fuel tank 14, and thus it is possible to appropriately adopt, as the fuel tank 14, a tank made of a material suitable for forming the step portion 110 and the like, such as a tank made of resin. Further, by fixing and supporting the fuel supply pump 120 on the support bracket 130 fixed to the base plate 40, it is possible to obtain high vibration isolation performance for the fuel supply pump 120, for example, as compared with a configuration in which the fuel supply pump 120 is directly attached to the fuel tank 14.

Further, the fuel tank 14 is provided to be movable with respect to the base plate 40 by releasing the fixation by the fixing/holding plate 170 and the support bracket 130. According to such a configuration, the fuel tank 14 can be easily removed from the swivel frame 7 by a simple operation of removing the fixing/holding plate 170 and the support bracket 130. As a result, for example, when the fuel tank 14 is cleaned in a case where an inappropriate fuel is put into the fuel tank 14, or when maintenance of the fuel tank 14 is performed, the fuel tank 14 can be easily removed from the swivel frame 7, and therefore good workability can be obtained.

Further, the fixing/holding plate 170 and the support bracket 130 are provided as fixing members for the fuel tank 14. According to such a configuration, the fixing/holding plate 170 can be supported and fixed by a simple configuration using the hydraulic oil tank 15 and the support bracket 130 fixedly provided on the base plate 40. Further, regarding the fixation of the fuel tank 14 on the base plate 40, a main fixing action can be obtained by the fixing/holding plate 170, and the movement of the fuel tank 14 in a predetermined direction can be restricted by the support bracket 130, and thus a stable fixed state on the base plate 40 can be obtained.

Further, the fuel tank 14 has the groove portion 114 into which the fixing/holding plate 170 is fitted, and it is thereby possible to suppress the positional deviation of the fuel tank 14 in the left-right direction on the base plate 40, and thus a more stable fixed state can be obtained. Furthermore, the fixing/holding plate 170 has a configuration in which the elastic sheet 172 is attached to the back side of the holding plate main body 171. According to such a configuration, it is possible to suppress a scar or the like caused by attaching the fixing/holding plate 170 to the fuel tank 14, bring the fixing/holding plate 170 into close contact with the fuel tank 14, and thus obtain a good holding property by the fixing/holding plate 170.

Further, the step portion 110 of the fuel tank 14 is provided with the operation switch 150 for turning on/off the fuel supply pump 120. According to such a configuration, when the hood 55 of the tank chamber 20 is opened, the operation switch 150 is exposed to face the opening portion 50 together with the fuel supply pump 120, and thus the fuel supply pump 120 and the operation switch 150 can be visually recognized at the same time. As a result, good accessibility to the fuel supply pump 120 and the operation switch 150 can be obtained, and maintenance of these units can be easily performed.

In addition, good operability of the operation switch 150 can be obtained, and thus the fuel can be easily supplied to the fuel tank 14 by the fuel supply pump 120. In particular, according to the configuration in which the fuel supply pump 120 is disposed above the bottom surface portion 110*c* in the step portion 110 of the fuel tank 14 and the operation switch 150 is disposed on the side surface portion such as the rear side surface portion 110*a*, the fuel supply pump 120 and the operation switch 150 can be disposed in the vicinity of each other, the operability of the operation switch 150 can be improved, and good workability can be obtained in the refueling operation for the fuel tank 14.

Further, the fuel gauge 160 for the fuel tank 14 is provided on the step portion 110 of the fuel tank 14. According to such a configuration, when the hood 55 of the tank chamber 20 is opened, the fuel gauge 160 is exposed to face the opening portion 50 together with the operation switch 150, and thus the fuel supply pump 120, the operation switch 150, and the fuel gauge 160 can be visually recognized at the same time. As a result, the fuel gauge 160 can be easily checked while the operation switch 150 is operated, and thus good workability can be obtained in the refueling operation for the fuel tank 14.

In particular, according to the configuration in which the operation switch 150 and the fuel gauge 160 are disposed adjacent to each other on the side surface portion such as the rear side surface portion 110*a* of the step portion 110 of the fuel tank 14 as in the present embodiment, it is possible to easily check the fuel gauge 160 while operating the operation switch 150 and obtain good workability in the refueling operation for the fuel tank 14.

Further, the hose accommodating portion 145 that accommodates the suction hose 121 of the fuel supply pump 120 is provided on the front side of the fuel tank 14. According to such a configuration, the suction hose 121 can be accommodated in the tank chamber 20 while being connected to the fuel supply pump 120, and thus the suction hose 121 can be easily used by opening the hood 55. As a result, good workability can be obtained in the refueling operation for the fuel tank 14, without providing a housing section of the suction hose 121 outside the tank chamber 20, for example.

In the above-described embodiment, the fuel supply pump 120 is disposed inside the step portion 110 of the fuel tank 14, but the functional component disposed inside the step portion 110 is not limited to the fuel supply pump 120. In the step portion 110 of the fuel tank 14, for example, auxiliary equipment for work machine such as a multivalve can be disposed as a functional component.

FIGS. 21 to 24 illustrate a configuration in which a multivalve 200, which is an example of a functional component included in the excavation work machine 1, is disposed as an example of disposition of another functional component in the step portion 110 of the fuel tank 14. The multivalve 200 is provided on the front side of the fuel tank 14 inside the tank chamber 20 by being disposed inside the step portion 110.

Figure 5:
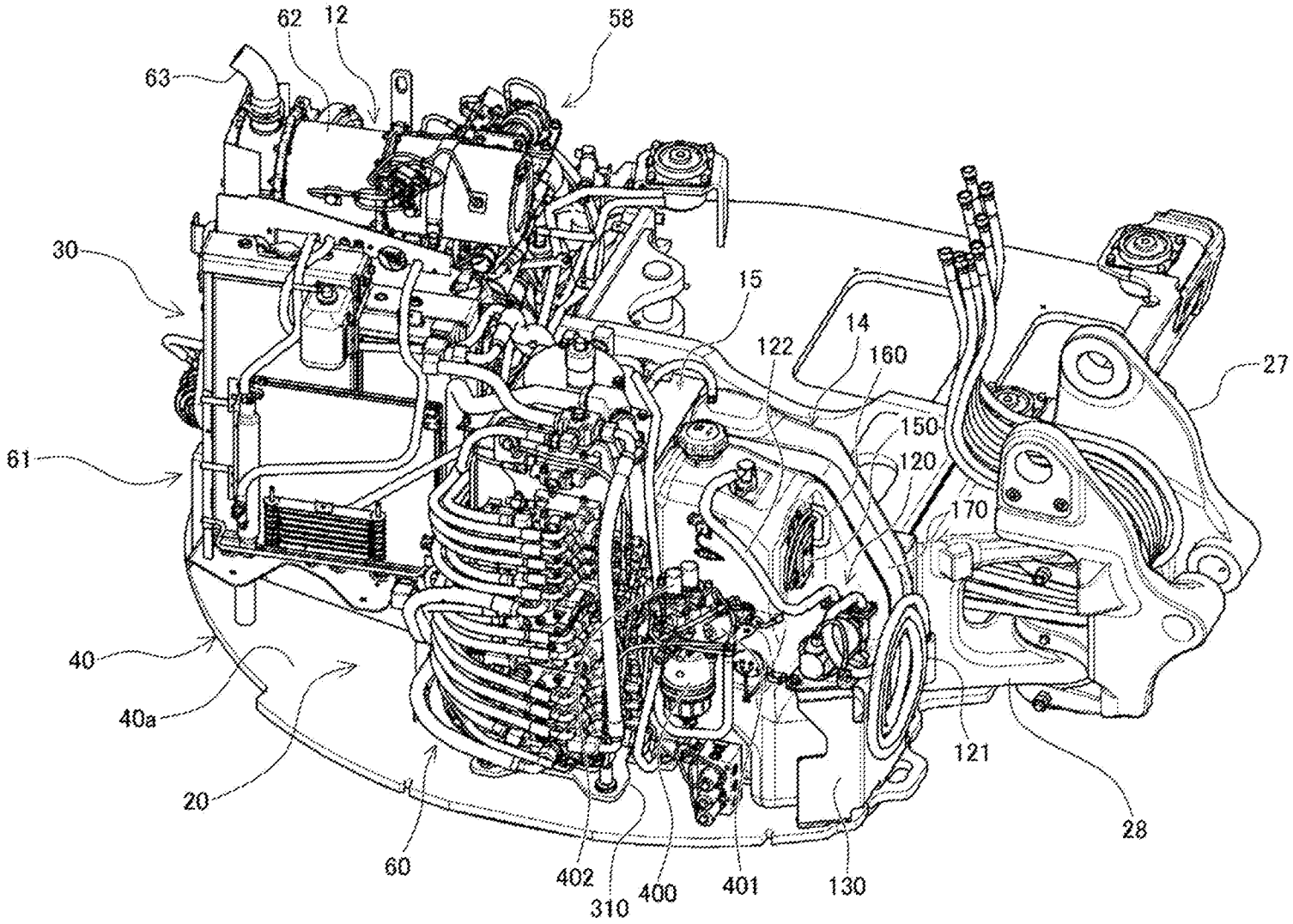
FIG. 5 is a right upper perspective view illustrating an arrangement configuration of units on a base plate of the excavation work machine according to one embodiment of the present invention.

The multivalve 200 is provided in a path (pilot circuit) of pressure oil from left and right pilot valves (not illustrated) to a switching valve (direction switching valve) of the control valve 60, and is a switching valve unit for changing a path of pilot pressure to the control valve 60 (see FIG. 5). The pilot valve is provided for each of the left side work operation lever 18 and the right side work operation lever 19 (see FIG. 3) of the driver's seat 17, and is operated by each lever. Each pilot valve is disposed in an operation box from which each lever of the left and right operation levers 18, 19 is protruded.

By operating the left and right operation levers 18, 19, the control valve 60 that controls the boom cylinder 24, the arm cylinder 25, the bucket cylinder 26, and the swivel motor (not illustrated) is operated by a pilot pressure. As a result, the operation of each part of the excavation unit 3 and the swivel operation of the swivel frame 7 are performed.

Moreover, the operation patterns of the left and right operation levers 18, 19 are switched by the operation of the multivalve 200. The multivalve 200 is configured to switch the operation patterns of the left and right operation levers 18, 19 to any one of a plurality of (for example, four) operation patterns. As described above, the multivalve 200 switches, as an operation pattern switching unit, the operation patterns of the left and right operation levers 18, 19 by switching the pattern of the hydraulic pressure input to the control valve 60 in response to the operation of the left and right operation levers 18, 19, which are operation units provided in the vicinity of the driver's seat 17.

The multivalve 200 has a valve main body portion 201 having a substantially cylindrical outer shape, and is installed in the step portion 110 of the fuel tank 14 in a direction in which the cylinder axial direction of the substantially cylindrical outer shape of the valve main body portion 201 is the up-down direction. A joint 202 communicating with each of a plurality of ports included in the valve main body portion 201 is provided around the valve main body portion 201, and a hydraulic hose 203 constituting the pilot circuit extends from each joint 202.

A handle 204 for performing the switching operation of the multivalve 200 is provided on the upper surface portion 201*a* of the valve main body portion 201. The handle 204 extends outward in the radial direction with the center portion of the circular shape, which is the shape of the upper surface portion 201*a* of the valve main body portion 201 in a plan view, as a rotation support portion, and is provided so as to be rotatable with the cylinder axial direction of the valve main body portion 201 as the rotation axis direction.

The operation patterns of the left side work operation lever 18 and the right side work operation lever 19 are switched by positioning the handle 204 at a switching operation position corresponding to each operation pattern by the rotational operation of the handle 204. By the rotational operation of the handle 204, the paths of the pressure oil (pilot pressure) from the left and right pilot valves to the switching valve of the control valve 60 are changed, and the operation patterns of the left and right operation levers 18, 19 are switched.

Specifically, for example, in a first operation pattern, with the left side work operation lever 18, the operation of the arm 22 is performed by the front and rear operation, and the left and right swiveling of the swivel frame 7 is performed by the left and right operation. With the right side work operation lever 19, the operation of the boom 21 is performed by the front and rear operation, and the operation of the bucket 23 is performed by the left and right operation. Further, for example, in a second operation pattern, with the left side work operation lever 18, the operation of the boom 21 is performed by the front and rear operation, and the operation of the bucket is performed by the left and right operation. With the right side work operation lever 19, the operation of the arm 22 is performed by the front and rear operation, and the left and right swiveling of the swivel frame 7 is performed by the left and right operation.

The handle 204 is provided with a lock knob 205 for locking the handle 204 at each switching operation position. In the lock knob 205, a knob main body portion serving as a grip portion is positioned on the handle 204, and a screw portion 205*a* vertically penetrating the handle 204 is provided on the lower side of the knob main body portion (see FIG. 22). The lock knob 205 locks the handle 204 to the valve main body portion 201 by screwing the screw portion 205*a* into a screw hole 201*b* (see FIG. 23) formed in the upper surface portion 201*a* of the valve main body portion 201 in a state where the handle 204 is located at each switching operation position. When the number of switchable operation patterns is four, four screw holes 201*b* are formed in the upper surface portion 201*a* in correspondence with the respective switching operation positions of the handle 204.

The multivalve 200 is provided so as to be positioned entirely or substantially entirely within the step portion 110 of the fuel tank 14. In other words, the multivalve 200 is entirely positioned within the range of the outer shape of the rear side surface portion 110*a* of the step portion 110 in a front view, substantially entirely positioned within the range of the outer shape of the left side surface portion 110*b* of the step portion 110 in a right side view, and entirely positioned within the range of the outer shape of the bottom surface portion 110*c* of the step portion 110 in a plan view.

Similar to the fuel supply pump 120, the multivalve 200 is supported by the support bracket 130. The multivalve 200 is fixed to and supported by the support bracket 130 via an attachment plate 210.

The attachment plate 210 is a substantially L-shaped bent plate-shaped member, and has a fixing surface portion 211 which is a horizontal plate-like portion and a support surface portion 212 which is a vertical plate-like portion, and these surface portions form an L-shape in a side view. The attachment plate 210 is fastened and fixed to the support bracket 130 at two front and rear positions by bolts 215 or the like penetrating the fixing surface portion 211 and the upper surface portion 133 in a state where the fixing surface portion 211 is superimposed on the upper surface portion 133 of the support bracket 130.

In the attachment plate 210, the support surface portion 212 is positioned on the rear side of the fixing surface portion 211, and the support surface portion 212 faces the front of the rear side surface portion 110*a* of the step portion 110 of the fuel tank 14. On the front side of the support surface portion 212, the multivalve 200 is provided in a state of being supported by the support surface portion 212. The multivalve 200 is supported by the support surface portion 212 in a state where the valve main body portion 201 is fixed to the support surface portion 212 at three positions by bolts 217. The bolt 217 penetrates the support surface portion 212 from the rear side, and is screwed into a screw hole which is opened to face the rear surface of the valve main body portion 201. The multivalve 200 is supported by the support surface portion 212 of the attachment plate 210 in a state where the valve main body portion 201 is floated from the fixing surface portion 211.

As described above, the multivalve 200 is disposed in the step portion 110 of the fuel tank 14, and is disposed at a position where the switching operation can be performed in a state where the hood 55 is opened. According to the configuration in which the multivalve 200 is disposed in the step portion 110 of the fuel tank 14, good maintainability and operability can be obtained for the multivalve 200. In other words, when the hood 55 of the tank chamber 20 is opened, the multivalve 200 faces the opening portion 50 and is exposed, and thus the multivalve 200 can be easily visually recognized, and the maintenance of the multivalve 200 and the switching operation of the operation patterns can be easily performed.

In particular, according to the configuration in which the multivalve 200 is disposed at a position on the front side of the fuel tank 14 by forming the step portion 110, the multivalve 200 can be installed by utilizing the installation space of the fuel tank 14 in the tank chamber 20 and the height of the fuel tank 14. As a result, the multivalve 200 can be disposed at a position with relatively good accessibility in the tank chamber 20, and good maintainability and operability can be obtained.

Further, according to the configuration in which the step portion 110 of the fuel tank 14 is opened on three sides of the upper side, the front side, and the lateral side (right side) as in the present embodiment, it is easy to secure the operation space for the handle 204 and the lock knob 205, and it is possible to obtain good operability in the switching operation of the multivalve 200. As for the removal of the support bracket 130 from the fuel tank 14, as in the case of the fuel supply pump 120, the support bracket 130 can be removed together with the multivalve 200 fixed on the support bracket 130.

[Configuration of Control Valve]

A configuration of the control valve 60 will be described with reference to FIGS. 25 to 32.

Figure 25:
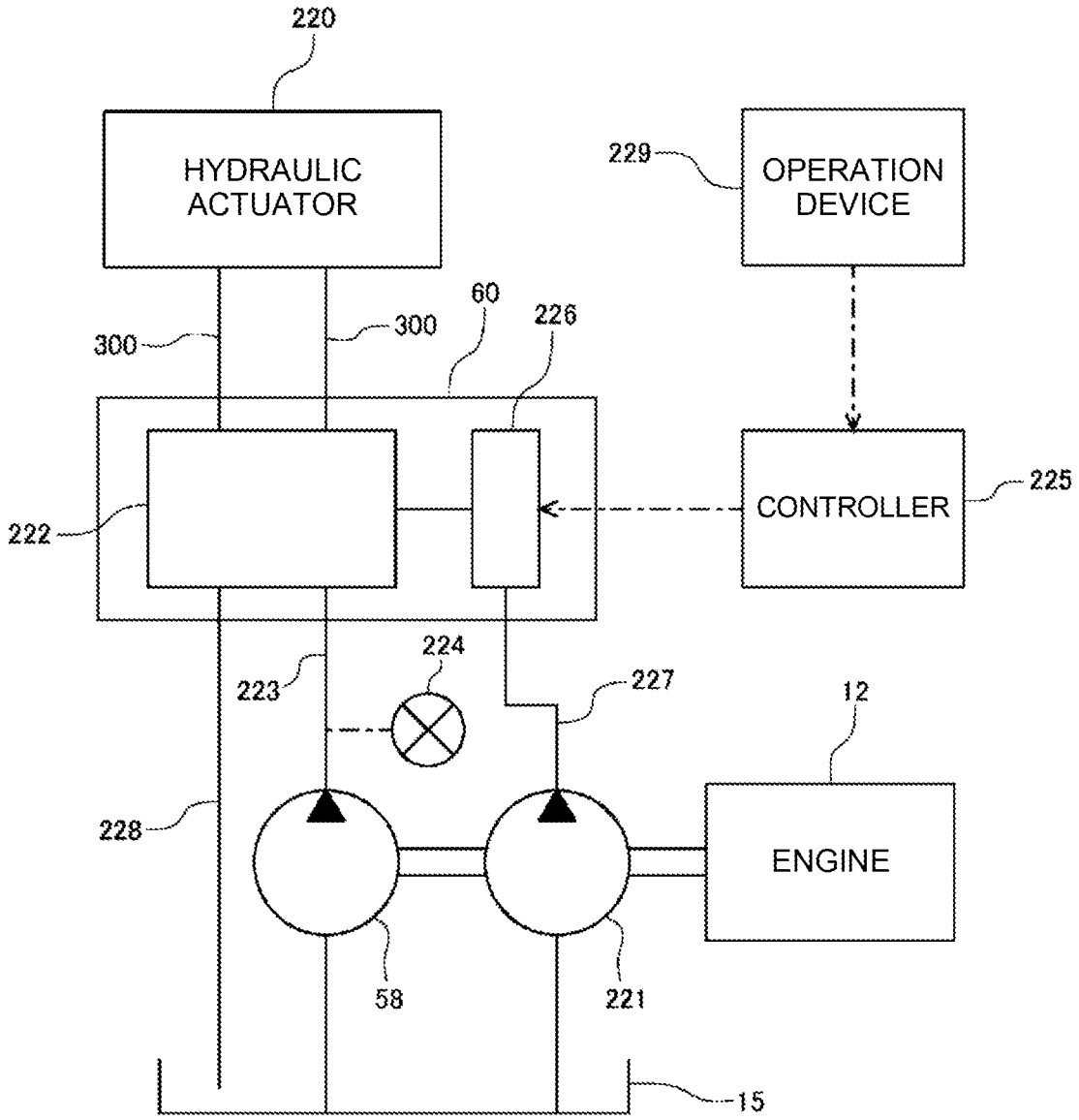
FIG. 25 is a block diagram illustrating a configuration of an electrically controlled hydraulic system according to one embodiment of the present invention.
Figure 26:
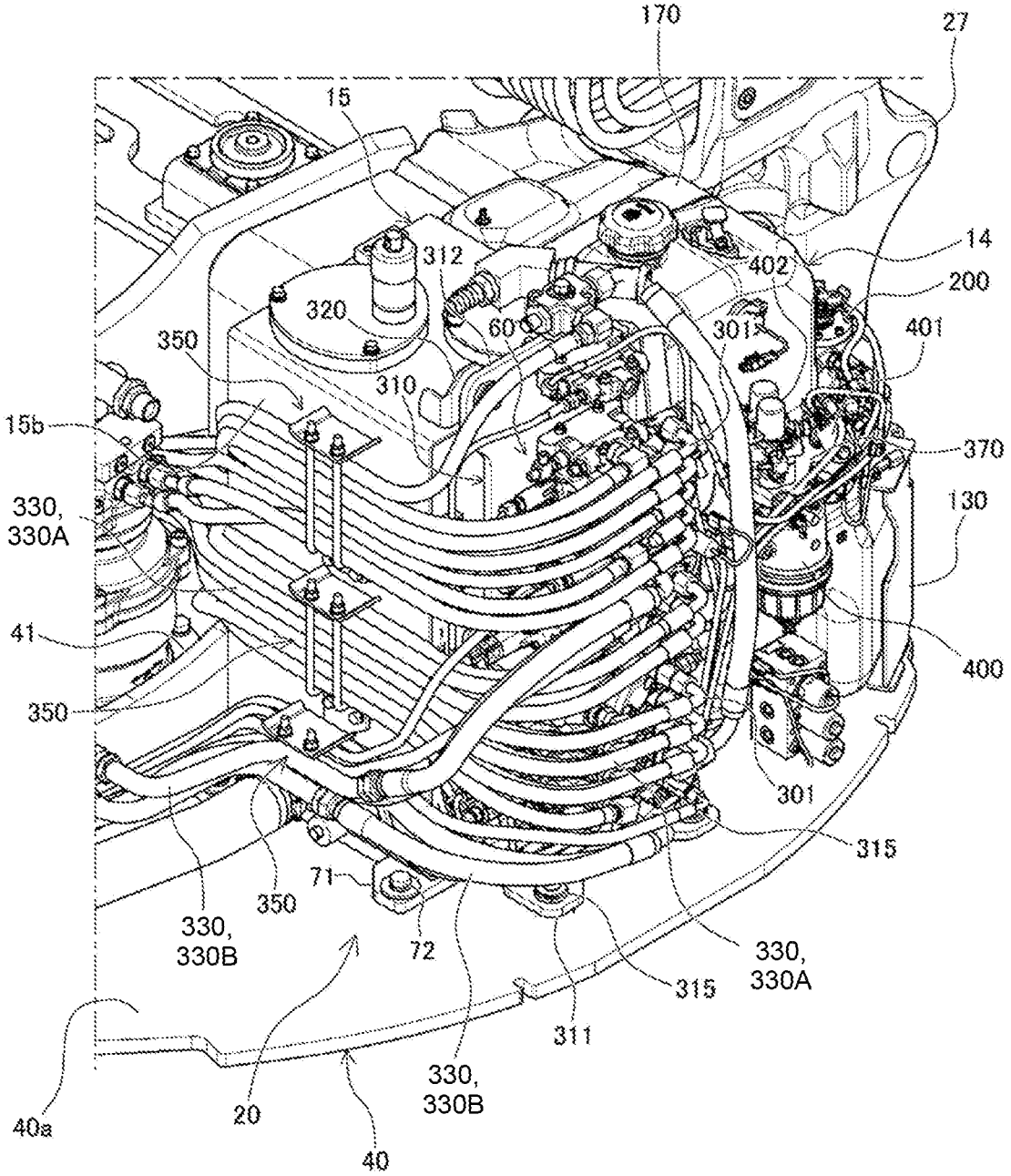
FIG. 26 is a right rear perspective view illustrating a configuration of a hydraulic oil tank, a control valve, and its vicinity according to one embodiment of the present invention.
Figure 27:
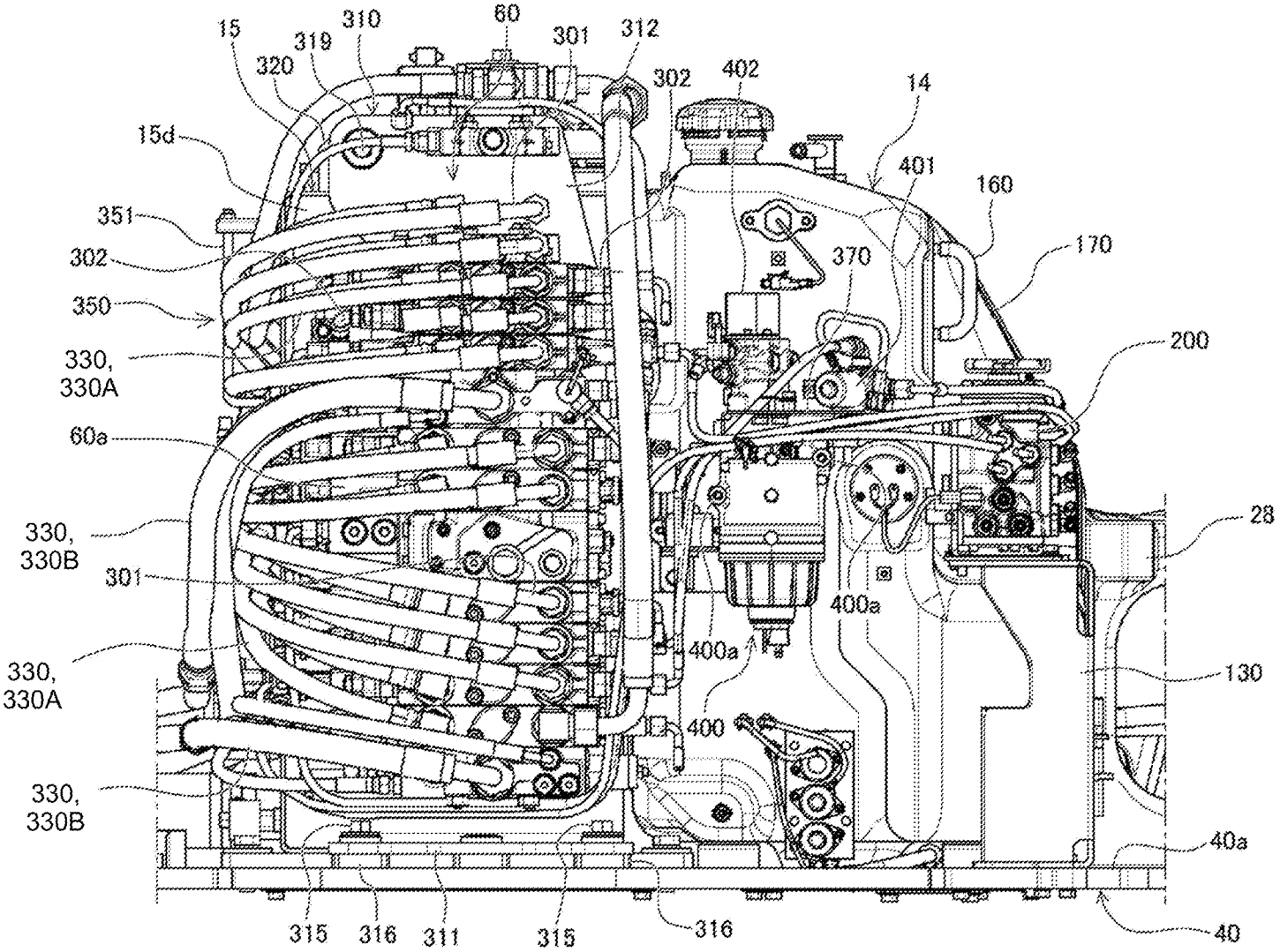
FIG. 27 is a right side view illustrating a configuration of the hydraulic oil tank, the control valve, and its vicinity according to one embodiment of the present invention.

First, a hydraulic system included in the excavation work machine 1 will be described with reference to FIG. 25. The excavation work machine 1 controls, by electric control, the operation of a plurality of hydraulic actuators. In FIG. 25, a hydraulic actuator 220 is any of various hydraulic actuators such as the boom cylinder 24, the arm cylinder 25, the bucket cylinder 26, the swing cylinder 29, the traveling hydraulic motor 11, and a swivel motor.

As illustrated in FIG. 25, a pilot pump 221 is coupled to the engine 12 in addition to the hydraulic pump 58. The pilot pump 221 is coupled to the engine 12 in the same manner as the hydraulic pump 58, and is driven along with the rotation of the drive shaft of the engine 12.

The hydraulic pump 58 is for supplying the hydraulic oil in the hydraulic oil tank 15 to the hydraulic actuator 220 via a direction switching valve 222 of the control valve 60. The hydraulic pump 58 is connected to the hydraulic oil tank 15 via a predetermined piping. The hydraulic pump 58 and the direction switching valve 222 are connected to each other by a supply piping 223. The supply piping 223 is provided with a pressure sensor 224 for detecting a discharge pressure of the hydraulic oil discharged from the hydraulic pump 58. A detection signal of the pressure sensor 224 is input to the controller 225 included in the excavation work machine 1 via a signal line (not illustrated).

The pilot pump 221 is for supplying a pilot pressure to the direction switching valve 222 via a solenoid proportional valve 226 of the control valve 60. The pilot pump 221 is connected to the hydraulic oil tank 15 via a predetermined piping. The pilot pump 221 and the solenoid proportional valve 226 are connected to each other by a pilot pressure supply piping 227.

The control valve 60 controls the flow rate and the flow direction of the hydraulic oil in the hydraulic system, and selectively supplies the hydraulic oil discharged from the hydraulic pump 58 to the plurality of hydraulic actuators 220.

The control valve 60 includes a plurality of direction switching valves 222 and solenoid proportional valves 226 corresponding to the plurality of hydraulic actuators 220, respectively.

The direction switching valve 222 is a pilot-operated direction control valve, and includes, for example, a 4-port, 3-position hydraulic pilot operated direction control valve. Each direction switching valve 222 is provided with a plurality of connection ports to which hydraulic piping including tubes or the like are connected. A supply piping 223 which is a discharge line of the hydraulic pump 58, a return piping 228 which is a return line to the hydraulic oil tank 15, and a supply/discharge piping 300 which is a supply line to the hydraulic actuator 220 or a discharge line from the hydraulic actuator 220 are connected to the respective connection ports of the direction switching valve 222. Further, the pilot pressure supply piping 227 that is a discharge line of the pilot pump 221 is connected to a connection port of the solenoid proportional valve 226.

The operation of the control valve 60 is controlled by the controller 225. The controller 225, also referred to as an electronic control unit (ECU), includes a computer device including a computing device and a memory, and a communication module, and the like. The controller 225 receives an electrical signal corresponding to an operation of an operation device 229 provided in the driving unit 10, and outputs a command signal based on the received signal to the solenoid proportional valve 226. Here, the controller 225 outputs a current corresponding to the operation amount of the operation device 229 to the solenoid proportional valve 226. The solenoid proportional valve 226 outputs a pilot pressure proportional to the input current to the input port of the direction switching valve 222 to slide a spool of the direction switching valve 222.

In this way, the pilot pressure applied from the solenoid proportional valve 226 to the direction switching valve 222 is adjusted, and the flow rate and flow direction of the hydraulic oil by the direction switching valve 222 are controlled. The operation device 229 is an operation unit corresponding to each hydraulic actuator 220 among various operation units such as a lever and a pedal provided in the driving unit 10.

By the hydraulic system having the above-described configuration, the supply of the hydraulic oil to the various hydraulic actuators 220 via the control valve 60 is controlled, and the operation of each part of the excavation work machine 1 is controlled.

Next, a fixing structure of the control valve 60 on the base plate 40 will be described. The control valve 60 schematically has a block-shaped outer shape with a predetermined direction as the longitudinal direction, and is installed on the right side of the hydraulic oil tank 15 in a direction with the longitudinal direction as the up-down direction. That is, the control valve 60 is provided in a state of being vertically placed at a position on the right side of the hydraulic oil tank 15 on the base plate 40. The upper end portion of the control valve 60 is positioned at a height slightly lower than the upper surface portion 15*e* of the tank main body section of the hydraulic oil tank 15.

On the periphery of the control valve 60, joint members 301, 302 respectively communicating with a plurality of connection ports included in the respective direction switching valves 222 are provided, and one end sides of various piping connected to the control valve 60 are connected to the respective joint members 301, 302.

A large number of joint members 301, 302 are provided in a predetermined arrangement over substantially the entire up-down direction on each of the front side, the right side, and the rear surface side of the control valve 60. Each of the joint members 301, 302 constitutes a connecting portion of various piping to the control valve 60. Depending on the arrangement portions of the joint members 301, 302, the joint member provided on the right side of the control valve 60 is referred to as the joint member 301, and the joint members provided on the front side and the rear side of the control valve 60 are referred to as the joint members 302.

The control valve 60 is supported in an upright state on the base plate 40 via a valve support base 310. That is, the control valve 60 is fixed to and supported by the base plate 40 via the valve support base 310.

The valve support base 310 is a substantially L-shaped bent plate-shaped member, and has a fixing surface portion 311 which is a horizontal plate-like portion and a support surface portion 312 which is a vertical plate-like portion, and these surface portions form an L-shape in a rear view. The valve support base 310 is fastened and fixed to the base plate 40 at two front and rear positions by bolts 315 or the like which are fixing members in a state where the fixing surface portion 311 is positioned above the base plate 40.

The bolt 315 penetrates the fixing surface portion 311 from the upper side and is screwed into a screw hole formed in the base plate 40. In the fixing section by the bolt 315, a vibration isolation rubber 316 is interposed between the base plate 40 and the fixing surface portion 311.

The vibration isolation rubber 316 has a substantially cylindrical outer shape, and has, in the center portion, a hole portion through which the bolt 315 penetrates. The vibration isolation rubber 316 has an outer peripheral groove portion which is a reduced diameter portion in the upper portion, and the upper end portion protrudes to the upper side of the fixing surface portion 311 in a state where the edge end portion of a hole portion formed in the fixing surface portion 311 is fitted to the outer peripheral groove portion. A washer is interposed between the head of the bolt 315 and the upper end portion of the vibration isolation rubber 316.

Further, the valve support base 310 fixedly supports the support surface portion 312 against the hydraulic oil tank 15. Specifically, in the valve support base 310, the upper end portion of the support surface portion 312 is fastened and fixed to the hydraulic oil tank 15 via a support bracket 320 by a bolt 319 or the like.

Figure 29:
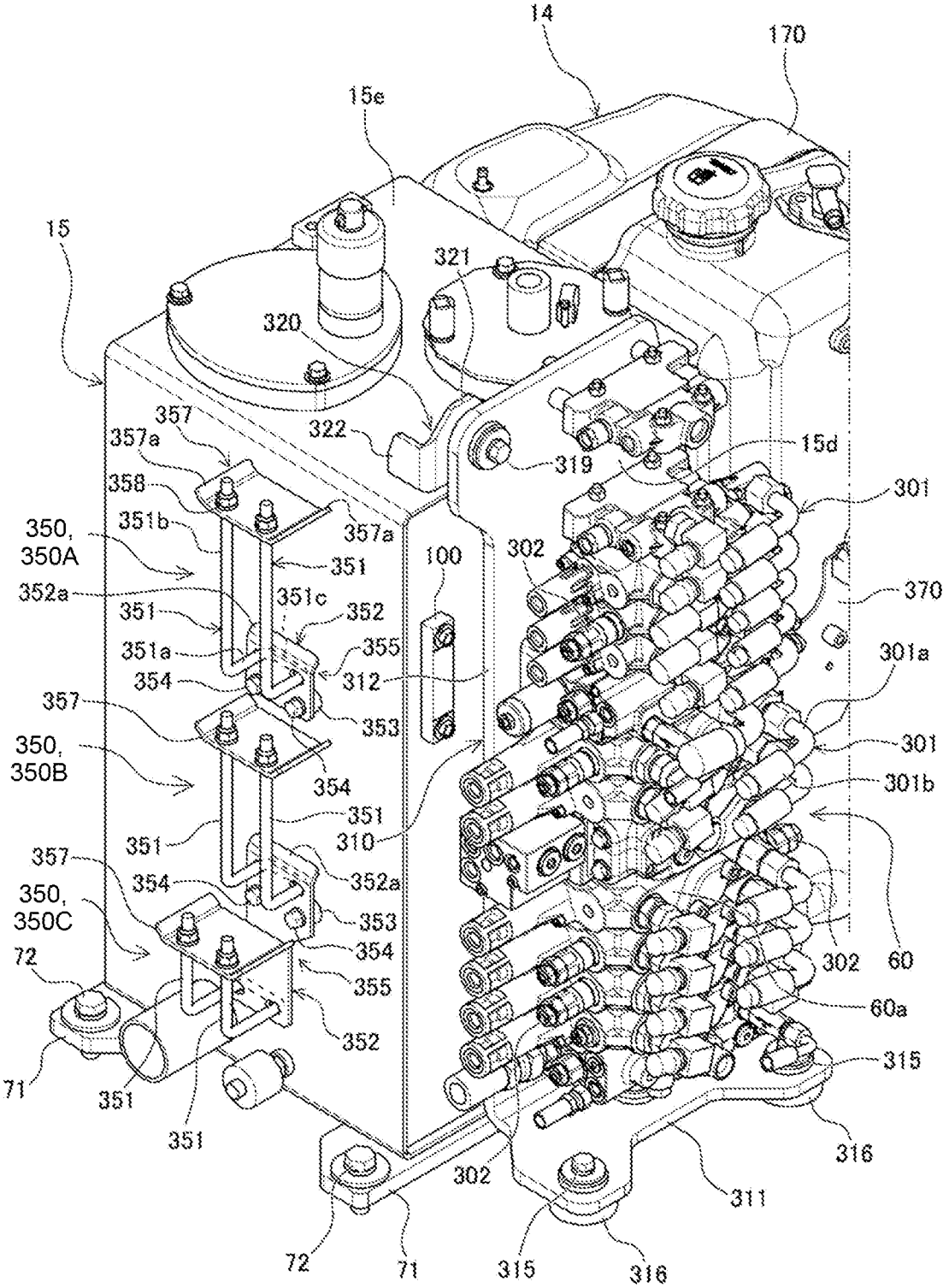
FIG. 29 is a right rear perspective view illustrating a configuration of the hydraulic oil tank and the control valve according to one embodiment of the present invention.
Figure 30:
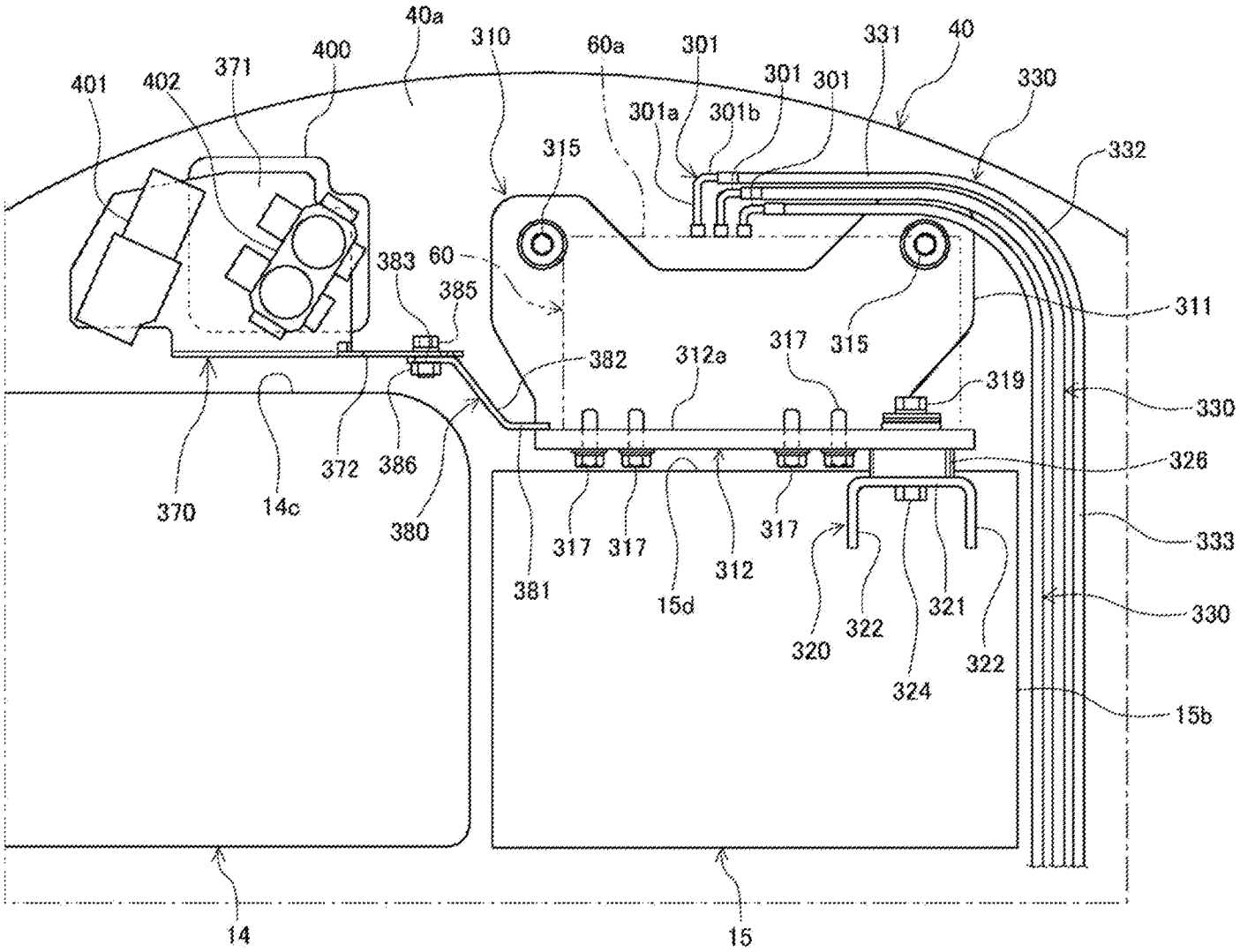
FIG. 30 is a plan view schematically illustrating a configuration of the hydraulic oil tank, the control valve, and its vicinity according to one embodiment of the present invention.

As illustrated in FIGS. 29 and 30, the support bracket 320 is a bent plate-shaped member forming a substantially U-shape with the left side as the open side in a plan view, and has a fixing surface portion 321 and support surface portions 322 formed on both front and rear sides of the fixing surface portion 321 so as to form a right angle as surface portions forming the substantially U-shape. The support bracket 320 is fixed to the upper surface portion 15*e* by welding or the like in the vicinity of a corner portion on the right rear side of the upper surface portion 15*e*.

In the valve support base 310, the upper edge portion of the support surface portion 312 is extended upward from the upper surface portion 15*e* of the hydraulic oil tank 15, and the bolt 319 is penetrated through the rear end portion of the upper edge portion of the support surface portion 312. The bolt 319 penetrates the support surface portion 312 and the fixing surface portion 321 of the support bracket 320, and is screwed into a nut 324 provided on the left side of the fixing surface portion 321. In the fixing section by the bolt 319, a vibration isolation rubber 326 is interposed between the support bracket 320 and the support surface portion 312 (see FIG. 30).

The vibration isolation rubber 326 has a substantially cylindrical outer shape, and has, in the center portion, a hole portion through which the screw portion of the bolt 319 penetrates. The vibration isolation rubber 326 has an outer peripheral groove portion which is a reduced diameter portion in the right side portion, and the right end portion protrudes to the right side of the support surface portion 312 in a state where the edge end portion of a hole portion formed in the support surface portion 312 is fitted to the outer peripheral groove portion. A washer is interposed between the head of the bolt 319 and the right end portion of the vibration isolation rubber 326.

The valve support base 310 positions the support surface portion 312 on the right side of the right side surface portion 15*d* of the hydraulic oil tank 15 with a predetermined gap, and covers most of the right side surface portion 15*d* from the right. On the right side of the support surface portion 312, the control valve 60 is provided in a state of being supported by the support surface portion 312. The control valve 60 is fixed to the support surface portion 312 by bolts 317 at a plurality of positions (see FIG. 30). The bolt 317 penetrates the support surface portion 312 from the left side, and is screwed into a screw hole which is opened to face the left side surface of the control valve 60. The control valve 60 is supported by the support surface portion 312 in a state where the control valve 60 is slightly floated from the fixing surface portion 311 with respect to the valve support base 310.

As described above, the control valve 60 is supported by the valve support base 310, and the valve support base 310 is supported in a vibration isolating manner by three fixing sections in total, that is, two fixing sections with respect to the base plate 40 and one fixing section with respect to the hydraulic oil tank 15.

According to the arrangement configuration of the control valve 60 as described above, in the configuration including the driver's seat 17 provided on a lateral side of the tank chamber 20, the control valve 60 is disposed on the side opposite to the driver's seat 17 side with respect to the hydraulic oil tank 15. In other words, on the base plate 40, the driver's seat 17 is disposed at a position on the left side of the center portion in the left-right direction, the hydraulic oil tank 15 is disposed at a position on the right side of the center portion in the left-right direction, and the control valve 60 is disposed on the right side of the hydraulic oil tank 15 (see FIG. 3). Therefore, the control valve 60 is disposed on the right side opposite to the driver's seat 17 side (left side) in the left-right direction with respect to the hydraulic oil tank 15 in relation to the driver's seat 17.

Next, a layout configuration of piping extending from the control valve 60 will be described. As described above, one end sides of the supply piping 223, the pilot pressure supply piping 227, and the supply/discharge piping 300 are connected to the control valve 60, and these piping are included in the piping extending from the control valve 60.

The piping extending from the control valve 60 includes a hydraulic hose 330 whose one end side is communicatively connected to each connection port via the joint members 301, 302. That is, a plurality of hydraulic hoses 330 constituting any of the supply piping 223, the pilot pressure supply piping 227, and the supply/discharge piping 300 extend from the control valve 60.

As described above, the excavation work machine 1 includes, as the plurality of hydraulic hoses 330, a plurality of hydraulic hoses 330A extending from the control valve 60 and communicatively connected to the respective hydraulic actuators 220, and a plurality of hydraulic hoses 330B extending from the control valve 60 and communicatively connected to the hydraulic pump 58 or the pilot pump 221. Moreover, the plurality of hydraulic hoses 330 are arranged along a side surface portion of the hydraulic oil tank 15.

In the present embodiment, the plurality of hydraulic hoses 330 are arranged along the rear surface portion 15*b* that is a side surface portion on the rear side of the hydraulic oil tank 15. Hereinafter, the rear surface portion 15*b* of the hydraulic oil tank 15 is referred to as a "tank rear surface portion 15*b*".

Further, each of the plurality of hydraulic hoses 330 has one end side connected to a right side surface portion 60*a*, which is a left and right outer side surface portion of the control valve 60, via the joint member 301 that is a connection member. In the control valve 60, the joint member 301 is communicatively connected to a connection port of each direction switching valve 222 facing the right side surface portion 60*a*. That is, the joint member 301 constitutes a connecting portion of the hydraulic hose 330 to the control valve 60 on the right side surface portion 60*a* of the control valve 60.

The joint member 301 is configured in such a manner that the hydraulic hose 330 extends rearward from the right side surface portion 60*a* of the control valve 60. The joint member 301 is configured as an elbow-shaped piping member having an L-shape that protrudes rightward from the right side surface portion 60*a* of the control valve 60 and is bent rearward.

Therefore, the joint member 301 has a first pipe portion 301*a* that protrudes rightward from the right side surface portion 60*a* of the control valve 60 with the left-right direction as the pipe axis direction, a second pipe portion 301*b* bent rearward so as to form a right angle with respect to the first pipe portion 301*a* with the front-rear direction as the pipe axial direction, and a curved square pipe portion that is a portion between these pipe portions and forms a corner of the joint member 301 (see FIGS. 29 and 30). The joint member 301 is attached to the control valve 60 so as to form an L-shape in a plan view with the second pipe portion

301*b* facing rearward. One end portion of the hydraulic hose 330 is connected to the rear side of the second pipe portion 301*b* of the joint member 301.

All or substantially all of the joint members 301 among the plurality of joint members 301 disposed on the right side surface portion 60*a* of the control valve 60 have an L-shaped form in such a manner that the hydraulic hose 330 extends rearward. Moreover, the group of hydraulic hoses 330 extending rearward from the right side surface portion 60*a* of the control valve 60 is routed from the right side to the rear side of the hydraulic oil tank 15, arranged along the tank rear surface portion 15*b*, and branched into a plurality of hoses from the vicinity of the rear-left corner of the hydraulic oil tank 15 in accordance with the connection destination of the other end side of the hydraulic hose 330.

As described above, the group of hydraulic hoses 330 extending from the right side surface portion 60*a* of the control valve 60 has the following path portion as a routing path portion around the hydraulic oil tank 15 and the control valve 60. In other words, as illustrated in FIG. 30, the group of hydraulic hoses 330 has a right side path portion 331 extending rearward on the right side of the control valve 60, a curved path portion 332 curved leftward from the rear side of the right side path portion 331, and a rear side path portion 333 extending leftward from the left side of the curved path portion 332 and arranged along the tank rear surface portion 15*b*. The group of hydraulic hoses 330 is routed adjacent to the tank rear surface portion 15*b* in the rear side path portion 333.

Figure 28:
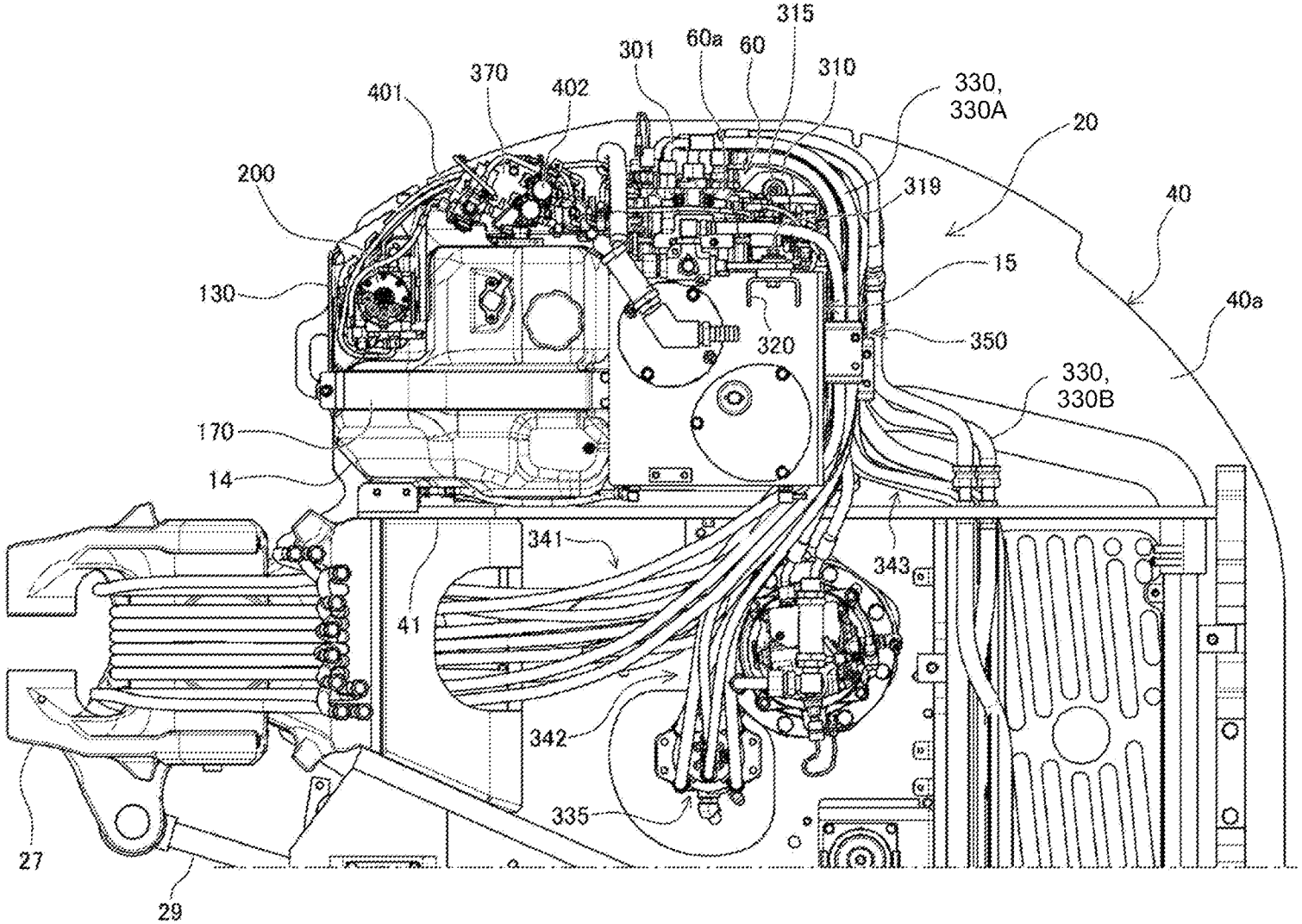
FIG. 28 is a plan view illustrating a configuration of the hydraulic oil tank, the control valve, and its vicinity according to one embodiment of the present invention.

As illustrated in FIG. 28, the group of hydraulic hoses 330 having such path portions is arranged so as to branch mainly into a first hydraulic hose group 341, a second hydraulic hose group 342, and a third hydraulic hose group 343 from the terminal end portion (left end portion) of the rear side path portion 333 positioned in the vicinity of the rear-left corner of the hydraulic oil tank 15 in accordance with the connection destination of the other end side of each hydraulic hose 330.

The first hydraulic hose group 341 is connected to each hydraulic cylinder such as the boom cylinder 24 constituting the excavation unit 3. Each hydraulic hose 330 of the first hydraulic hose group 341 corresponds to the supply/discharge piping 300 illustrated in FIG. 25. The first hydraulic hose group 341 extends from the vicinity of the corner portion on the left rear side of the hydraulic oil tank 15 toward the front side where the excavation unit 3 is positioned through the left side of the vertical plate 41.

The second hydraulic hose group 342 is connected to a substantially cylindrical swivel joint 335 provided in the center portion of the swivel frame 7. Each hydraulic hose 330 of the second hydraulic hose group 342 is communicatively connected to a connection port, which is provided in a predetermined portion of the swivel joint 335, via a joint member. The second hydraulic hose group 342 branches from the vicinity of the corner portion on the left rear side of the hydraulic oil tank 15 to the left rear side with respect to the first hydraulic hose group 341, and extends toward the swivel joint 335 positioned on the left side of the hydraulic oil tank 15.

The third hydraulic hose group 343 is connected to the hydraulic pump 58 or the pilot pump 221 provided in the left rear portion on the base plate 40. Each hydraulic hose 330 of the third hydraulic hose group 343 corresponds to the supply piping 223 or the pilot pressure supply piping 227 illustrated FIG. 25. The third hydraulic hose group 343 branches from the left rear side of the hydraulic oil tank 15 to the rear side with respect to the first hydraulic hose group 341 and the second hydraulic hose group 342 and extends leftward, and extends leftward where the hydraulic pump 58 and the pilot pump 221 are positioned in the rear portion on the base plate 40.

In the rear surface portion 15*b* along which the group of the hydraulic hoses 330 is arranged, a hose clamp 350 as a holding section that holds the middle part of the hydraulic hose 330 against the tank rear surface portion 15*b* is provided. The hose clamp 350 holds the hydraulic hose 330 along with the tank rear surface portion 15*b* at a predetermined location with respect to the hydraulic hose 330 arranged in the left-right direction on the rear side of the hydraulic oil tank 15, and guides the routing position of the hydraulic hose 330 on the rear side of the hydraulic oil tank 15.

The hose clamps 350 are provided at a plurality of positions in the vertical direction. Specifically, as illustrated in FIG. 29, on the tank rear surface portion 15*b*, the hose clamps 350 are provided at three positions so as to be arranged along the up-down direction. In other words, an upper hose clamp 350A, a middle hose clamp 350B, and a lower hose clamp 350C are provided as the hose clamp 350. These three hose clamps 350 have substantially the same configuration.

The hose clamp 350 has a configuration in which a pair of left and right holding rod portions 351 that hold the hydraulic hose 330 between the hose clamp 350 and the tank rear surface portion 15*b* is supported by the tank rear surface portion 15*b*. The holding rod portion 351 is provided in a state of being supported by a support plate 352 fixed to the tank rear surface portion 15*b*. The middle hose clamp 350B and the lower hose clamp 350C share the support plate 352.

Figure 31:
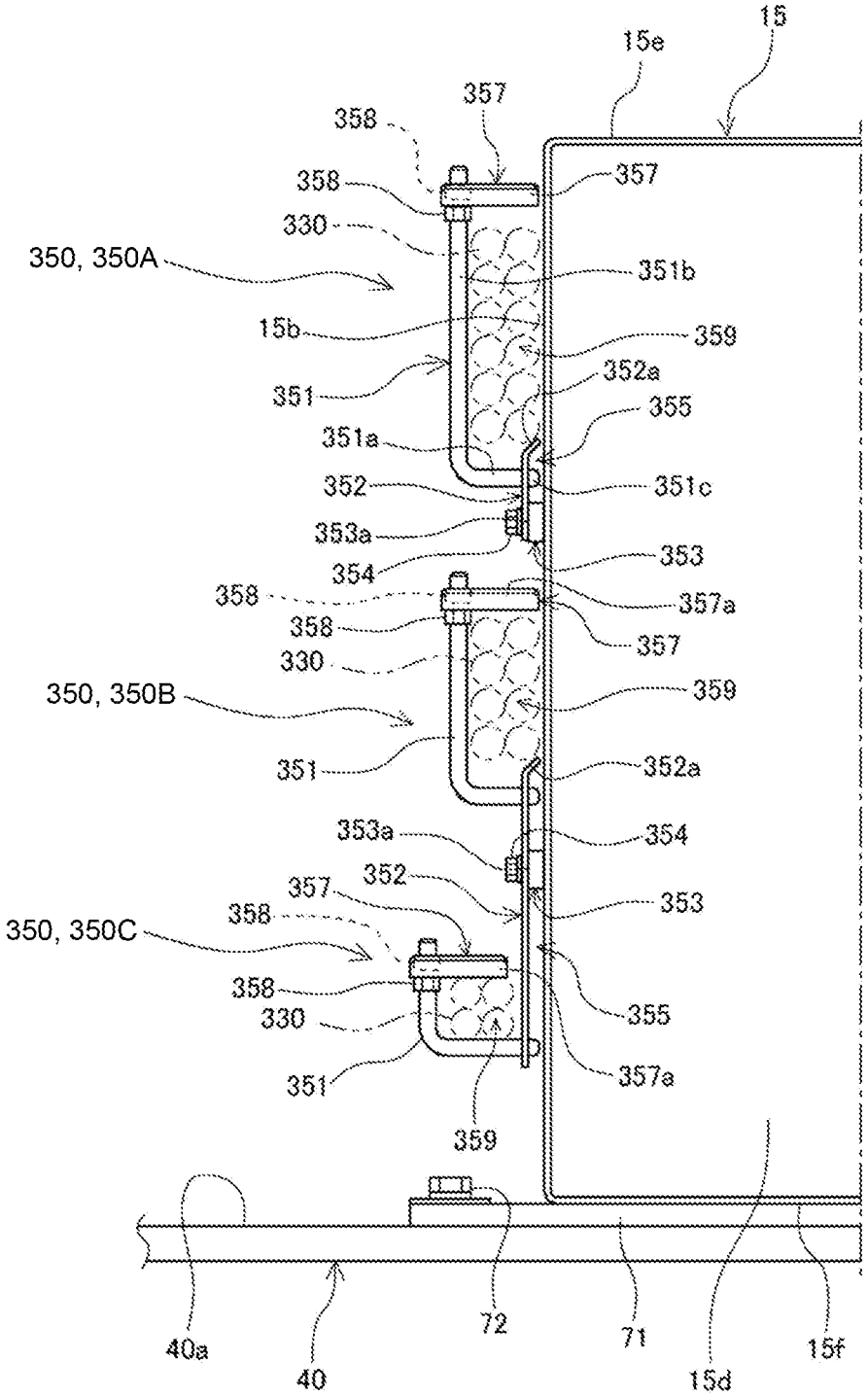
FIG. 31 is a right side view illustrating a configuration of a hose clamp according to one embodiment of the present invention.

As illustrated in FIGS. 29 and 31, the support plate 352 is a rectangular plate-shaped member whose plate thickness direction is the front-rear direction, and is fixed to an attachment seat portion 353 fixed to the tank rear surface portion 15*b* by bolts 354. The attachment seat portion 353 is a portion that protrudes by a predetermined thickness with respect to the tank rear surface portion 15*b*, and forms an attachment surface 353*a* that is a vertical surface. The attachment seat portion 353 has a longitudinal shape with the left-right direction as the longitudinal direction, and has screw holes into which the bolts 354 are screwed on both left and right sides.

The support plate 352 is fastened and fixed to the attachment seat portion 353 by the bolt 354 which penetrates the support plate 352 and is screwed into a screw hole of the attachment seat portion 353 in a state of being in contact with the attachment surface 353*a* of the attachment seat portion 353. A gap 355 is formed between the tank rear surface portion 15*b* and the support plate 352 by an amount corresponding to the thickness of the attachment seat portion 353 (the amount of protrusion from the rear surface portion 15*b*).

Each of the left and right holding rod portions 351 has a lower rod portion 351*a* that protrudes rearward from the support plate 352 and a vertical rod portion 351*b* that is bent upward from the rear side of the lower rod portion 351*a* so as to form a right angle and extends in the up-down direction, and these rod portions form a substantially L-shape in a side view (see FIG. 31). The left and right holding rod portions 351 are formed by bending or curving a single rod-shaped member into a predetermined shape. That is, the left and right holding rod portions 351 penetrate the support plate 352 from the rear side of the support plate 352, and are connected to each other via a curved portion 351*c* positioned in the gap 355 on the front side of the support plate 352. The left and right holding rod portions 351 may be provided by fixing separate rod members to the support plate 352.

A roof plate 357 is provided at upper end portions of the left and right holding rod portions 351. The roof plate 357 is a rectangular plate-shaped member whose plate thickness direction is the up-down direction, and is fixed to the holding rod portions 351 by nuts 358 screwed onto the holding rod portions 351, welding, or the like in a state where the upper end portions of the left and right holding rod portions 351 are penetrated through the roof plate 357. The roof plate 357 is provided so as to have a small gap with respect to the rear surface portion 15*b* and to have a portion positioned above the lower rod portion 351*a* of the holding rod portion 351. The roof plate 357 is provided so as to cover the entire arrangement range of the left and right holding rod portions 351 in a plan view.

In the hose clamp 350 having the above-described configuration, a hose holding space 359 having a substantially rectangular shape in a side view is formed as a space portion that holds the hydraulic hose 330 between the hose clamp 350 and the tank rear surface portion 15*b*, by the support plate 352, the left and right holding rod portions 351, and the roof plate 357 (see FIG. 31). The hydraulic hose 330 penetrates the hose holding space 359 in the left-right direction, and thus a portion of the hydraulic hose 330 positioned on the rear side of the hydraulic oil tank 15 is held by the hose clamp 350. The hose clamp 350 is configured to prevent the hydraulic hose 330 from being detached from the hose clamp 350 due to vibration or the like of the machine body, by forming the hose holding space 359 as a space surrounded on four sides in a side view.

The support plate 352 has an inclined surface portion 352*a* whose upper edge portion is bent forward in an inclined shape. The inclined surface portion 352*a* is positioned on the front side of the lower end portion of the hose holding space 359, and functions as a guide portion for the hydraulic hose 330 supported on the lower rod portion 351*a* by gradually increasing the front-rear interval between the inclined surface portion 352*a* and the vertical rod portion 351*b* from the lower side to the upper side. In the support plate 352 shared by the middle hose clamp 350B and the lower hose clamp 350C, the inclined surface portion 352*a* is provided only for the middle hose clamp 350B. Further, the roof plate 357 has an inclined surface portion 357*a* whose both left and right edge portions are bent upward in an inclined shape. The inclined surface portions 357*a* are positioned at upper edge portions on both left and right sides of the hose holding space 359, and function as guide portions for the hydraulic hose 330 arranged in the hose holding space 359.

Regarding the arrangement of the hose clamps 350 in the three upper and lower stages on the tank rear surface portion 15*b*, the upper stage hose clamp 350A and the middle stage hose clamp 350B are provided at positions closer to the right side from the center in the left-right direction, and the lower stage hose clamp 350C is provided in the center portion in the left-right direction. Further, the length of the vertical rod portion 351*b* of the holding rod portion 351 of the lower hose clamp 350C is shorter than that of the upper hose clamp 350A and the middle hose clamp 350B. Therefore, the vertical dimension of the hose holding space 359 in the lower hose clamp 350C is smaller than those of the other two hose clamps 350.

In the present embodiment, the hydraulic hoses 330 held by the upper hose clamp 350A and the middle hose clamp 350B include some of the hydraulic hoses 330 of the first hydraulic hose group 341 and the second hydraulic hose group 342. Further, the hydraulic hoses 330 held by the lower hose clamp 350C include the hydraulic hoses 330 constituting the supply piping 223 and the pilot pressure supply piping 227. However, the type (connection destination) of the hydraulic hose 330 held by each hose clamp 350 is not particularly limited.

Furthermore, in the configuration in which the fuel tank 14 is disposed in front of the hydraulic oil tank 15, a hydraulic equipment support stay 370 serving as an equipment attachment section for attaching hydraulic equipment included in the excavation work machine 1 is provided on the right side on the left and right outside of the fuel tank 14. The hydraulic equipment attached to the hydraulic equipment support stay 370 is provided for a path of the hydraulic oil stored in the hydraulic oil tank 15 or a path of the fuel stored in the fuel tank 14.

Figure 32:
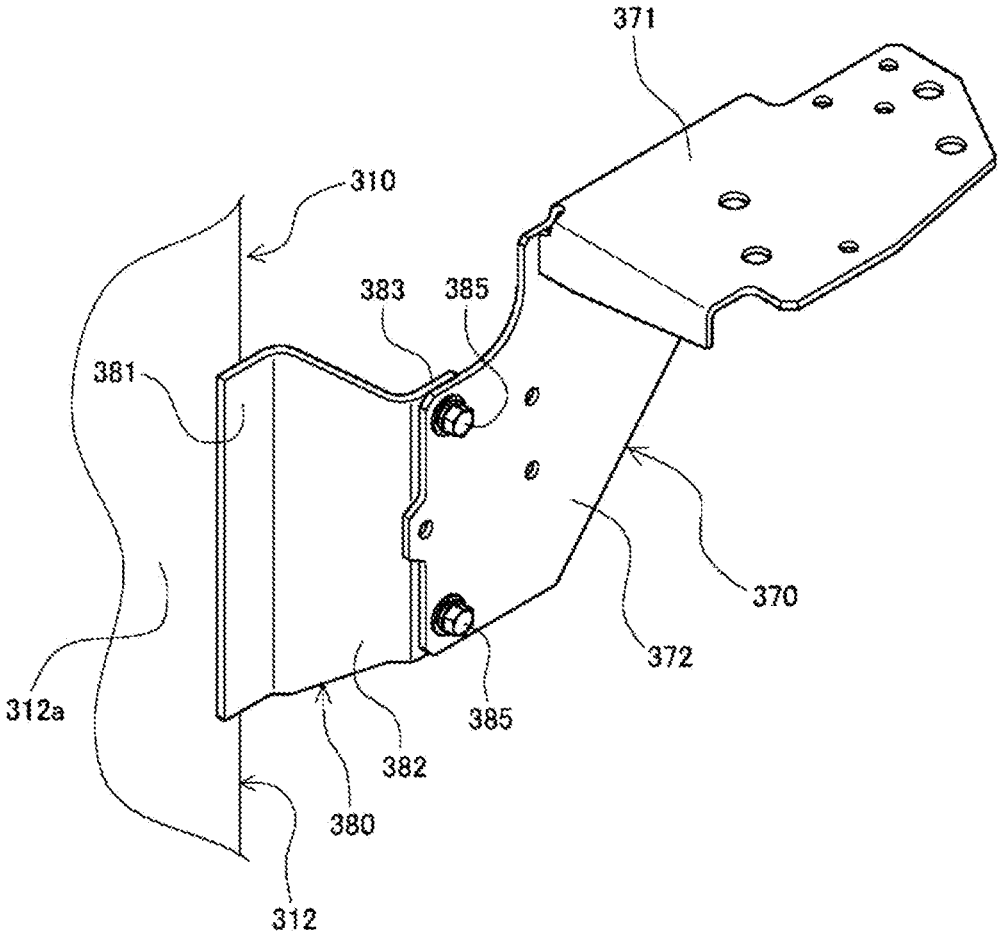
FIG. 32 is a right rear perspective view illustrating a configuration of a hydraulic equipment support stay according to one embodiment of the present invention.

As illustrated in FIGS. 30 and 32, the hydraulic equipment support stay 370 is a bent plate-shaped member, and has a lateral surface portion 371 as a first support surface portion and a vertical surface portion 372 as a second support surface portion, and these surface portions form a substantially L-shape in a front view. The lateral surface portion 371 is a horizontal plate-like portion, and is provided as a bent portion with respect to the front portion of the vertical surface portion 372. The vertical surface portion 372 is a vertical plate-like portion and extends to the rear side of the lateral surface portion 371 in the front-rear direction.

The hydraulic equipment support stay 370 is provided in such a manner that the vertical surface portion 372 is arranged along the right side surface portion 14*c* of the fuel tank 14 and the lateral surface portion 371 protrudes rightward from the right side surface portion 14*c*. The hydraulic equipment support stay 370 is provided at an intermediate portion in the up-down direction with respect to the fuel tank 14. The hydraulic equipment support stay 370 is provided in a state of being fixedly supported via an attachment plate 380 with respect to the support surface portion 312 of the valve support base 310 that supports the control valve 60.

As illustrated in FIGS. 30 and 32, the attachment plate 380 is a bent plate-shaped member having a predetermined bent shape, and has a fixing surface portion 381 whose plate thickness direction is the left-right direction, an arm surface portion 382 bent from the front side of the fixing surface portion 381 toward the right front to form an obtuse angle, and a support surface portion 383 bent from the right side of the arm surface portion 382 toward the front to form an obtuse angle. The attachment plate 380 has a substantially crank shape in a top view by these surface portions.

The attachment plate 380 is fixed to the valve support base 310 by fixing the fixing surface portion 381 to a right surface 312*a* of the front edge portion of the support surface portion 312 of the valve support base 310 by welding or the like. The hydraulic equipment support stay 370 is fixed to the support surface portion 383 of the attachment plate 380.

The hydraulic equipment support stay 370 is fastened and fixed to the attachment plate 380 at two upper and lower positions by bolts 385 and nuts 386 in a state where the rear edge portion of the vertical surface portion 372 is overlapped with the support surface portion 383 of the attachment plate 380 from the right side. The bolt 385 penetrates the vertical surface portion 372 and the support surface portion 383 from the right side, and is screwed into the nut 386 on the left side of the support surface portion 383.

In the hydraulic equipment support stay 370 supported on the valve support base 310 via the attachment plate 380 as described above, an oil-water separator 400 and two solenoid proportional valves 401 and 402 are attached, as hydraulic equipment.

The oil-water separator 400 is a unit for separating water from the fuel in the fuel tank 14. The oil-water separator 400 is provided in a fuel supply path from the fuel tank 14 to the engine 12. The fuel in the fuel tank 14 is supplied to the engine 12 after being subjected to the action of removing water by the oil-water separator 400.

The oil-water separator 400 has a substantially cylindrical outer shape, and is fixed to and supported by the vertical surface portion 372 of the hydraulic equipment support stay 370 in a direction in which the cylinder axial direction thereof is the up-down direction. The oil-water separator 400 is disposed at a position on the right side of the vertical surface portion 372 and below the lateral surface portion 371, and is provided in a state of being fixed to the vertical surface portion 372 at a plurality of positions by fixing tools such as bolts. In the oil-water separator 400, a boss portion 400*a* through which the fixing tool penetrates is provided at a plurality of positions (see FIG. 27).

Each of the solenoid proportional valves 401, 402 corresponds to the above-described solenoid proportional valve 226 (see FIG. 25), and is provided corresponding to any one of the plurality of hydraulic actuators 220.

The solenoid proportional valves 401, 402 are fixed to and supported by the lateral surface portion 371 of the hydraulic equipment support stay 370. The solenoid proportional valves 401, 402 are placed on the upper side of the lateral surface portion 371 and fixed to the lateral surface portion 371 at a plurality of positions by fixing tools such as bolts. One solenoid proportional valve 401 is disposed on the front portion of the lateral surface portion 371, and the other solenoid proportional valve 402 is disposed on the rear portion of the lateral surface portion 371.

According to the piping configuration of the hydraulic hoses 330 of the control valve 60 in the excavation work machine 1 according to the present embodiment as described above, good maintainability can be obtained for the plurality of hydraulic hoses 330 extending from the control valve 60.

The group of hydraulic hoses 330 extending from the control valve 60 is arranged along the tank rear surface portion 15*b* which is one of the side surface portions of the hydraulic oil tank 15. According to such a configuration, the group of hydraulic hoses 330 can be concentrated around the hydraulic oil tank 15, and thus maintenance such as replacement of the hydraulic hoses 330 can be easily performed. At the time of maintenance of the control valve 60 and the group of hydraulic hoses 330, an exterior cover forming the tank chamber 20 is opened or removed, and the control valve 60 and the group of hydraulic hoses 330 are thereby released from the exterior cover.

Regarding the piping configuration of the group of hydraulic hoses 330, the side surface portion of the hydraulic oil tank 15 may be any one of the vertical surface portions of the tank main body section of the hydraulic oil tank 15. In the configuration in which the fuel tank 14 is disposed immediately in front of the hydraulic oil tank 15 as in the present embodiment, at least one of the tank rear surface portion 15*b*, the left side surface portion 15*c*, and the right side surface portion 15*d* is used as the side surface portion of the hydraulic oil tank 15 along which the group of hydraulic hoses 330 is arranged. According to such a configuration, it becomes easy to secure a working space around the hydraulic hose 330, and good maintainability can be obtained.

In particular, in the present embodiment, the group of hydraulic hoses 330 is arranged along the tank rear surface portion 15*b* of the side surface portions of the hydraulic oil tank 15. According to such a configuration, compared to the front side of the hydraulic oil tank 15 in which the fuel tank 14 is disposed, it becomes easy to secure a working space around the hydraulic hose 330, and good maintainability can be obtained.

Further, regarding the arrangement of the control valve 60, the control valve 60 is disposed on the right side which is opposite to the driver's seat 17 side with respect to the hydraulic oil tank 15. According to such a configuration, the control valve 60 and the group of hydraulic hoses 330 can be arranged at a position easily accessible from the outside of the machine body, and thus the maintainability of the control valve 60 and the group of hydraulic hoses 330 can be improved.

Further, the joint member 301 to which the hydraulic hose 330 is connected on the right side on the left and right outside of the control valve 60, is configured to face rearward in such a manner that the hydraulic hose 330 extends rearward. According to such a configuration, the group of hydraulic hoses 330 can be routed straight from the right side of the control valve 60 toward the rear side, and thus the group of hydraulic hoses 330 can be arranged at a relatively easily accessible position, and good maintainability can be obtained for the group of hydraulic hoses 330. Further, for example, in the case of a configuration in which the group of hydraulic hoses 330 extends forward from the control valve 60, since the fuel tank 14 exists on the front side of the hydraulic oil tank 15, it is difficult to secure a working space around the group of hydraulic hoses 330. However, according to the configuration in which the group of hydraulic hoses 330 extends rearward from the right side of the control valve 60, it is relatively easy to secure a working space around the group of hydraulic hoses 330, and good maintainability can be obtained.

Furthermore, in the configuration in which the fuel tank 14 is disposed in front of the hydraulic oil tank 15, for example, in the case of a configuration in which the group of hydraulic hoses 330 extends from the control valve 60 toward the front side which is the fuel tank 14 side, it is difficult to secure an arrangement space for hydraulic equipment such as the oil-water separator 400 provided for the fuel tank 14 around the fuel tank 14 and to dispose the hydraulic equipment at a position where maintenance is easy. Consequently, according to the configuration in which the group of hydraulic hoses 330 is extended rearward from the right side of the control valve 60, it is possible to easily secure the arrangement space of the equipment having a relatively high maintenance frequency such as the oil-water separator 400, for example, around the fuel tank 14 in front of the hydraulic oil tank 15 at a position where maintenance is easy, and it is possible to improve maintainability of the units in the tank chamber 20.

Further, the hose clamp 350 that holds the plurality of hydraulic hoses 330 is provided on the tank rear surface portion 15*b* of the hydraulic oil tank 15. According to such a configuration, the plurality of hydraulic hoses 330 can be reliably arranged along the tank rear surface portion 15*b*, and shaking of the hydraulic hoses 330 due to vibration of the machine body or the like can be suppressed, and thus the hydraulic hoses 330 can be protected.

Further, by the hose clamp 350, the group of the hydraulic hoses 330 routed toward the respective hydraulic actuators 220 arranged at various positions in the excavation work machine 1 can be gathered at a portion on the base end side portion with respect to the tank rear surface portion 15*b*. As a result, the maintainability of the hydraulic hose 330 can be improved.

Further, the hose clamps 350 are provided at a plurality of positions (three positions) in the up-down direction. According to such a configuration, the group of hydraulic hoses 330 can be gathered for each hose clamp 350 in accordance with, for example, a connection destination or the like, and thus good maintainability can be obtained for the group of hydraulic hoses 330. In particular, according to the configuration in which the plurality of hose clamps 350 are arranged in the up-down direction, the group of the hydraulic hoses 330 arranged in the left-right direction along the tank rear surface portion 15*b* can be easily gathered for each hose clamp 350, and good routing performance can be obtained for the group of the hydraulic hoses 330.

Further, the hydraulic equipment support stay 370 for attaching hydraulic equipment such as the oil-water separator 400 is provided on the right outer side of the fuel tank 14. According to such a configuration, it is possible to dispose hydraulic equipment having a relatively high frequency of maintenance at a position in front of the hydraulic oil tank 15 and having relatively good accessibility. As a result, good maintainability can be obtained for the hydraulic equipment provided to the hydraulic oil tank 15 and the fuel tank 14. Further, since the hydraulic equipment support stay 370 is provided at an exposed position on the left and right outside of the fuel tank 14, it is possible to obtain good attachment performance of the hydraulic equipment supported by the hydraulic equipment support stay 370, and thus it is possible to improve productivity.

In particular, according to the configuration in which the hydraulic equipment support stay 370 is supported on the support surface portion 312 of the valve support base 310 via the attachment plate 380, the hydraulic equipment support stay 370 can be supported using the valve support base 310 fixedly provided on the base plate 40. Therefore, the hydraulic equipment support stay 370 can be firmly supported with a simple configuration, and the hydraulic equipment can be provided in a stable state.

The construction machine according to the present invention described above is not limited to the above-mentioned embodiment, and various modes can be adopted to the extent within the scope of the gist of the present invention.

The present technique may have the following configurations. The configurations described below can be selected and combined as appropriate.

(A1)

A construction machine including:

a hydraulic oil tank provided in a tank chamber and storing hydraulic oil that actuates hydraulic actuators;

a driver's seat provided on a lateral side of the tank chamber; and a level gauge that is provided on the driver's seat side of the tank chamber and indicates an amount of the hydraulic oil in the hydraulic oil tank.

(A2)

The construction machine according to (A1), further including a swivel frame provided with the tank chamber and the driver's seat, wherein the level gauge is disposed above a front portion of the swivel frame.

(A3)

The construction machine according to (A1) or (A2), wherein the level gauge is communicatively connected to the hydraulic oil tank via a connection hose.

(A4)

The construction machine according to any one of the (A1) to (A3), further including a fuel tank disposed in front of the hydraulic oil tank, wherein the level gauge is disposed on a lateral side of the fuel tank.

(A5)

The construction machine according to any one of (A1) to (A4), wherein the tank chamber is covered with a cover member provided to be openable and closable, the construction machine further includes an other level gauge that is provided in the tank chamber and indicates an amount of the hydraulic oil in the hydraulic oil tank, and the other level gauge is disposed at a position where the other level gauge can be visually observed in a state where the cover member is opened.

(B1)

A construction machine including a tank provided in a front portion in a tank chamber covered with a cover member provided to be openable and closable, wherein the tank has a step portion in a front portion, and a functional component is provided in a space portion formed above the step portion in the tank chamber.

(B2)

The construction machine according to (B1), wherein the step portion has a rear side surface portion, a side surface portion, and a bottom surface portion, and is a notch-shaped portion that forms the space portion by these surface portions.

(B3)

The construction machine according to (B1) or (B2), further including a swivel frame on which the tank is installed, wherein the functional component is provided in a state of being supported by a support member attached to the swivel frame.

(B4)

The construction machine according to (B3), further including a fixing member for fixing the tank to the swivel frame, wherein the tank is provided to be movable with respect to the swivel frame by releasing fixation by the fixing member.

(B5)

The construction machine according to (B4), further including an other tank provided in the tank chamber and disposed behind the tank, and having, as the fixing member, a first fixing member fixed to each of the other tank and the support member and a second fixing member also serving as the support member.

(B6)

The construction machine according to (B2), wherein the tank is a fuel tank that stores fuel to be supplied to a drive source, the functional component is a fuel supply pump for supplying fuel to the fuel tank, and an operation switch for turning on and off an actuation of the fuel supply pump is provided on the rear side surface portion of the step portion.

(B7)

The construction machine according to (B6), wherein a fuel gauge that indicates an amount of fuel in the fuel tank is provided on the rear side surface portion of the step portion.

(B8)

The construction machine according to (B6) or (B7), wherein a hose accommodating portion that accommodates a suction hose for fuel suction by a fuel supply pump is provided in the tank chamber.

(C1)

A construction machine including:

a hydraulic oil tank provided in a tank chamber and storing hydraulic oil that actuates a plurality of hydraulic actuators;

a control valve for controlling a flow of pressure oil supplied from the hydraulic oil tank to each of the hydraulic actuators; and a plurality of hydraulic hoses extending from the control valve and communicatively connected to each of the hydraulic actuators, wherein the plurality of hydraulic hoses are arranged along a side surface portion of the hydraulic oil tank.

(C2)

The construction machine according to (C1), further including a driver's seat provided on a lateral side of the tank chamber, wherein the control valve is disposed on a side opposite to the driver's seat side with respect to the hydraulic oil tank.

(C3)

The construction machine according to (C1) or (C2), wherein a side surface portion of the hydraulic oil tank is a side surface portion on a rear side.

(C4)

The construction machine according to any one of (C1) to (C3), wherein one end side of each of the hydraulic hoses is connected to a side surface portion on a left and right outside of the control valve via a connection member, and the connection member is configured in such a manner that the hydraulic hoses extend rearward from the side surface portion on the left and right outside.

(C5)

The construction machine according to any one of (C1) to (C4), wherein a holding section that holds an intermediate portion of the hydraulic hoses against a side surface portion of the hydraulic oil tank is provided on the side surface portion of the hydraulic oil tank.

(C6)

The construction machine according to (C5), wherein the holding section is provided at a plurality of locations above and below.

(C7)

The construction machine according to any one of the (C1) to (C6), further including a fuel tank disposed in front of the hydraulic oil tank, wherein an equipment attachment section for attaching hydraulic equipment provided to a path of hydraulic oil stored in the hydraulic oil tank or a path of fuel stored in the fuel tank is provided on a left and right outside of the fuel tank.

(C8)

The construction machine according to any one of (C2), wherein the tank chamber is covered with a cover member provided to be openable and closable, an operation pattern switching unit that is provided on a front side of the fuel tank in the tank chamber and switches a pattern of hydraulic pressure input to the control valve in response to an operation of an operation unit provided near the driver's seat to thereby switch an operation pattern of the operation unit is included, and the operation pattern switching unit is disposed at a position where a switching operation can be performed in a state where the cover member is opened.

REFERENCE SIGNS LIST

1 excavation work machine (construction machine)
7 swivel frame
11 traveling hydraulic motor
12 engine (drive source)
14 fuel tank (tank)
15 hydraulic oil tank (other tank)
**15*b*** rear surface portion (side surface portion)
16 cabin
17 driver's seat
18 left side work operation lever (operation unit)
19 right side work operation lever (operation unit)
20 tank chamber
24 boom cylinder
25 arm cylinder
26 bucket cylinder
29 swing cylinder
40 base plate
42 bulkhead portion
44 upper front frame
47 partition plate
50 opening portion
55 hood (cover member)
60 control valve
**60*a*** right side surface portion
70 level gauge
74 upper connection hose
75 lower connection hose
100 other level gauge
110 step portion
**110*a*** rear side surface portion
**110*b*** left side surface portion (side surface portion)
**110*c*** bottom surface portion
111 space portion
120 fuel supply pump (functional component)
121 suction hose
130 support bracket (support member, fixing member, second fixing member)
145 hose accommodating portion
150 operation switch
160 fuel gauge
170 fixing/holding plate (fixing member, first fixing member)
200 multivalve (functional component, operation pattern switching unit)
220 hydraulic actuator
301 joint member (connection member)
310 valve support base
330 hydraulic hose
350 hose clamp (holding section)
370 hydraulic equipment support stay (equipment attachment section)
400 oil-water separator (hydraulic equipment)
401 solenoid proportional valve (hydraulic equipment)
402 solenoid proportional valve (hydraulic equipment)

The invention claimed is:

1. A construction machine comprising:

a hydraulic oil tank provided in a tank chamber and configured to store hydraulic oil, the hydraulic oil configured to actuate a plurality of hydraulic actuators;

a control valve configured to control a flow of pressure oil supplied from the hydraulic oil tank to each of the hydraulic actuators; and a plurality of hydraulic hoses extending from the control valve and communicatively connected to each of the hydraulic actuators, wherein the plurality of hydraulic hoses are arranged along a side surface portion of the hydraulic oil tank, and wherein at least one hydraulic hose of the plurality of hydraulic hoses is directed laterally and rearward from a first lateral side of the control valve to a second lateral side of the control valve.

2. The construction machine according to claim 1, further comprising a driver's seat provided on a lateral side of the tank chamber, wherein the control valve is disposed on a side opposite to the driver's seat side with respect to the hydraulic oil tank.

3. The construction machine according to claim 1, wherein the side surface portion of the hydraulic oil tank is a side surface portion on a rear side.

4. The construction machine according to claim 1, wherein one end side of each of the hydraulic hoses is connected to a side surface portion on a right side of the control valve via a connection member, and the connection member is configured such that the hydraulic hoses extend rearward from the side surface portion on the right side.

5. The construction machine according to claim 1, wherein a holding section configured to hold an intermediate portion of the hydraulic hoses against the side surface portion of the hydraulic oil tank is provided on the side surface portion of the hydraulic oil tank.

6. The construction machine according to claim 5, wherein the holding section comprises one or more vertically-spaced holding sections.

7. The construction machine according to claim 1, further comprising a fuel tank disposed in front of the hydraulic oil tank, wherein an equipment attachment section for attaching hydraulic equipment provided to a path of hydraulic oil stored in the hydraulic oil tank or a path of fuel stored in the fuel tank is provided on a right side of the fuel tank.

8. The construction machine according to claim 7, wherein:

the tank chamber is configured to be covered with a cover member, the cover member configured to be openable and closable, and the construction machine further comprises an operation pattern switching unit that is provided on a front side of the fuel tank in the tank chamber and is configured to switch a pattern of hydraulic pressure input to the control valve in response to an operation of an operation unit provided near the driver's seat to thereby switch an operation pattern of the operation unit, and the operation pattern switching unit is disposed at a position where a switching operation can be performed in a state where the cover member is opened.

9. A construction machine comprising:

a hydraulic oil tank provided in a tank chamber and configured to store hydraulic oil, the hydraulic oil configured to actuate a plurality of hydraulic actuators;

a control valve configured to control a flow of pressure oil supplied from the hydraulic oil tank to each of the hydraulic actuators;

a plurality of hydraulic hoses extending from the control valve and communicatively connected to each of the hydraulic actuators; and a tank provided in a front portion in a tank chamber that is configured to be covered with a cover member, the cover member configured to be openable and closable, wherein:

the plurality of hydraulic hoses are arranged along a side surface portion of the hydraulic oil tank, at least one hydraulic hose of the plurality of hydraulic hoses is directed laterally and rearward from a first lateral side of the control valve to a second lateral side of the control valve, the tank has a step portion in a front portion, and a functional component is provided in a space portion formed above the step portion in the tank chamber.

10. The construction machine according to claim 9, wherein the space portion is defined by a rear side surface portion, a side surface portion, and a bottom surface portion.

11. The construction machine according to claim 10, wherein:

the tank is a fuel tank that is configured to store fuel to be supplied to a drive source, the functional component is a fuel supply pump configured to supply the fuel to the fuel tank, and an operation switch configured to turn on and off an actuation of the fuel supply pump is provided on the rear side surface portion of the step portion.

12. The construction machine according to claim 11, wherein a fuel gauge configured to indicate an amount of fuel in the fuel tank is provided on the rear side surface portion of the step portion.

13. The construction machine according to claim 11, wherein a hose accommodating portion that is configured to accommodate a suction hose for fuel suction by a fuel supply pump is provided in the tank chamber.

14. The construction machine according to claim 9, further comprising a swivel frame on which the tank is installed, wherein the functional component is fixed to a support member attached to the swivel frame.

15. The construction machine according to claim 14, further comprising a fixing member configured to selectively fix the tank to the swivel frame, wherein the tank is provided and configured to be selectively positioned with respect to the swivel frame based on operation of the fixing member.

16. The construction machine according to claim 15, further comprising a second tank provided in the tank chamber and disposed behind the tank, wherein the second tank is selectively fixed via the fixing member.

17. A construction machine comprising:

a hydraulic oil tank provided in a tank chamber and configured to store hydraulic oil, the hydraulic oil configured to actuate a plurality of hydraulic actuators;

a control valve configured to control a flow of pressure oil supplied from the hydraulic oil tank to each of the hydraulic actuators;

a plurality of hydraulic hoses extending from the control valve and communicatively connected to each of the hydraulic actuators;

a driver's seat provided on a lateral side of the tank chamber; and a level gauge that is provided on the driver's seat side of the tank chamber and that is configured to indicate an amount of the hydraulic oil in the hydraulic oil tank, and wherein the plurality of hydraulic hoses are arranged along a side surface portion of the hydraulic oil tank, and wherein at least one hydraulic hose of the plurality of hydraulic hoses is directed laterally and rearward from a first lateral side of the control valve to a second lateral side of the control valve.

18. The construction machine according to claim 17, further comprising a swivel frame provided with the tank chamber and the driver's seat, wherein the level gauge is disposed above a front portion of the swivel frame.

19. The construction machine according to claim 17, wherein the level gauge is communicatively connected to the hydraulic oil tank via a connection hose.

20. The construction machine according to claim 17, wherein:

the tank chamber is configured to be covered with a cover member, the cover member configured to be openable and closable, the construction machine further comprises another level gauge that is provided in the tank chamber and indicates an amount of the hydraulic oil in the hydraulic oil tank, and the other level gauge is disposed at a position where the other level gauge can be visually observed in a state where the cover member is opened.

* * * * *